US008698577B2

(12) United States Patent
Sherrer et al.

(10) Patent No.: US 8,698,577 B2
(45) Date of Patent: Apr. 15, 2014

(54) THREE-DIMENSIONAL MICROSTRUCTURES

(75) Inventors: David Sherrer, Radford, VA (US); Jean-Marc Rollin, Radford, VA (US); Kenneth Vanhille, Blacksburg, VA (US); Marcus Oliver, Blacksburg, VA (US); Steve Huettner, Tucson, AZ (US)

(73) Assignee: Nuvotronics, LLC, Radford, VA (US)

( * ) Notice: Subject to any disclaimer, the term of this patent is extended or adjusted under 35 U.S.C. 154(b) by 292 days.

(21) Appl. No.: 13/176,740

(22) Filed: Jul. 5, 2011

(65) Prior Publication Data

US 2012/0062335 A1 Mar. 15, 2012

Related U.S. Application Data

(60) Provisional application No. 61/361,132, filed on Jul. 2, 2010.

(51) Int. Cl.
*H01P 3/08* (2006.01)

(52) U.S. Cl.
USPC ..... 333/127; 333/134; 333/136

(58) Field of Classification Search
USPC ..... 333/124–127, 134, 136
See application file for complete search history.

(56) References Cited

U.S. PATENT DOCUMENTS

| | | | | |
|---|---|---|---|---|
| 2,502,479 | A * | 4/1950 | Pearson et al. | 330/309 |
| 4,590,446 | A | 5/1986 | Hsu et al. | |
| 4,812,782 | A | 3/1989 | Ajioka | |
| 5,079,527 | A | 1/1992 | Goldfarb | |
| 5,117,377 | A | 5/1992 | Finman | |
| 5,126,704 | A | 6/1992 | Dittmer et al. | |
| 5,222,246 | A | 6/1993 | Wolkstein et al. | |
| 5,736,898 | A | 4/1998 | Kohl et al. | |
| 5,872,491 | A | 2/1999 | Kim et al. | |
| 5,880,648 | A | 3/1999 | Aves et al. | |
| 5,884,143 | A | 3/1999 | Wolkstein et al. | |
| 5,953,811 | A | 9/1999 | Mazzochette | |
| 6,046,609 | A | 4/2000 | Toyoshima et al. | |
| 6,046,649 | A | 4/2000 | Lange | |
| 6,242,984 | B1 | 6/2001 | Stones et al. | |
| 6,483,397 | B2 | 11/2002 | Catoiu | |
| 6,753,807 | B1 | 6/2004 | McLaughlin et al. | |
| 6,799,020 | B1 | 9/2004 | Heidmann et al. | |
| 6,982,613 | B2 | 1/2006 | Wu et al. | |
| 7,012,489 | B2 | 3/2006 | Sherrer | |
| 7,113,056 | B2 | 9/2006 | Wu et al. | |

(Continued)

FOREIGN PATENT DOCUMENTS

| | | |
|---|---|---|
| WO | 2012003506 | 1/2012 |

OTHER PUBLICATIONS

Ali Darwish et al.; Vertical Balun and Wilkinson Divider; 2002 IEEE MTT-S Digest; pp. 109-112.

(Continued)

*Primary Examiner* — Robert Pascal
*Assistant Examiner* — Kimberly Glenn
(74) *Attorney, Agent, or Firm* — Niels Haun; Dann, Dorfman, Herrell & Skillman, P.C.

(57) ABSTRACT

An apparatus comprising a first power combiner/divider network and a second power combiner/divider network. The first power combiner/divider network splits a first electromagnetic signal into split signals that are connectable to signal processor(s). The second power combiner/divider network combines processed signals into a second electromagnetic signal. The apparatus includes a three-dimensional coaxial microstructure.

32 Claims, 31 Drawing Sheets

(56) References Cited

U.S. PATENT DOCUMENTS

| | | | | |
|---|---|---|---|---|
| 7,148,772 | B2 | 12/2006 | Sherrer et al. | |
| 7,227,428 | B2 | 6/2007 | Fukunaga | |
| 7,271,680 | B2 | 9/2007 | Hall et al. | |
| 7,312,673 | B2 | 12/2007 | Wu et al. | |
| 7,382,212 | B2 | 6/2008 | Lo Hine Tong et al. | |
| 7,385,462 | B1 | 6/2008 | Epp et al. | |
| 7,405,638 | B2 | 7/2008 | Sherrer et al. | |
| 7,463,109 | B2 | 12/2008 | Iio | |
| 7,482,894 | B2 | 1/2009 | Wu et al. | |
| 7,616,058 | B1 | 11/2009 | Nezakati et al. | |
| 7,623,006 | B2 | 11/2009 | Ezzeddine et al. | |
| 7,649,432 | B2 | 1/2010 | Sherrer et al. | |
| 7,656,256 | B2 | 2/2010 | Houck et al. | |
| 7,746,175 | B2 | 6/2010 | Rector | |
| 7,755,174 | B2 | 7/2010 | Rollin et al. | |
| 7,898,356 | B2 | 3/2011 | Sherrer et al. | |
| 7,932,781 | B2 | 4/2011 | Lopez | |
| 7,948,335 | B2 | 5/2011 | Sherrer et al. | |
| 8,031,037 | B2 | 10/2011 | Sherrer et al. | |
| 8,319,583 | B2 * | 11/2012 | Huettner | 333/136 |
| 2011/0187453 | A1 | 8/2011 | Deckman et al. | |
| 2012/0062335 | A1 | 3/2012 | Sherrer et al. | |
| 2013/0050055 | A1 | 2/2013 | Paradiso et al. | |

OTHER PUBLICATIONS

Ali Darwish et al.; Three Dimensional Transmission Lines and Power Divider Circuits; 2009 IEEE; pp. 184-190.

Sherrer, D, Vanhille, K, Rollin, J.M., "PolyStrata Technology: A Disruptive Approach for 3D Microwave Components and Modules," Presentation (Apr. 23, 2010).

Comtech EF Data, PCT-4000, 1+1 Phase Combiner Installation and Operation Manual, Revision 2, Oct. 9, 2012. http://www.comtechefdata.com/files/manuals/mn-amplifiers-pdf/mn-pcb4000.pdf.

CPI, Power Amplifer Phase (Power) Combining, Jun. 8, 2005. http://www.ramayes.com/Data%20Files/Communications%20Power%20Industries/CPI%201000-Watt%20Amplifier%20System.pdf.

Dong, Y., et al., "60 GHz Low Loss, Amplitude and Phase Balanced Radial Waveguide Power Combiner", International Conference on Communications and Control, Sep. 9-11, 2011, pp. 4077-4073.

Q Guo et al., A Novel Broadband High-Power Combiner, 2005 IEEE Asia Pacific Microwave Conference Proceedings.

Vanhille, K., et al., "A Capacitively-Loaded Quasi-Planar Ka-Band Resonator", 36th European Microwave Conference, Sep. 10-15, 2006.

Vanhille, K., et al., "Quasi-Planar High-Q Millimeter Wave Resonators", IEEE Transactions on Microwave Theory and Techniques, Jun. 2006.

Written Opinion of the International Searching Authority mailed Jan. 5, 2012 on PCT/US2011/042902.

Saito, Y., Fontaine, D., Rollin, J-M., Filipovic, D., "Micro-Coaxial Ka-Band Gysel Power Dividers," Microwave Opt Technol Lett 52: 474-478, 2010.

Chance, G.I. et al., "A suspended-membrane balanced frequency doubler at 200GHz," 29th International Conference on Infrared and Millimeter Waves and Terahertz Electronics, pp. 321-322, Karlsrube, 2004.

Immorlica, Jr., T. et al., "Miniature 3D micro-machined solid state power amplifiers," COMCAS 2008.

Ehsan, N. et al., "Microcoaxial lines for active hybrid-monolithic circuits," 2009 IEEE MTT-S Int. Microwave.Symp. Boston, MA, Jun. 2009.

Filipovic, D. et al., "Monolithic rectangular coaxial lines. Components and systems for commercial and defense applications," Presented at 2008 IASTED Antennas, Radar, and Wave Propagation Conferences, Baltimore, MD, USA, Apr. 2008.

Filipovic, D.S., "Design of microfabricated rectangular coaxial lines and components for mm-wave applications," Microwave Review, vol. 12, No. 2, Nov. 2006, pp. 11-16.

Ingram, D.L. et al., "A 427 mW 20% compact W-band InP HEMT MMIC power amplifier," IEEE RFIC Symp. Digest 1999, pp. 95-98.

Lukic, M. et al., "Surface-micromachined dual Ka-band cavity backed patch antennas," IEEE Trans. AtennasPropag., vol. 55, pp. 2107-2110, Jul. 2007.

Oliver, J.M. et al., "A 3-D micromachined W-band cavity backed patch antenna array with integrated rectacoax transition to wave guide," 2009 Proc. IEEE International Microwave Symposium, Boston, MA 2009.

Rollin, J.M. et al., "A membrane planar diode for 200GHz mixing applications," 29th International Conference on Infrared and Millimeter Waves and Terahertz Electronics, pp. 205-206, Karlsrube, 2004.

Rollin, J.M. et al., "Integrated Schottky diode for a sub-harmonic mixer at millimetre wavelengths," 31st International Conference on Infrared and Millimeter Waves and Terahertz Electronics, Paris, 2006.

Saito et al., "Analysis and design of monolithic rectangular coaxial lines for minimum coupling," IEEE Trans. Microwave Theory Tech., vol. 55, pp. 2521-2530, Dec. 2007.

Vanhille, K. et al., "Balanced low-loss Ka-band μ-coaxial hybrids," IEEE MTT-S Dig., Honolulu, Hawaii, Jun. 2007.

Vanhille, K. et al., "Ka-Band surface mount directional coupler fabricated using micro-rectangular coaxial transmission lines," 2008 Proc. IEEE International Microwave Symposium, 2008.

Vanhille, K.J. et al., "Ka-band miniaturized quasi-planar high-Q resonators," IEEE Trans. Microwave Theory Tech., vol. 55, No. 6, pp. 1272-1279, Jun. 2007.

Vyas R. et al., "Liquid Crystal Polymer (LCP): The ultimate solution for low-cost RF flexible electronics and antennas," Antennas and Propagation Society, International Symposium, p. 1729-1732 (2007).

Wang, H. et al., "Design of a low integrated sub-harmonic mixer at 183GHz using European Schottky diode technology," From Proceedings of the 4th ESA workshop on Millimetre-Wave Technology and Applications, pp. 249-252, Espoo, Finland, Feb. 2006.

Wang, H. et al., "Power-amplifier modules covering 70-113 GHz using MMICs," IEEE Trans Microwave Theory and Tech., vol. 39, pp. 9-16, Jan. 2001.

Vanhille, K., "Design and Characterization of Microfabricated Three-Dimensional Millimeter-Wave Components," Dissertation, 2007.

Ehsan, N., "Broadband Microwave Litographic 3D Components," Dissertation 2009.

Colantonio, P., et al., "High Efficiency RF and Microwave Solid State Power Amplifiers," pp. 380-395, 2009.

Palacios, T. et al., "High-power AlGaN/GaN HEMTs for Ka-band applications," IEEE Electron Device Letters 26, No. 11 (2005): 781-783.

York, R.A., et al., "Some considerations for optimal efficiency and low noise is large power combiners," IEEE Transactions on Microwave Theory and Techniques, vol. 49, No. 8, Aug. 2001.

Guannella, G., "Novel Matching Systems for High Frequencies,": Brown-Boveri Review, vol. 31, Sep. 1944, pp. 327-329.

Chen, A.C., "Development of Low-Loss Broad-Band Planar Baluns Using Multilayered Organic Thin Films," IEEE Transactions on Microwave Theory and Techniques, vol. 53, No. 11, pp. 3648-3655, Nov. 2005.

Written Opinion of the International Searching Authority mailed Jan. 5, 2012 on PCT/U52011/042902. Jan. 5, 2012.

* cited by examiner

THREE-DIMENSIONAL MICROSTRUCTURES

CROSS-REFERENCE TO RELATED APPLICATIONS

The present application claims priority to U.S. Provisional Patent Application No. 61/361,132 (filed on Jul. 2, 2010), which is hereby incorporated by reference in its entirety.

STATEMENT REGARDING FEDERALLY SPONSORED RESEARCH

The subject matter of the present application was made with government support from the Air Force Research Laboratory under contract numbers FA8650-10-M-1838 and F093-148-1611, and from the National Aeronautics and Space Administration under contract number S1.02-8761. The government may have rights to the subject matter of the present application.

BACKGROUND OF THE INVENTION

Embodiments relate to electric, electronic and/or electromagnetic devices, and/or processes thereof. Some embodiments relate to three-dimensional microstructures and/or processes thereof, for example to three-dimensional coaxial microstructure combiners/dividers, networks and/or processes thereof. Some embodiments relate to processing electromagnetic signals, for example amplifying electromagnetic signals.

Many microwave applications may require lightweight, reliable and/or efficient components, for example in satellite communications systems. There may be a need for a technology to provide high power microwave signal processing, amplifiers for example, in a small modular package that is reliable, adaptable and/or electrically efficient.

BRIEF SUMMARY OF THE INVENTION

Embodiments relate to electric, electronic and/or electromagnetic devices, and/or processes thereof. Some embodiments relate to three-dimensional microstructures and/or processes thereof, for example to three-dimensional coaxial microstructure combiners/dividers, networks and/or processes thereof. Some embodiments relate to processing electromagnetic signals, for example amplifying electromagnetic signals.

According to embodiments, an apparatus may include one or more networks. In embodiments, one or more networks may be configured to pass one or more electromagnetic signals. In embodiments, a network may include one or more combiner/divider networks. In embodiments, one or more portions of a combiner/divider network may include one or more three-dimensional microstructures, for example three-dimensional coaxial microstructures.

According to embodiments, an apparatus may include one or more combiner/divider networks, for example a power combiner/divider network. In embodiments, a combiner/divider network may be configured to split a first electromagnetic signal into two or more split electromagnetic signals. In embodiments, two or more split electromagnetic signals may each be connectable to one or more inputs of one or more electrical devices, for example one or more signal processors. In embodiments, a power combiner/divider network may be configured to combine two or more processed electromagnetic signals into a second electromagnetic signal. In embodiments, two or more split processed signals may each be connectable to one or more outputs of one or more electrical devices. In embodiments, one or more portions of a combiner/divider network may include a three-dimensional microstructure, for example a three-dimensional coaxial microstructure.

According to embodiments, an apparatus may include one or more n-way three-dimensional microstructures. In embodiments, an n-way three-dimensional microstructure may include an n-way three-dimensional coaxial microstructure. In embodiments, an n-way three-dimensional coaxial microstructure may include n ports with n legs connected to a single port, and/or it may have n ports with n legs connected to m ports with m legs. In embodiments, an n-way three-dimensional coaxial microstructure may include an electrical path having a resistive element between two or more legs.

According to embodiments, an n-way three-dimensional coaxial microstructure may include any configuration, for example a 1:2 way three-dimensional coaxial microstructure configuration, a 1:4 way three-dimensional coaxial microstructure configuration, a 1:6 way three-dimensional coaxial microstructure configuration, a 1:32 way three-dimensional coaxial microstructure configuration and/or a 2:12 way three-dimensional coaxial microstructure configuration, and/or the like. In embodiments, an n-way three-dimensional coaxial microstructure may include any combiner/divider configuration, for example a Wilkinson combiner/divider configuration, a Gysel combiner/divider configuration and/or a hybrid combiner/divider configuration. In embodiments, configurations may be modified to increase their bandwidth and/or reduce their loss. In embodiments, configurations may include additional transformers, additional stages and/or tapers.

According to embodiments, an apparatus may include one or more tiered and/or cascading portions. In embodiments, a tiered and/or cascading portion may be one or more combiner/divider networks. In embodiments, two or more n-way three-dimensional coaxial microstructures may be cascading. In embodiments, one or more n-way three-dimensional coaxial microstructures, which may be cascading, may be on different vertical tiers of a apparatus. In embodiments, one or more n-way three-dimensional coaxial microstructures may be on a different vertical tier of an apparatus relative to itself, one or more other n-way three dimensional microstructures, three-dimensional microstructure combiner/divider networks, electronic devices, and/or the like. In embodiments, one or more electrical paths of an n-way three-dimensional coaxial microstructure may be a fraction and/or a multiple of a fraction of a central operational wavelength, for example approximately ¼ of an operational wavelength, ½ of an operational wavelength, and/or the like.

According to embodiments, one or more portions of one or more combiner/divider networks may include an architecture. In embodiments, one or more portions of one or more combiner/divider networks may include an H tree architecture, an X tree architecture, a multi-layer architecture and/or a planar architecture, and/or the like. In embodiments, one or more portions of a combiner/divider network may be inter-disposed with itself, with another portion of another combiner/divider network and/or with one or more electronic devices of an apparatus. In embodiments, one or more portions of a combiner/divider network may be inter-disposed vertically and/or horizontally.

According to embodiments, one or more combiner/divider networks may be on a different vertical tier of an apparatus and/or a different substrate than one or more n-way three dimensional microstructures, three-dimensional microstructure combiner/divider networks, electronic devices, and/or the like. In embodiments, one or more portions of one or more combiner/divider networks may be tapered on one or more axes, for example including a down taper disposed to pass one or more split electromagnetic signals and/or an up taper disposed to pass one or more processed electromagnetic signals. Such down tapers and up tapers may be used to interconnect to ports, on devices or signal processors, at a small pitch, and/or that are of a small size in relation to the coax, and/or that are close together while minimizing loss and maximizing power handling in the rest of the coaxial network.

According to embodiments, an apparatus may include one or more impedance matching structures. In embodiments, an impedance matching structure may include a tapered portion, for example a tapered portion of one or more three-dimensional coaxial microstructures, a down taper disposed to pass one or more split electromagnetic signals and/or an up taper disposed to pass one or more processed electromagnetic signals. In embodiments, an impedance matching structure may include an impedance transformer, an open-circuited stub and/or a short-circuited stub, and/or the like. In embodiments, one or more impedance matching structures may be on a different vertical tier and/or a different substrate of an apparatus relative to one or more n-way three dimensional microstructures, three-dimensional microstructure combiner/divider networks, electronic devices, portions thereof, and/or the like.

According to embodiments, an apparatus may include one or more phase adjusters. In embodiments, a phase adjuster may be disposed between two or more combiner/divider networks. In embodiments, a phase adjuster may be a portion of a jumper. In embodiments, a phase adjuster may include a wire bond jumper configured to change a path length. In embodiments, a phase adjuster may include a variable sliding structure configured to change a path length. In embodiments, a phase adjuster may include placing a fixed length coaxial jumper or may include a monolithic microwave integrated circuit (MMIC) phase shifter. In embodiments, one or more adjusters may be on a different vertical tier and/or a different substrate of an apparatus relative to one or more n-way three dimensional microstructures, three-dimensional microstructure combiner/divider networks, electronic devices, portions thereof, and/or the like. In embodiments, a phase adjuster may include any structure, including a transistor, a cut length of transmission line such as a laser trimmed line, a MMIC phase shifter and/or microelectromechanical system (MEMS) phase shifter, and/or the like. In some preferred embodiments, where the signal processor is a microwave amplifier, the phase shifter may be on an input side of the signal processor to minimize loss.

According to embodiments, an apparatus may include one or more transition structures. In embodiments, a transition structure may be configured to connect to one or more electronic devices of an apparatus, for example one or more signal processors. In embodiments, a transition structure may be configured to connect to one or more electronic devices by employing a connector, a wire, a strip-line connection, a monolithically integrated transition from coax to either a ground-signal-ground or microstrip connection and/or a coaxial-to-planar transmission line structure, and/or the like. In embodiments, one or more transition structures may be an independent structure. In embodiments, one or more transition structures may be on a different vertical tier and/or a different substrate of an apparatus relative to one or more n-way three dimensional microstructures, three-dimensional microstructure combiner/divider networks, electronic devices, portions thereof, and/or the like.

According to embodiments, an apparatus may include one or more portions constructed as a mechanically releasable module. In embodiments, a mechanically releasable module may be of one or more combiner/divider networks. In embodiments, a mechanically releasable module may include one or more combiner/divider networks, n-way three-dimensional coaxial microstructures, impedance matching structures, transition structures, phase adjusters, discrete and/or integrated passives devices such as capacitors, inductors, or resistors, sockets for hybridly placing devices, signal processors and/or cooling structures, and/or the like. In embodiments, a mechanically releasable module may include a heat sink, a signal processor and a three-dimensional microstructure backplane. In embodiments, a mechanically releasable module may be attached by, for example, one or more of a micro-connectors, a spring force, a mechanical snap connection, a solder, or a reworkable epoxy.

According to embodiments, an apparatus may include one or more combiner/divider networks having a three-dimensional microstructure, for example a three-dimensional coaxial microstructure, and one or more waveguide power combiners/dividers, spatial power combiners/dividers and/or electric field probes, and/or the like. In embodiments, one or more combiner/divider networks may include one or more antennas. In embodiments, two or more antennas may be disposed inside a common waveguide. In embodiments, one or more antennas may include an electric field probe to radiate a signal in and/or out of the device. In embodiments, one or more antennas may include an electric field probe which may be disposed inside a common waveguide. In embodiments, one or more waveguide power combiners/dividers, spatial power combiners/dividers and/or electric field probes may be cascading, on a different vertical tier and/or a different substrate of an apparatus relative to one or more n-way three dimensional microstructures, three-dimensional microstructure combiner/divider networks, electronic devices, portions thereof, and/or the like.

According to embodiments, a method may include splitting a first electromagnetic signal into one or more split electromagnetic signals. In embodiments, a method may include transitioning one or more split electromagnetic signals to one or more electronic devices, for example one or more signal processors. In embodiments, a method may include combining two or more processed electromagnetic signals from one or more electronic devices into a second electromagnetic signal. A method may include employing an apparatus in accordance with one or more aspects of embodiments.

BRIEF DESCRIPTION OF THE DRAWINGS

Example

Example

Example

Example

Example

Example

Example

Example

Example

Example

Example

Example

Example

Example

Example

Example

Example

Example

Example

Example

Example

Example

Example

Example

Example

Example

Example

Example

Example

Example

DETAILED DESCRIPTION OF THE INVENTION

Figure 1:
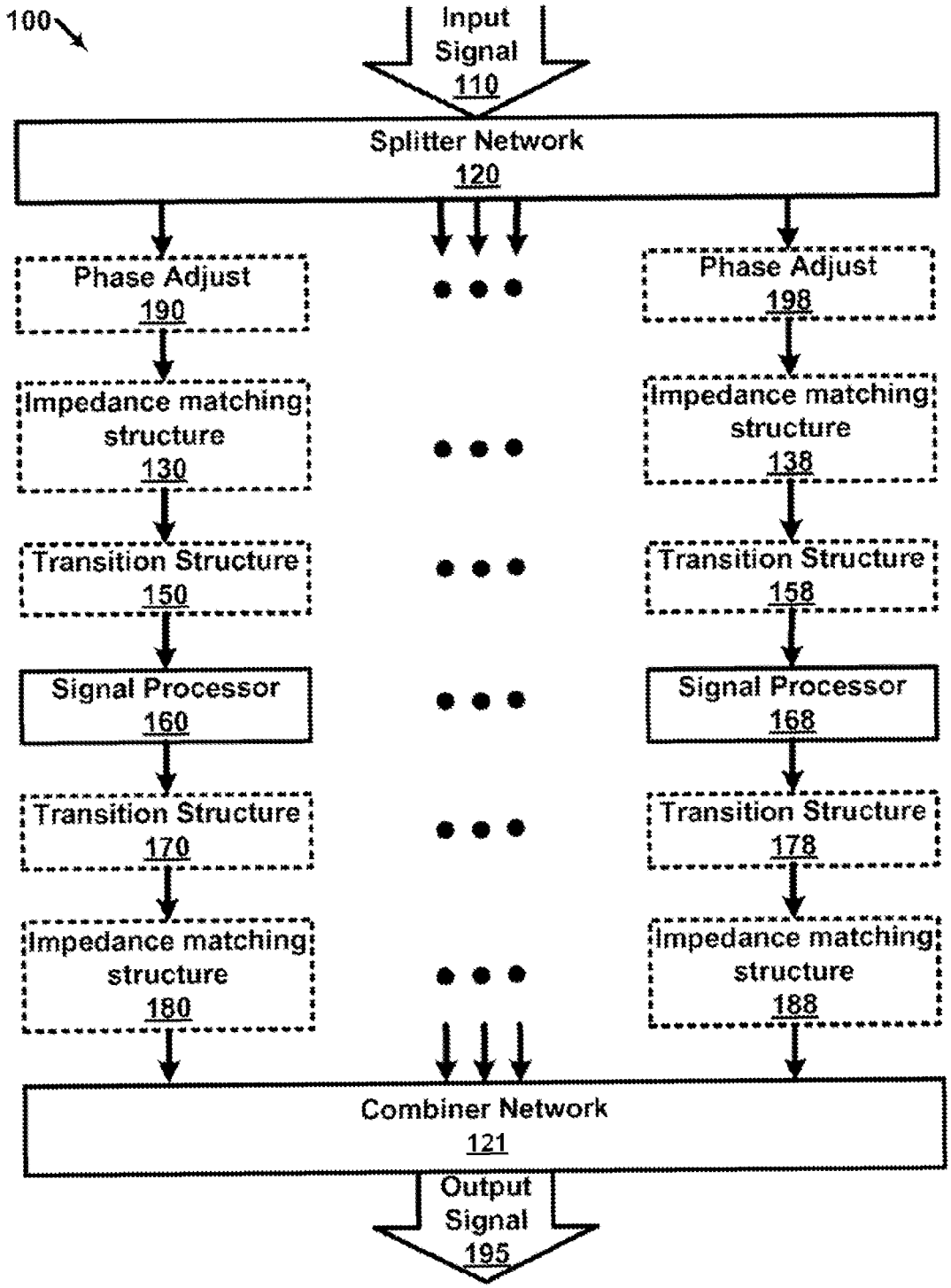
FIG. 1 illustrates one or more elements of an apparatus in accordance with one aspect of embodiments.

Embodiments relate to electric, electronic and/or electromagnetic devices, and/or processes thereof. Some embodiments relate to three-dimensional microstructures and/or processes thereof, for example to three-dimensional coaxial microstructure combiners/dividers, networks and/or processes thereof. Some embodiments relate to processing one or more electromagnetic signals, for example receiving, transmitting, generating, terminating, combining, dividing, filtering, shifting and/or transforming one or more electromagnetic signals.

According to embodiments, it may be possible to create microstructures that bring two or more transmission lines relatively close together in a local area to maintain maximum shielding between lines and/or provide electrically small regions where coaxial center conductors may be accessed and/or bridged by one or more devices such as a resistor. In embodiments, for example in bridge resistors for Wilkinson combiners, electrically small may be in relation to the wavelength of operation mean, for example regions less than approximately 1/10 of a wavelength and/or where a resistor may be decoupled from a ground plane by a distance such as approximately 10, 25 or 50 microns. In embodiments, a distance may be a function of adapting the coupling in the device structure, such as a thin-film surface mounted resistor, and/or minimizing the coupling into the substrate ground plane of the adjacent coax, for example coax below it. In embodiments, shielding may be maintained between two or more transmission lines. In embodiments, a shorting resistor may be employed which may be electrically small enough to allow an n-way microstructure, for example a Wilkinson, to be manufactured with the number of coaxial line (N) greater than two. In embodiments, it may be possible to converge N coaxial lines in a spatially small area compared to the shortest operational wavelength of the waves being combined. In embodiments, for example, there may be a localized down-taper. In embodiments, structures may be manufactured including coaxial lines which may converge running parallel to each other and/or where they join together in a radial fashion. In embodiments, one or more portions of an n-way combiner structure may be on more than one vertical level of an apparatus, for example to enable transmission lines to be of maximum size.

According to embodiments, an apparatus may include one or more networks. In embodiments, one or more networks may be configured to pass one or more electromagnetic signals. In embodiments, an electromagnetic signal may include a frequency between approximately 300 MHz and 300 GHz. In embodiments, any frequency for an electromagnetic signal may be supported, for example approximately 1 THz and above. In embodiments, an electromagnetic signal may include microwaves and/or millimeter waves. In embodiments, e-probes and/or antennas may be employed with a coaxial microstructure to minimize coaxial transmission line lengths employed in routing signals over distances, enabling routing to be done in lower loss medium such as in hollow and/or folded waveguide structures. In embodiments, a coaxial microstructure, e-probe and/or waveguide transition may be monolithically fabricated. In embodiments, part of a waveguide may be fabricated separately, for example through precision milling and/or other techniques, and joined on one or more sides of an e-probe/coaxial microstructure to complete a waveguide and/or backshort structure.

According to embodiments, an electrical device of an apparatus may include a signal processor. In embodiments, a signal processor may operate to receive, transmit, generate, terminate, filter, shift and/or transform electromagnetic signals. In one aspect of embodiments, a signal processor may include an amplifier. In embodiments, an amplifier may include a Solid State Power Amplifier (SSPA), for example a V-band SSPA. In embodiments, an integrated circuit may include one or more signal processors, for example a Monolithic Microwave Integrated Circuit (MMIC) including one or more transistors.

According to embodiments, a signal processor may include a semiconductor device, for example formed of a semiconductor material. In embodiments, a semiconductor material may include a compound semiconductor material, for example a III-V compound semiconductor material such as GaN, GaAs and/or InP, and/or the like. In embodiments, a semiconductor material may include any other semiconductor material, for example a group IV semiconductor such as SiGe. In embodiments, a semiconductor device may include a high electron mobility transistor (HEMT), for example an AlGaN/GaNHEMT.

According to embodiments, an apparatus may include one or more combiner/divider networks. In one aspect of embodiments, one or more portions of a apparatus, for example one or more portions of a combiner/divider network, may include one or more three-dimensional coaxial microstructures. Examples of three-dimensional microstructures are illustrated at least in U.S. Pat. Nos. 7,012,489, 7,148,772, 7,405,638, 7,649,432, 7,656,256, 7,755,174, 7,898,356 and/or 7,948,335, and/or U.S. patent application Ser. Nos. 12/608,870, 12/785,531, 12/953,393, 13/011,886, 13/011,889, 13/015,671 and/or 13/085,124, each of which are hereby incorporated by reference in their entireties.

Referring to example FIG. 1, one or more elements of an apparatus are illustrated in accordance with aspects of embodiments. According to embodiments, an apparatus may include one or more combiner/divider networks. As illustrated in one aspect of embodiments in FIG. 1, apparatus 100 may include one or more combiner/divider networks 120. In embodiments, one or more combiner/divider networks 120 may be configured to split first electromagnetic signal 110 into two or more split electromagnetic signals. In embodiments, two or more split electromagnetic signals may each be connectable to one or more inputs of one or more electrical devices, for example split electromagnetic signals connectable to signal processors 160 . . . 168. In embodiments, one or more portions of combiner/divider networks 120 may include a three-dimensional microstructure, for example a three-dimensional coaxial microstructure such as a three-dimensional coaxial microstructure with a primarily air dielectric.

As illustrated in another aspect of embodiments in FIG. 1, apparatus 100 may include one or more combiner/divider networks 120, 121. In embodiments, one or more combiner/divider networks 120, 121 may be configured to combine two or more processed electromagnetic signals into a second electromagnetic signal 195. In embodiments, two or more processed electromagnetic signals may each be connectable to one or more outputs of one or more electrical devices, for example processed electromagnetic signals each connectable to signal processors 160 . . . 168. In embodiments, one or more portions of combiner/divider network 120, 121 may include a three-dimensional microstructure, for example a three-dimensional coaxial microstructure.

According to embodiments, any configuration for a combiner/divider and/or combiner/divider network may be employed. In embodiments, for example, a 1:32 way three-dimensional coaxial microstructure and/or network may be employed. In embodiments, as another example, a 2:12 way three-dimensional coaxial microstructure and/or network may be employed. In embodiments, one or more combiner/divider and/or combiner/divider networks may be cascading. In embodiments, one or more combiner/divider and/or combiner/divider networks may be tiered. In embodiments, one or more combiner/divider and/or combiner/divider networks may be cascading and/or tiered. In embodiments, one or more combiner/divider and/or combiner/divider networks may include a three-dimensional coaxial microstructure.

According to embodiments, one or more combiner/divider and/or combiner/divider networks may include a three-dimensional coaxial microstructure having a transition structure to provide mechanical and/or electrical transitions to contact with one or more signal processors. Such transition structures may include a down taper and may be optimized to transition or interface to a planar transmission line, such as a microstrip or coplanar waveguide (CPW) mode on the signal processor. In embodiments, one or more microcoaxial combiner/divider networks may include a Wilkinson coupler, for example a three-way Wilkinson with a delta resistor and/or an n-way Wilkinson coupler. In embodiments, one or more microcoaxial combiner/divider networks may include a quadrature coupler, for example a coupled line coupler, a branchline coupler and/or a Wilkinson coupler in a quadrature combining mode having ¼ wave transformers added to half of the ports. In embodiments, one or more microcoaxial combiner/divider networks may include a traveling wave combiner. In embodiments, one or more microcoaxial combiner/divider networks may include an in-phase combiner, for example a n-way Gysel, a ratrace and/or a cascaded ratrace combiner. In embodiments, one or more combiner/divider and/or combiner/divider networks may include any configuration, for example waveguide combiners/dividers, spatial power combiners/dividers and/or electric field probes.

According to embodiments, an apparatus may include one or more n-way three-dimensional microstructures. In embodiments, an n-way three-dimensional coaxial combiner/divider microstructure may include one or more first microstructural elements and/or second microstructural elements. In embodiments, a first microstructural element and/or a second microstructural element may include any material, for example conductive material such as example copper, insulation material such as a dielectric, and/or the like. In embodiments, a first microstructural element and/or a second microstructural element may be formed of one or more strata and/or layers, and/or may include any thickness.

According to embodiments, a first microstructural element may be substantially surrounded by a second microstructural element, such that a first microstructural element may be an inner microstructural element and a second microstructural element may be an outer microstructural element. In embodiments, one or more first microstructural elements may be spaced apart from one or more second microstructural elements. In embodiments, a first microstructural element may be spaced apart from a second microstructural element by a non-solid volume, for example a gas such as oxygen and/or argon, and/or the like. In embodiments, all or a portion of a non-solid volume may be replaced with a circulating or non-circulating fluid, such as a refrigerant to provide a cooling function to circuits in operation. In embodiments, a portion of a solid volume of a microstructure may provide mechanical structures, for example posts extending into a channel to provide turbulent and/or impingement interaction with a circulating and/or noncirculating fluid, for example a refrigerant or liquid to provide a cooling function to the circuits in operation. In embodiments, a first microstructural element may be spaced apart from a second microstructural element by a vacuous state. In embodiments, a first microstructural element may be spaced apart from a second microstructural element by an insulation material, for example dielectric material.

Figure 2:
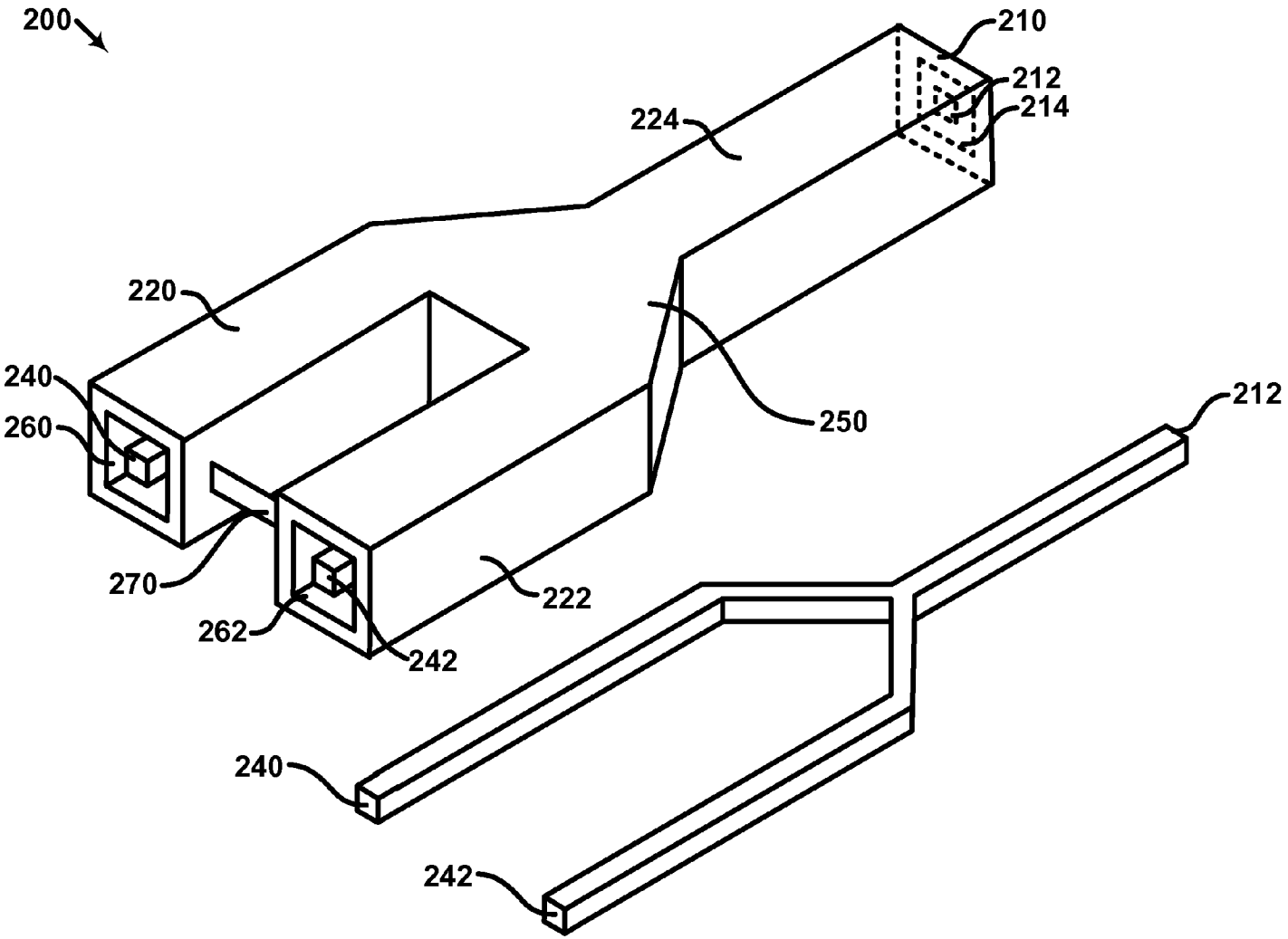
FIG. 2 illustrates an n-way three-dimensional coaxial microstructure in accordance with one aspect of embodiments.

Referring to example FIG. 2, an n-way three-dimensional microstructure is illustrated in accordance with aspects of embodiments. According to the embodiments illustrated in FIG. 2, 1:2 way three-dimensional coaxial combiner/divider microstructure 200 may include port 210 and/or legs 220, 222 and/or 224. In embodiments, 1:2 way three-dimensional coaxial combiner/divider microstructure 200 may include first microstructural elements 212, 240 and/or 242, and/or may include second microstructural element 250, each including conductive material. In embodiments, microstructural element 212 may branch to microstructural elements 240 and 242. As illustrated in another aspect of embodiments in FIG. 2, first microstructural elements 212, 240 and/or 242 may be spaced apart from second microstructural element 250 by volumes 214, 260 and/or 262, respectively, for example spaced apart by air, vacuum and/or a gas such nitrogen, argon and/or $SF_6$ chosen to reduce electrical breakdown, and/or a liquid such a Fluorinert™, manufactured by 3M, filling at least a portion of the volume to provide cooling to the structures.

According to embodiments, one or more first microstructural elements may be electrically connected to form an electrical path through an n-way three-dimensional coaxial combiner/divider microstructure. As illustrated in one aspect of embodiments in FIG. 2, first microstructural elements 212, 240 and/or 242 may be connected to form an electrical path through 1:2 way three-dimensional coaxial combiner/divider microstructure 200. In embodiments, an operational wavelength may be considered to configure an electrical path through an n-way three-dimensional coaxial microstructure. In embodiments, for example, the length of a first microstructural element of an n leg may be a fraction of an operational wavelength. In embodiments, an operational wavelength may reference a central chosen operational wavelength in a chosen band of operation for an apparatus. In embodiments, for example, the length of a first microstructural element of an n leg may be approximately ¼ of an operational wavelength, the length of first microstructural elements 240 and/or 242 of legs 220 and 222, respectively, may be approximately ¼ of an operational wavelength between the point where they branch to one or more lines (e.g., branch to first microstructural element 212) and the point where they meet in resistor 270. Resistor 270 may be representative of a Wilkinson configuration and bridge electrically only to center conductors 240 and 242. Resistor 270 may not be in electrical contact with the outer conductor 250 of the coax but pass through it in this schematic. Actual methods to interconnect resistors are various and an actual representative method is detailed in and discussed in FIG. 22. In embodiments, the distance from first microstructural elements 240 to 242 may be approximately ½ of an operational wavelength between ports where measured from, and bridged in or by, resistor 270. In embodiments, an electrical configuration of a Wilkinson coupler/divider network may be represented, and such distances may be adapted in length and/or structure to provide a desired improved function. Additional quarter wave segments may be added to improve bandwidth, and electrical path lengths and resistive values may be optimized using software such as Ansoft's HFSS® or Designer® or Agilent's ADS®.

According to embodiments, an n-way three-dimensional coaxial microstructure may include an electrical path having one or more resistive elements between two or more legs. As illustrated in one aspect of embodiments in FIG. 2, 1:2 way three-dimensional coaxial combiner/divider microstructure 200 may include an electrical path between legs 220, 222 and/or 224 having resistive element 270. In embodiments, resistive element 270 may be disposed on or include insulation material, for example dielectric material. In embodiments, resistive element 270 may be formed of one or many layers, and/or may include any thickness. In embodiments, resistor 270 may be a thin film resistor, for example made of TaN, TiW, $RuO_2$, SiCr, NiCr, and/or an epi and/or a diffused resistor, or other materials known in the art of thin film and thick film microelectronics. In embodiments, a resistor may include one or more protective layers such a $SiO_2$, $Si_3N_4$, SiON, and/or other dielectrics. In embodiments, resistors may be deposited on a high thermal conductivity dielectric and/or semiconductor substrate such as BeO, Synthetic Diamond, AlN, SiC, and/or Si, and/or may be on $Al_2O_3$, $SiO_2$, quartz, low temperature co-fired ceramic (LTCC), and/or like materials. Substrate materials may be chosen for resistors based on their power handling requirements given their electrical size in the circuit and typically resistors in such a configuration may be designed to be less than 1/10 of a wavelength at the upper frequency of operation of the circuit. Generally, low K substrates may be desirable, such as quartz if the power handling of the resistor is low under worst case operating conditions. For high power devices, resistors may be disposed on high thermal conductivity substrates to allow them to be sufficiently electrically small given the power handling limitations of the resistive films and materials used in their construction. Resistors for these designs may be for example made of a patterned film of TaN and disposed on a high thermal conductivity material such as BeO, AlN, or synthetic diamond.

According to embodiments, resistive element 270 may be formed on a separate substrate, assembled and/or be part of a carrier substrate. In embodiments, resistors may be grown monolithically into a three-dimensional microstructure disposed on a integrated dielectric material and/or placed in a circuit hybridly, for example using a surface mount component. In embodiments, a resistive element may be placed in a circuit, for example by employing solder, conductive epoxy, metallic bonding, and/or the like. In embodiments, a resistive element may be bonded in a circuit, for example using thermo-compression bonding. In embodiments, resistors may be surface mount components. In embodiments, a resistor may be placed into sockets and/or receptacles in a three-dimensional microstructure to enable coaxial-to-planar interconnection between a three-dimensional microstructure and a resistor. According to embodiments, resistive element 270 may traverse the thickness of second microstructural element 250 and/or volumes 260, 262, for example to contact first microstructural elements 240 and 242. In embodiments, the ground plane outer conductor 250 of legs 220 and 222 may be removed from a region to facilitate the mounting or bridging of a resistor element. In embodiments, the center conductors 240 and 242 may branch out of their axis a small distance to exit through an aperture in the ground plane surface of 220 and 222 to electrically connect to the resistive element, similar to a variation of FIG. 10. In embodiments, one or more portions of resistive element 270 may be adjacent to, and/or embedded in, one or more first microstructural elements and/or second microstructural elements. In embodiments, an operational wavelength may not need to be considered to configure an electrical path through an n-way three-dimensional coaxial microstructure. In embodiments, for example, an operational wavelength may not need to be considered to configure an electrical path between a resistive element and one or more first microstructural elements, for example where the distance between a resistive element and one or more first microstructural elements may be relatively small, such as less than approximately 10 times smaller than the wavelength.

Figure 23A:
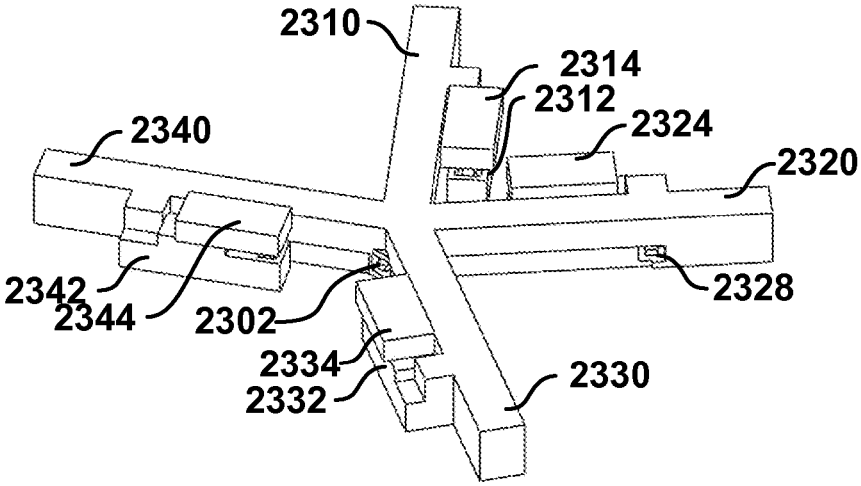
FIGS. 23A to 23B illustrate an n-way three-dimensional microstructure in accordance with one aspect of embodiments.
Figure 23B:
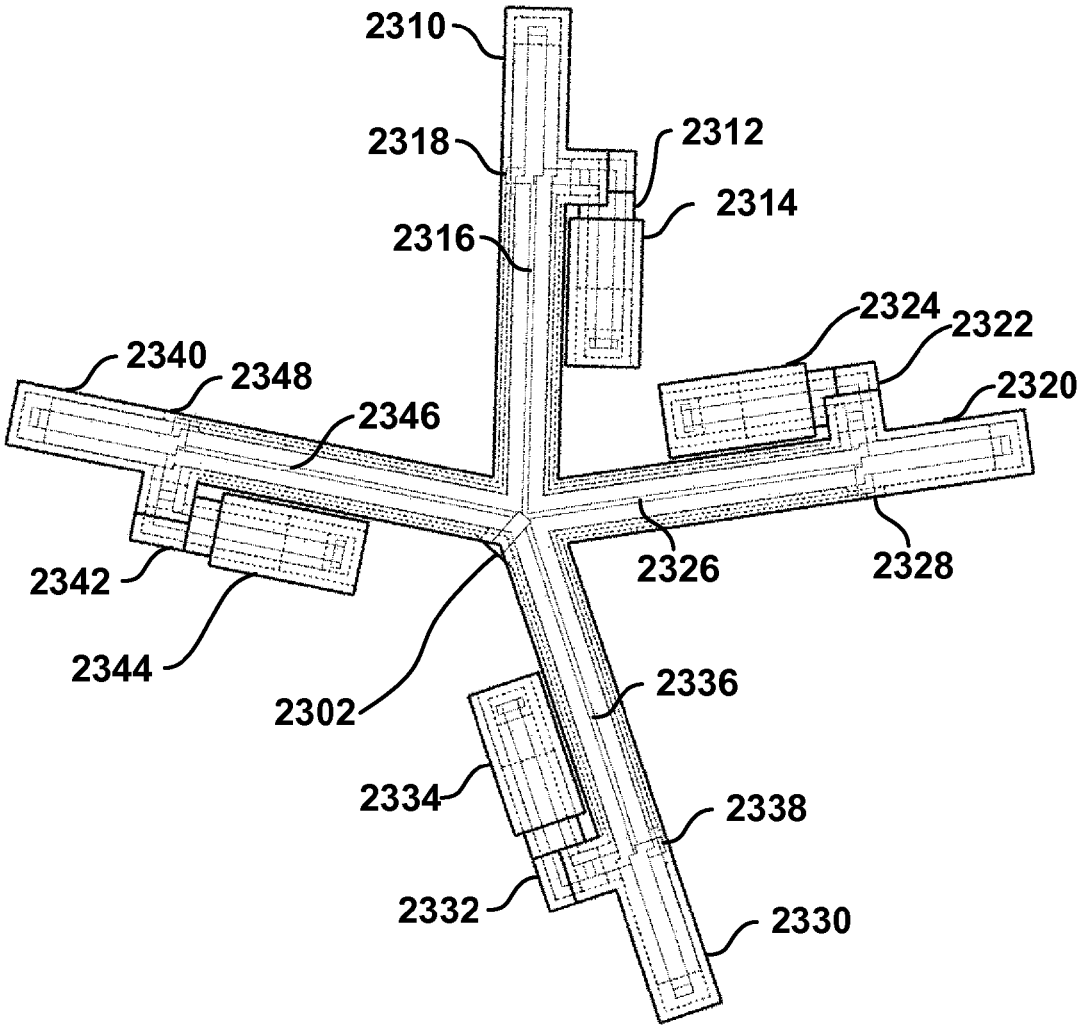

According to embodiments, a reactive divider/combiner may be utilized in some splitter combiner applications. In this case, a coax can divide N times without the use of isolation resistors or quarter wave segments. Such a structure provides no protection between ports and is generally not used in MMIC PA amplifier construction to protect devices in the event, for example, of failure or amplitude imbalance between one or more devices in the circuit. In some applications, for example when power combining semiconductor devices directly on a wafer or chip, for example of complementary metal-oxide semi-conductor (CMOS) or SiGe power amplifiers, device protection may not be necessary. Thus, in some applications, an operational wavelength may not need to be considered to configure an electrical path between resistive element 270 and/or first microstructural elements 240, 242. In embodiments, resistive element 270 may minimize the impact of a circuit degradation, shorting, and/or opening, for example by isolating faults such that the power of 1:2 way three-dimensional coaxial combiner/divider microstructure 200 may be substantially maintained. In embodiments, for example where a resistor is not required because signal processing devices connected to one or more n-way three-dimensional microstructures may be insensitive to the need for isolation between ports and/or legs, any reactive divider technique may be employed and a port may branch into m ports as required. Alternative structures that power combine but also provide port isolation may have different requirements from the Wilkinson construction, for example in baluns, hybrids, quadrature, and Gysel combiners. An example of a Gysel n-way power combiner is shown in FIG. 23A to FIG. 23B, and described in the relevant section along with an improvement thereon.

According to embodiments, an n-way three-dimensional coaxial microstructure may include one or more additional microstructural elements, for example to further maximize electrical and/or mechanical insulation of an n-way three-dimensional coaxial combiner/divider microstructure. In embodiments, an additional microstructural element may include insulation material substantially surrounding one or more portions of an n-way three-dimensional coaxial combiner/divider microstructure. In embodiments, an additional microstructural element may include a support structure, for example insulation material in contact with a first microstructural element, to support the element.

According to embodiments, an additional microstructural element may maximize mechanical releasable modularity of an n-way three-dimensional coaxial combiner/divider microstructure, for example configured as a coaxial connector, fastener, detent, spring, and/or rail, and/or any other suitable mating interconnect structure. In embodiments, modularity of an n-way three-dimensional coaxial combiner/divider microstructure, or network of them, may be employed irrespective of additional microstructural elements, for example by employing a socket on a substrate having a dimension configured to receive one or more portions of an n-way three-dimensional coaxial combiner/divider microstructure.

According to embodiments, an n-way three-dimensional coaxial combiner/divider microstructure may operate as a combiner and/or a divider. In embodiments, for example, 1:2 way three-dimensional coaxial combiner/divider microstructure 200 may operate as a combiner when legs 220, 222 operate as an input for an electromagnetic signal and/or leg 224 operates as an output for an electromagnetic signal. In embodiments, 1:2 way 3-dimensional coaxial combiner/divider microstructure 200 may operate as a splitter where leg 224 operates as an input for an electromagnetic signal and/or legs 220, 222 operate as an output for an electromagnetic signal. In embodiments, an electromagnetic signal may be received from, and/or transmitted to, an electronic device.

Figures 3A, 3B:
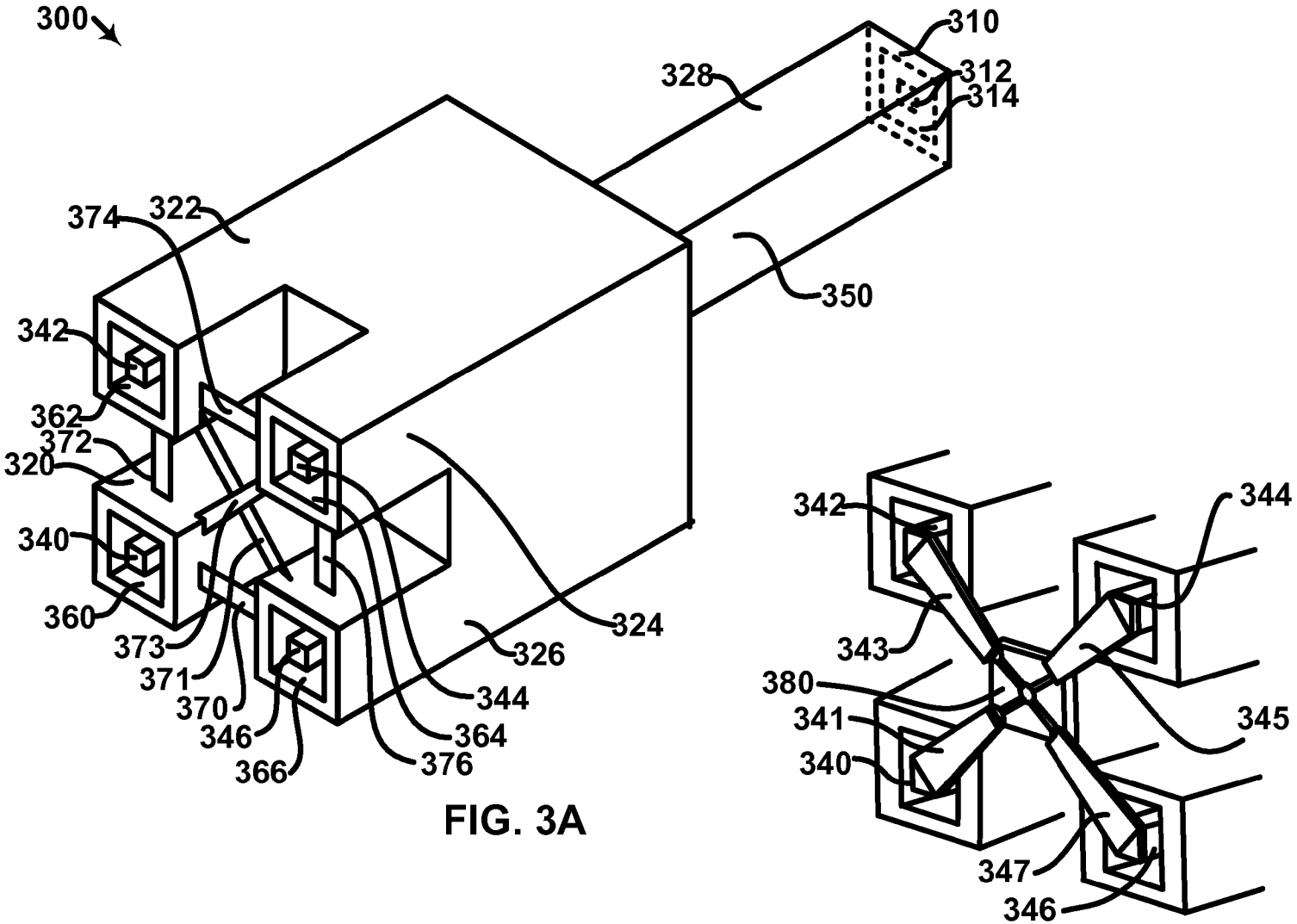
FIGS. 3A to 3B illustrates an n-way three-dimensional coaxial combiner/divider microstructure in accordance with one aspect of embodiments.

Referring to example FIG. 3A to FIG. 3B, an n-way three-dimensional coaxial combiner/divider microstructure is illustrated in accordance with one aspect of embodiments. As illustrated in one example of embodiments in FIG. 3A, 1:4 way three-dimensional coaxial combiner/divider microstructure 300 may include port 310 and/or legs 320, 322, 324 326, and/or 328. In embodiments, 1:4 way three-dimensional coaxial combiner/divider microstructure 300 may include first microstructural elements 312, 340, 342, 344 and/or 346. In embodiments, first microstructural elements 312, 340, 342, 344 and/or 346 may be spaced apart from second microstructural element 350 by volumes 314, 360, 362, 364, and/or 366, respectively. At least two possible resistor combinations may be used. A star configuration 380 where each center conductor (not outer conductor) is bridged together through a shared resistor network with N branches corresponding to the N output ports, in this case four. Alternatively, resistors 372, 374, 376, 370, 371, and 373 may bridge between elements.

Figure 22A:
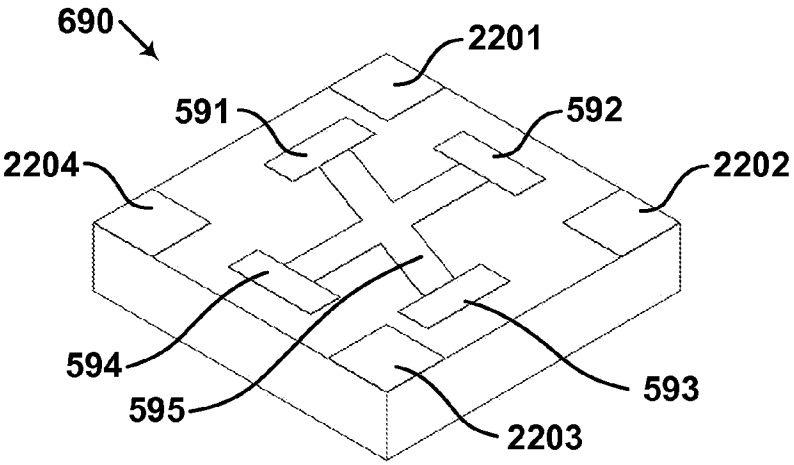
FIGS. 22A to 22D illustrate a resistor configuration in accordance with one aspect of embodiments.

As illustrated in one example of embodiments in FIG. 3B, 1:4 way three-dimensional coaxial combiner/divider microstructure 300, as described FIG. 3A is shown in a configuration for inclusion of a star resistor. While shown with four output ports, it may include one or more m ports and/or n legs. In embodiments, 1:4 way three-dimensional coaxial combiner/divider microstructure 300 may include first microstructural elements 340, 342, 344 and/or 346. In embodiments, first microstructural elements 340, 342, 344 and/or 346 may be spaced apart from second microstructural element 350 by one or more volumes. In embodiments, one or more resistance elements may not be formed to traverse through a second microstructural element. In embodiments, for example, the center conductors of the 4-way Wilkinson shown may have an opening in the outer conductor walls to allow a mounting structure 341, 343, 345 and 347 to extend to form a resistor mounting region. Microstructural elements 340, 342, 344 and/or 346 allow a star resistor 380 to be mounted on one or more surfaces in the center. Similar resistors are shown in FIG. 22A and described in that section. The resistor 380 may be attached to the resistor mounting region through any suitable electrical means including wirebonding, flip chip mounting, solder, conductive epoxy and the like. If the combiner/divider is to handle and dissipate substantial power or heat under certain conditions, a thermal mounting region may be provided. For example, the resistor(s) may protrude from the inner center of the 4-way splitter, the resistor may be thermally grounded on its back substrate surface, and then the resistor(s) may be wirebond attached to mounting arms 343, 345, 347, and 341. In this case, the resistor may be dimensioned to fit between these mounting arms and placed to facilitate short interconnects between them. Other mounting methods would include bridging solder, such as a solder ball, between the resistor and the arms, for example. In practice, ground shielding may be provided around or between the arms and their electrical length may be kept minimal to facilitate resistor mounting. Typically, the center conductors 342, 344, 346 and 340 may continue along with their outer conductors to ports where devices or additional network components of connectors may interface to them. FIG. 3B shows a cut away view not showing the continuation of these ports to terminal ends. In embodiments, FIG. 3B may resemble a star resistor Wilkinson.

According to embodiments, 1:4 way three-dimensional coaxial combiner/divider microstructure 300 may operate as a combiner and/or as a divider. In embodiments, an operational wavelength may be considered to configure an electrical path through 1:4 way three-dimensional coaxial microstructure 300. In embodiments, for example, the length of a first microstructural elements 340, 342, 344 and/or 346 may be approximately ¼ of an operational wavelength, as measured from the resistor bridge to their point of intersection. In embodiments, 1:4 way three-dimensional coaxial combiner/divider microstructure 300 may include an electrical path between legs 320, 322, 324, 326 and/or 328 having resistive elements 370, 371, 372, 373, 374 and/or 376. In embodiments, an operational wavelength may need to be considered to configure an electrical path between resistive elements 370, 371, 372, 373, 374 and/or 376 and first microstructural elements 340, 342, 244 and/or 346, for example if the length between a resistor and the mounting region preferably is below approximately $\lambda/10$ (where $\lambda$ may reference the shortest wavelength of the operating frequency for the device). In embodiments, 1:4 way three-dimensional coaxial combiner/divider microstructure 300 may include one or more additional microstructural elements.

Figure 4:
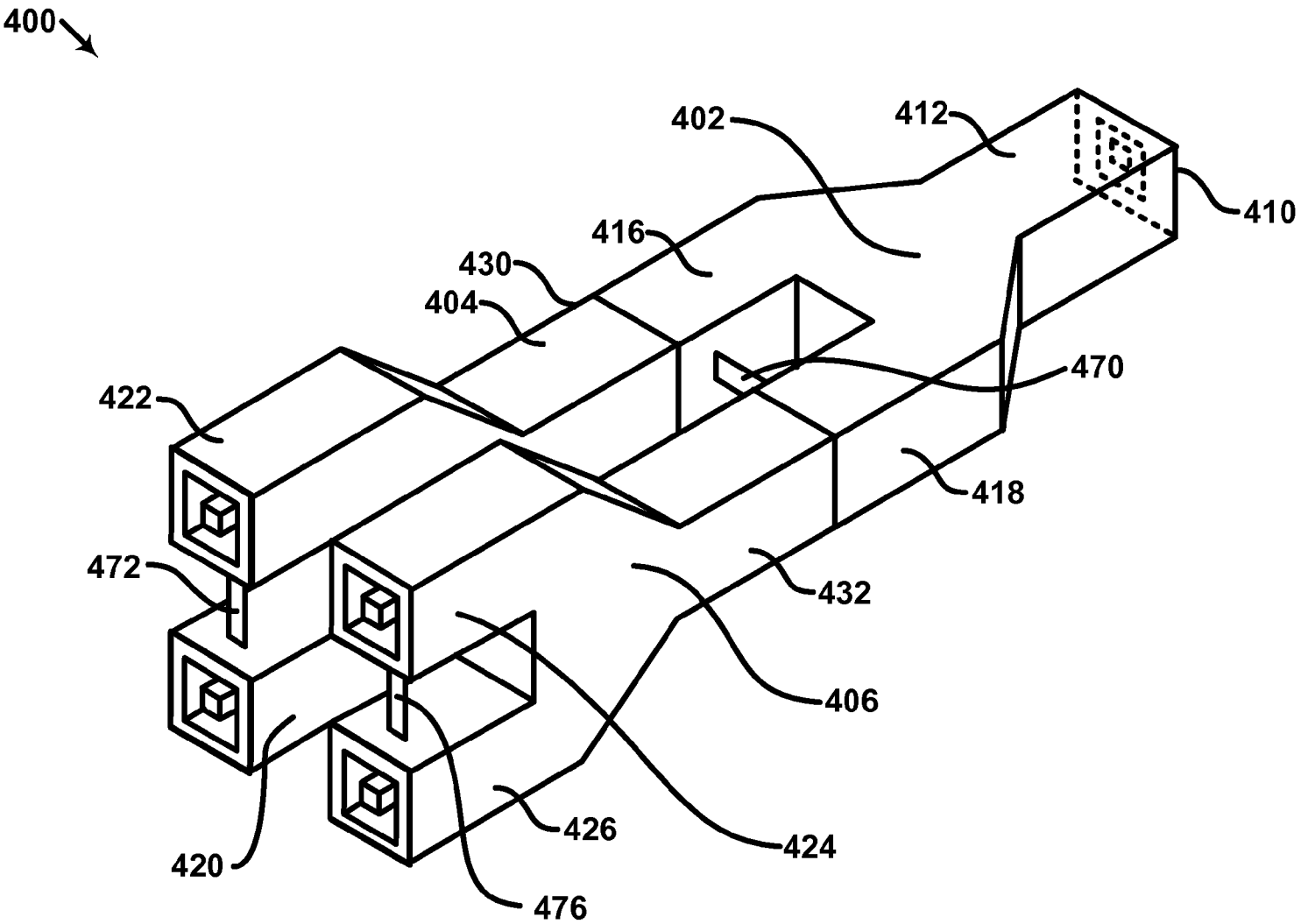
FIG. 4 illustrates a cascading n-way three-dimensional coaxial combiner/divider microstructure in accordance with one aspect of embodiments.

According to embodiments, an apparatus may include one or more cascading portions. In embodiments, a cascading portion may be of one or more combiner/divider networks. In embodiments, a cascading portion may be of N extra sections, for example employed to increase the operating bandwidth. In embodiments, two or more n-way three-dimensional coaxial microstructures may be cascaded. Referring to example FIG. 4, a cascading n-way three-dimensional coaxial combiner/divider microstructure is illustrated in accordance with some aspects of embodiments. In embodiments, cascading 1:4 way three-dimensional coaxial combiner/divider microstructure 400 may be formed by connecting or forming together three 1:2 way three-dimensional coaxial combiner/divider microstructures 402, 404 and/or 406. In embodiments, leg 416 of the 1:2 way three-dimensional coaxial combiner/divider microstructure 402 may be connected to leg 430 of 1:2 way three-dimensional coaxial combiner/divider microstructure 404. In embodiments, leg 418 of 1:2 way three-dimensional coaxial combiner/divider microstructure 402 may be connected to leg 432 of 1:2 way three-dimensional coaxial combiner/divider microstructure 406.

According to embodiments, cascading 1:4 way three-dimensional coaxial combiner/divider microstructure 400 may operate as a combiner and/or as a divider. In embodiments, cascading 1:4 way three-dimensional coaxial combiner/divider microstructure 400 may include an electrical path between legs 412, 420, 422, 424 and/or 426. In embodiments, an operational wavelength may be considered to configure an electrical path through cascading 1:4 way three-dimensional coaxial microstructure 400. In embodiments, for example, the length of a first microstructural element of legs 416, 418, 420, 422, 424, 426, 430 and/or 432, may be approximately ¼ of a operational wavelength from the resistor at one end to their first branching point. In embodiments, cascading 1:4 way three-dimensional coaxial combiner/divider microstructure 400 may include an electrical path between legs 416 and 418, 420 and 422, and/or 424 and 426 having resistive elements 470, 472 and/or 476. In embodiments, an operational wavelength may need to be considered to configure an electrical path between a resistive element and a first microstructural element of legs 416, 418, 420, 422, 424 and/or 426. In embodiments, cascading 1:4 way three-dimensional coaxial combiner/divider microstructure 400 may include one or more additional microstructural elements.

Figure 5A:
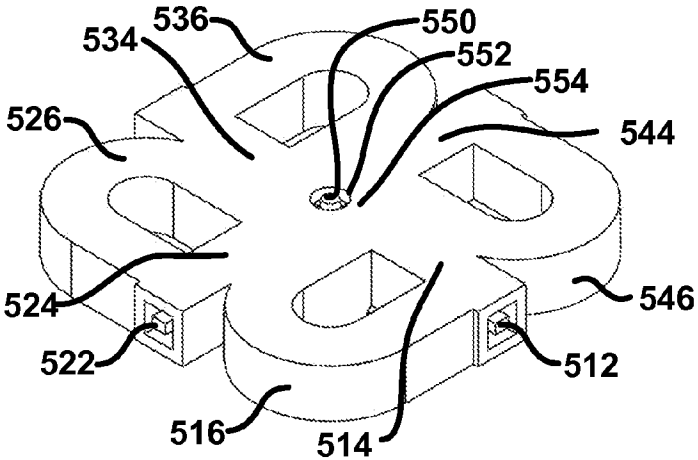
FIGS. 5A to 5C illustrate an n-way three-dimensional coaxial combiner/divider microstructure in accordance with one aspect of embodiments.
Figure 5B:
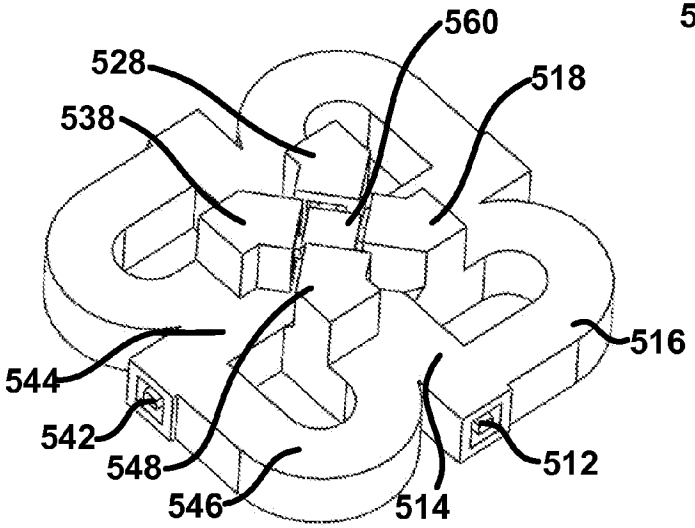
Figure 5C:
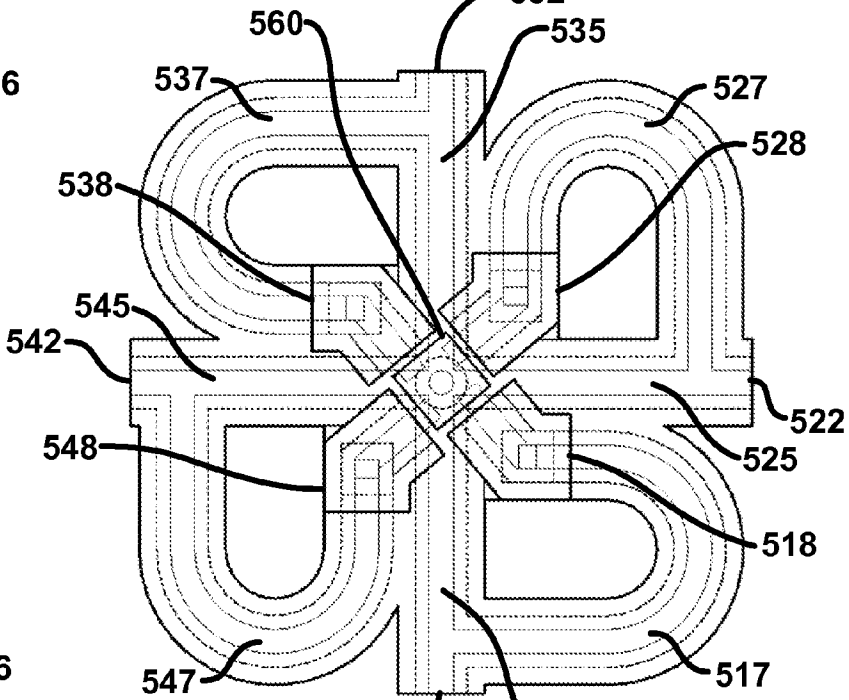

Referring to example FIG. 5A to 5C, an n-way three dimensional coaxial combiner/divider microstructure is illustrated in accordance with embodiments. According to embodiments, 1:4 way three-dimensional coaxial combiner/divider microstructure 500 may include input and/or output ports 512, 522, 532, 542, and/or 552. As illustrated in one aspect of embodiments in FIG. 5A and FIG. 5C, first microstructural elements 515, 525, 535, and/or 545 may be spaced apart from second microstructural element 554, which may be an electrically continuous outer conductor shielding one or more inner conductors. In embodiments, one or more first microstructural elements and second microstructural elements may form a micro-coaxial network, for example a 4:1 Wilkinson power divider/combiner employing half wave connections to a load resistor which may be utilized to reduce routing loss and/or form a relatively electrically small area to place a resistor.

According to embodiments, 1:4 way three-dimensional coaxial combiner/divider microstructure 500 may operate as a combiner and/or as a divider. As illustrated in one aspect of embodiments in FIG. 5A, first microstructural elements 550, 512, 522, 532 and/or 542 may be connected to form an electrical path through 1:4 way three-dimensional coaxial combiner/divider microstructure 500. In embodiments, an operational wavelength may be considered to configure an electrical path through a 1:4 way three-dimensional coaxial microstructure 500. In embodiments, the path from where one or more coaxial microstructures divide from ports 512, 522, 532, and/or 542 may contain $\lambda/2$ segments routing to star resistor 560, for example first microstructural elements 515, 525, 535, and/or 545 and/or $\lambda/4$ segments routing to combiner/divider port 550, for example first arm microstructural elements 517, 527, 537, and/or 547.

Figure 6:
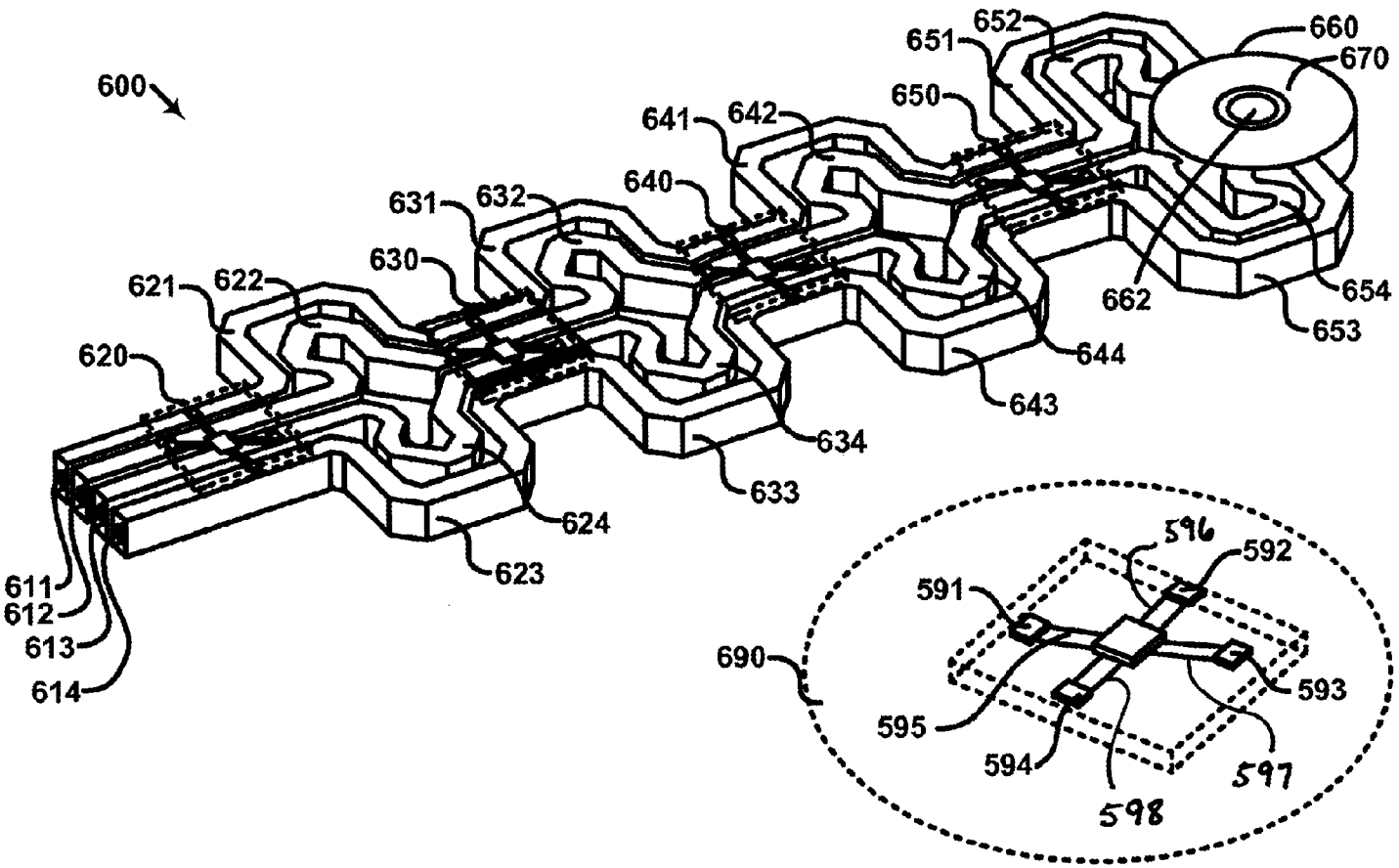
FIG. 6 illustrates an n-way three-dimensional coaxial combiner/divider microstructure in accordance with one aspect of embodiments.

According to embodiments, resistor elements 518, 528, 538, and/or 548 may be formed on a second tier relative to one or more other portions of n-way three dimensional microstructure 500. In embodiments, resistor elements 518, 528, 538 and/or 548 may be disposed on the same level as the resistor and/or a circuit, for example as illustrated in FIG. 6. In embodiments, three-dimensional packaging density may be maximized, line routing may be reduced and/or footprint in a plane may be minimized.

As illustrated in one aspect of embodiments in FIG. 5, a $\lambda/2$ separation for a resistor may aid line routing and/or resistor placement. In embodiments, three-dimensional microstructures may be employed with traditional $\lambda/4$ separations between port 550 and star resistors disposed $\lambda/4$ away. In embodiments, three-dimensional microstructures may include additional quarter wave transformer segments, for example to increase the bandwidth of the devices as illustrated in one aspect of embodiments in FIG. 30. In embodiments, three-dimensional microstructures may be cascaded in and/or out of a plane, and/or may be configured in any number of ports other than four.

According to embodiments, a certain division between two planes of coax, for example between the quantity of transmission lines in a plane of coax including microstructural elements 516, 526, 536, and/or 546 relative to the coax in the tier of resistor elements 518, 528, 538, and/or 548 with resistor 560. In embodiments, alternative divisions may be employed. In embodiments, for example a larger amount of coax may be in an upper or lower tier. In embodiments, for example three or more tiers may be employed to construct the device. In embodiments, the division between layers may be configured relative to one or more variables, for example desired footprint, manufacturing simplicity, minimizing excess line lengths in a circuit and/or other design configurations. As illustrated in one aspect of embodiments in FIG. 5, four ports may be in a plane and a combined and/or divided port may be out of a plane. In embodiments, routings may be opposite and/or the same by adding additional transmission line lengths. In embodiments, an outer conductor may be a solid. In embodiments, an outer conductor may include one or more openings for release holes employed in manufacturing three-dimensional coaxial microstructures.

Referring to example FIG. 6, an n-way three-dimensional coaxial combiner/divider microstructure is illustrated in accordance with one aspect of embodiments. As illustrated in one aspect of embodiments, a 4-stage 4-way Wilkinson power divider/combiner shown may be created in a process, such as the PolyStrata® process and/or other microfabrication technique for creating coaxial, quasi-coaxial and/or related three-dimensional microstructures performing electrical operations. In embodiments, a multistage 4:1 Wilkinson, may include four outputs which may be bridged a by star resistor, for example illustrated at locations 620, 630, 640, and 650. In embodiments, a coax microstructure may provide a shielded and/or relatively electrically small region in which one or more center conductors can exit an outer conductor shielding and/or be bridged, for example by the flip-chip processes to one or more resistor structures, for example, 690. In embodiments, a configuration including one or more mounting regions is illustrated in FIG. 22. In embodiments, any suitable configuration may be employed, for example including embedding resistors on one or more dielectric layers and/or forming them within the coaxial microstructures, and/or defining resistors on a substrate layer and interconnecting to them.

According to embodiments, each of the path lengths may be designed with a series of quarter wave segments, and/or the impedances and resistor values of each segment may be adapted using software such as Agilent's ADS®, or Ansoft's HFSS® or Designer®. In embodiments, four coaxial ports for input and/or output are illustrated at 611, 612, 613, and/or 614. In embodiments, a central combining port may be provided, for example as illustrated at terminal end 660, where the four legs combine together and may take the form of a connector port, such as a coaxial connector, and/or could transition to an e-probe for a waveguide output at this end.

According to embodiments, meandering and/or folding the lengths may reduce the total device size and/or the path length in each repeating segment may be matched. In embodiments, reduction in physical size may be substantially greater in micro-coaxial devices using such meandering line techniques and/or may be achieved due to adjacent line shielding that may not be achieved well in transmission line techniques, such as microstrip, due to adjacent line coupling. In embodiments, impedances may be adjusted in the coax line segments, as desired, by adjusting the gap between one or more center conductors and an outer conductor, for example by providing a larger center conductor and/or by adjusting the inside of the outer conductor inward and/or outward, for example by varying wall thickness or coax diameter.

Figure 14:
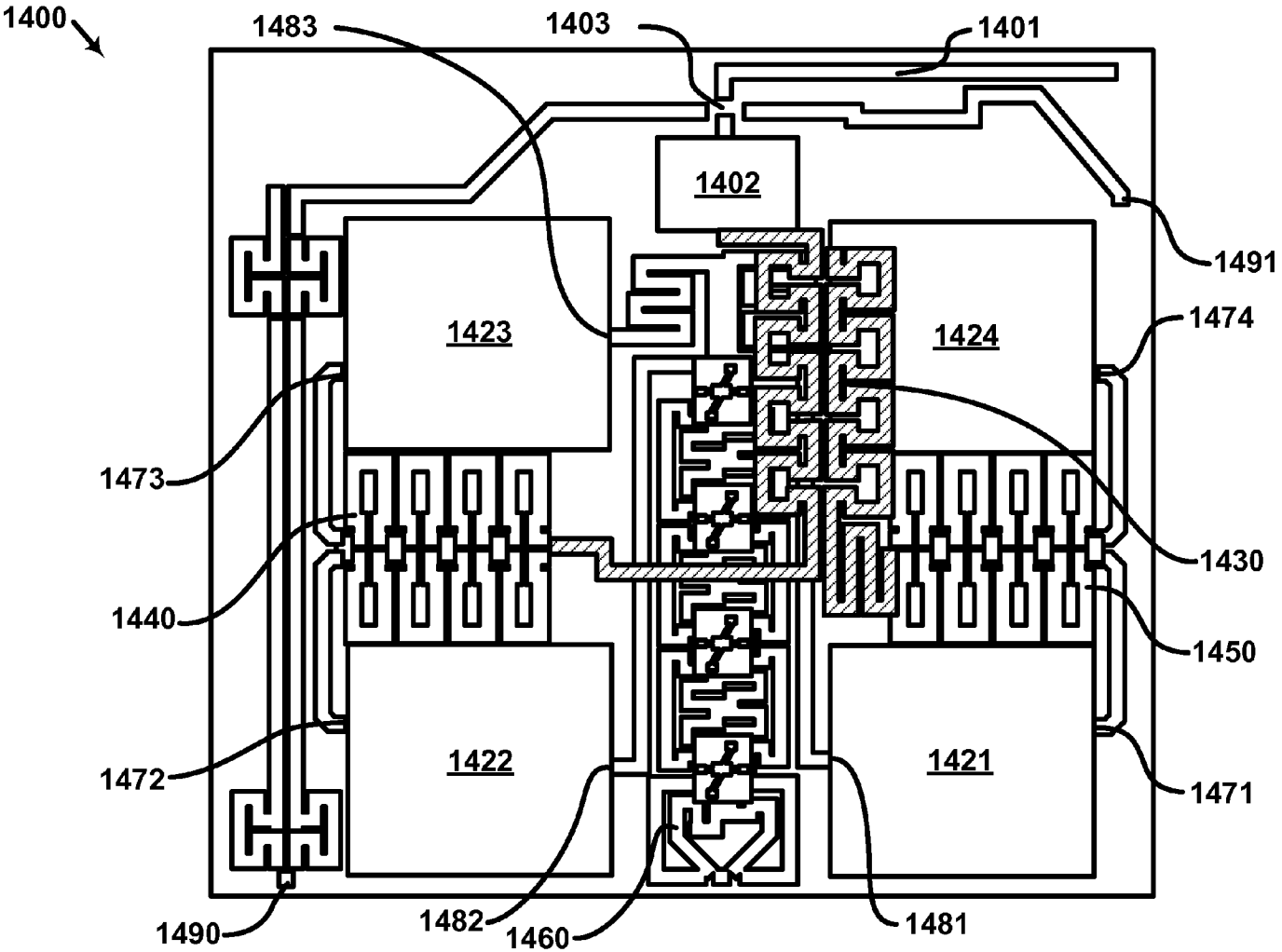
FIG. 14 illustrates an apparatus including a modular configuration in accordance with one aspect of embodiments.
Figure 15:
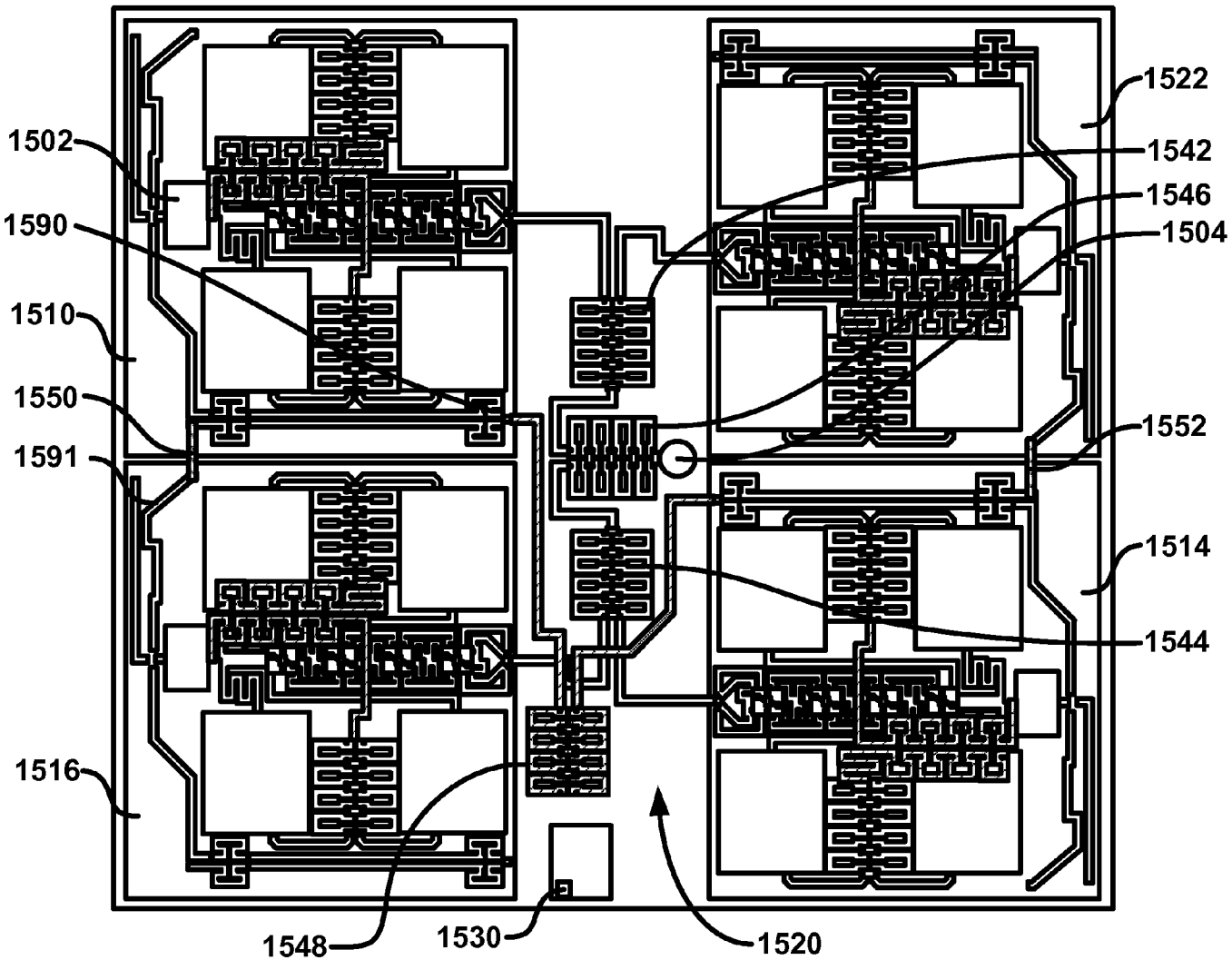
FIG. 15 illustrates an apparatus including a modular configuration in accordance with one aspect of embodiments.
Figure 30:
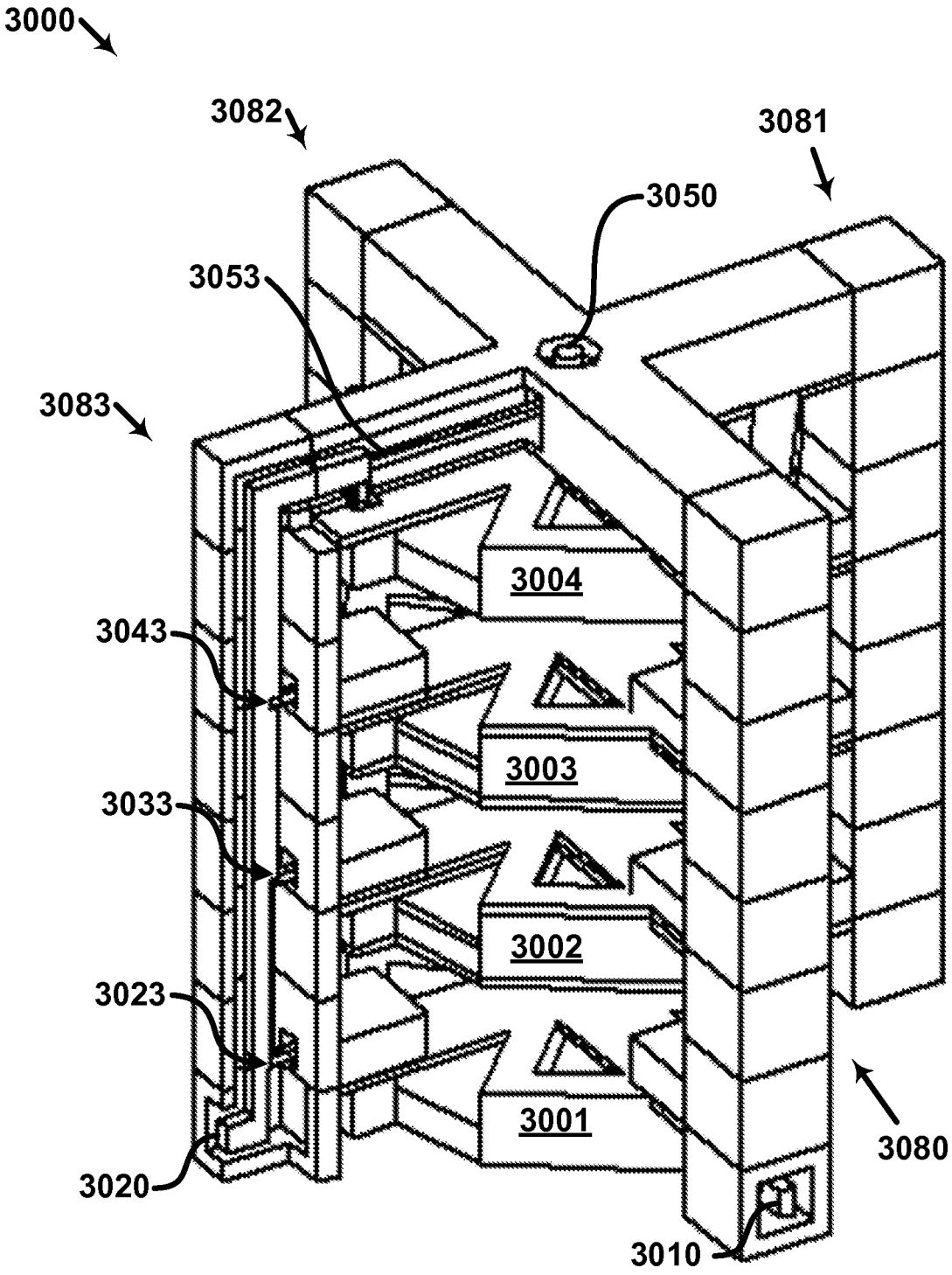
FIG. 30 illustrates n-way three-dimensional coaxial combiner/divider microstructure in accordance with one aspect of embodiments.

According to embodiments, methods of interfacing a resistor such that it may be relatively electrically small compared to the highest frequency of operation may include down-tapering the coax locally in the resistor bridge regions, and/or the resistor may be added using techniques illustrated in FIG. 22. In embodiments, multistage combiners may take various layouts and/or other versions are illustrated in FIG. 14 and FIG. 15. In embodiments, the particular design illustrated may perform equal or similar to that shown in FIG. 24C, and/or the bandwidth can be made greater and/or less by changing the number of quarter wave segments and re-adapting the design. In embodiments, a coaxial microstructure may be disposed in a plane, as illustrated in FIG. 6. In embodiments, it should be clear that the repeating quarter wave segments may be stacked vertically and/or formed either monolithically with embedded resistors and/or assembled from multiple layers, for example as illustrated in FIG. 30.

According to embodiments, 1:4 way three-dimensional coaxial combiner/divider microstructure 600 may include a meandered configuration. According to embodiments, 1:4 way three-dimensional coaxial combiner/divider microstructure 600 may include an input/output port 660 and n legs. In embodiments, for example, a first leg includes portions 621, 631, 641 and/or 651. In embodiments, 1:4 way three-dimensional coaxial combiner/divider microstructure 600 may include first microstructural elements 611, 612, 613 and/or 614, representing center conductors of a coax which may be spaced apart from second microstructural elements 670. In embodiments, for example, first microstructural element 611 of a first leg may be connected to first microstructural element 662 of port 660. In embodiments, for example, first microstructural elements 611, 612, 613 and/or 614 (e.g., center conductors of a coaxial element) may traverse through microstructural element 670 and/or a volume to meet first microstructural element 662 as a final combined output port, for example when the other side of microstructure is an input.

According to embodiments, 1:4 way three-dimensional coaxial combiner/divider microstructure 600 may operate as a combiner and/or as a divider. In embodiments, 1:4 way three-dimensional coaxial combiner/divider microstructure 600 may include an electrical path between port 662 and n legs. In embodiments, an operational wavelength may be considered to configure an electrical path through 1:4 way three-dimensional coaxial microstructure 600. In embodiments, for example, the length of first microstructural elements 611, 612, 613 and/or 614 may be approximately ¼ of an operational wavelength between resistors and/or between output port 660.

In embodiments, 1:4 way three-dimensional coaxial combiner/divider microstructure 600 may include an electrical path between port 660 and n legs having resistive elements 620, 630, 640 and/or 650. As illustrated in one aspect of embodiments in FIG. 6, resistive elements 620, 630, 640 and/or 650 may include a star configuration, for example as illustrated in 690. In embodiments, resistive element 620, 630, 640 and/or 650 may be in the form of a module, and/or may include resistor materials 595, 596, 597, and/or 598. In embodiments, resistor materials 595, 596, 597, and/or 598 may be connected directly together and/or connected as discrete elements with a shorting conductive metal, for example as illustrated in the center of 690. In embodiments, first microstructural elements 611, 612, 613 and/or 614 may be connected to resistor material 591 through conductive interfaces 591, 592, 593 and/or 594, respectively.

In embodiments, three-dimensional coaxial microstructures may provide enhanced isolation, allowing first microstructural elements to approach at an electrically small area. In embodiments, a relatively thin film resistor may be designed to both connect all lines in a relatively small area compared to the wavelengths, and/or the substrate of chip resistor 690 may be sized to allow a thermal path for the resistor materials 595, 596, 597, and/or 598 connected to center conductors of coax 611, 612, 613 and/or 614 to pass the outer conductor of coax in the resistor mounting region through a non-electrically, but thermally conductive, substrate material of chip resistor 690. In embodiments, the microcoax layers may taper down in width leading in to resistor mounting regions to reduce the electrical size of a resistor and/or mounting region desired and/or, maximize isolation. In embodiments, a microcoax may taper up from a resistor mounting region to minimize the loss and/or improve power handling in the coax outside the resistor mounting region. In embodiments, an n-way three-dimensional microstructure may include a planar layout, as illustrated in one aspect of embodiments in FIG. 6, and/or a stacked and/or tiered configuration formed of from multiple parts, for example by employing monolithic or hybridly placed embedded resistors. In embodiments, resistor values and/or segments (e.g., impedances in transmission lines) in a multistage, n-way divider may be adapted using software such as Agilent's ADS® or Ansoft's HFSS® or Designer®.

According to embodiments, any configuration of a resistive element may be employed. Referring to example FIG. 22A to FIG. 22D, a resistor configuration is illustrated in accordance with one aspect of embodiments. As illustrated in one aspect of embodiments in FIG. 22A, resistive element 690 may include resistor materials 595, 596, 597, and/or 598 and conductive interfaces 591, 592, 593 and/or 594. In embodiments, resistive element 690 may include resistor thermal and/or mechanical joining interfaces 2201, 2202, 2203 and/or 2204, which may be alignment and/or thermal grounding pads related to second microstructural elements. In embodiments, such regions may also operate as electrical grounding pads. For example, where the back side of resistor 690 may need to be grounded. In embodiments, regions 2201 to 2204 may contain an electrical via through the substrate of resistor 690 connecting pads to a back side metal on the substrate of resistor 690.

Figure 22B:
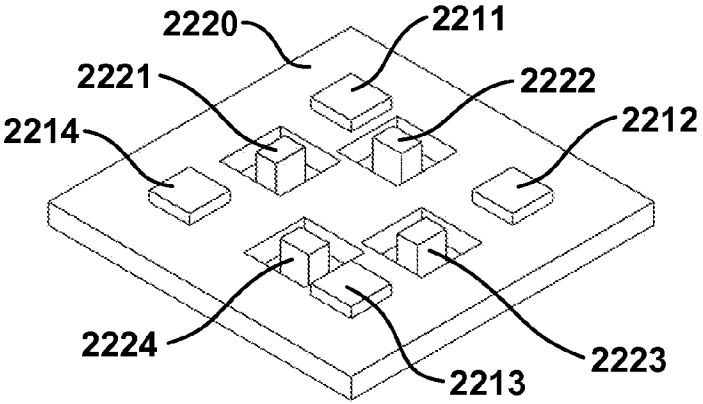

As illustrated in aspect of embodiments in FIG. 22B, resistive element 690 may be configured to connect to a socket for mounting resistor 690. In embodiments, a socket may include first microstructural elements 2221, 2222, 2223 and/or 2224. In embodiments, a socket may include second microstructural element 2220. In embodiments, a socket may include socket joining interfaces 2211, 2212, 2213, and/or 2214, which may be alignment and/or thermal and/or electrical grounding pads related to a resistive element 690. As illustrated in example FIG. 22C to 22D, resistive element may be joined with a socket such that joining interfaces meet and such that first microstructural elements meet conductive interfaces. In embodiments, 2221, 2222, 2223 and/or 2224 may be center conductors of separate coaxial lines transversing under shared top surface of outer conductor 2220, and/or may correspond to one of the four resistor mounting regions as illustrated in FIG. 6, for example areas 620, 630, 640 and 650. In embodiments, 2221, 2222, 2223 and/or 2224 may also be similar to the resistor mounting region. In embodiments, the structure illustrated in FIG. 22 may be employed for resistor mounting regions in any configuration, for example in the configuration illustrated in resistor and/or resistor mounting region 560 FIG. 5B, as a 6-way version in the disk star resistor illustrated in FIG. 7B at 771 and/or as region 2571 of FIG. 25B, and/or disk resistor and resistor mounting region located at 2573 illustrated in FIG. 25D, and/or as may be located in one or more levels illustrated in FIG. 30.

Figure 7A:
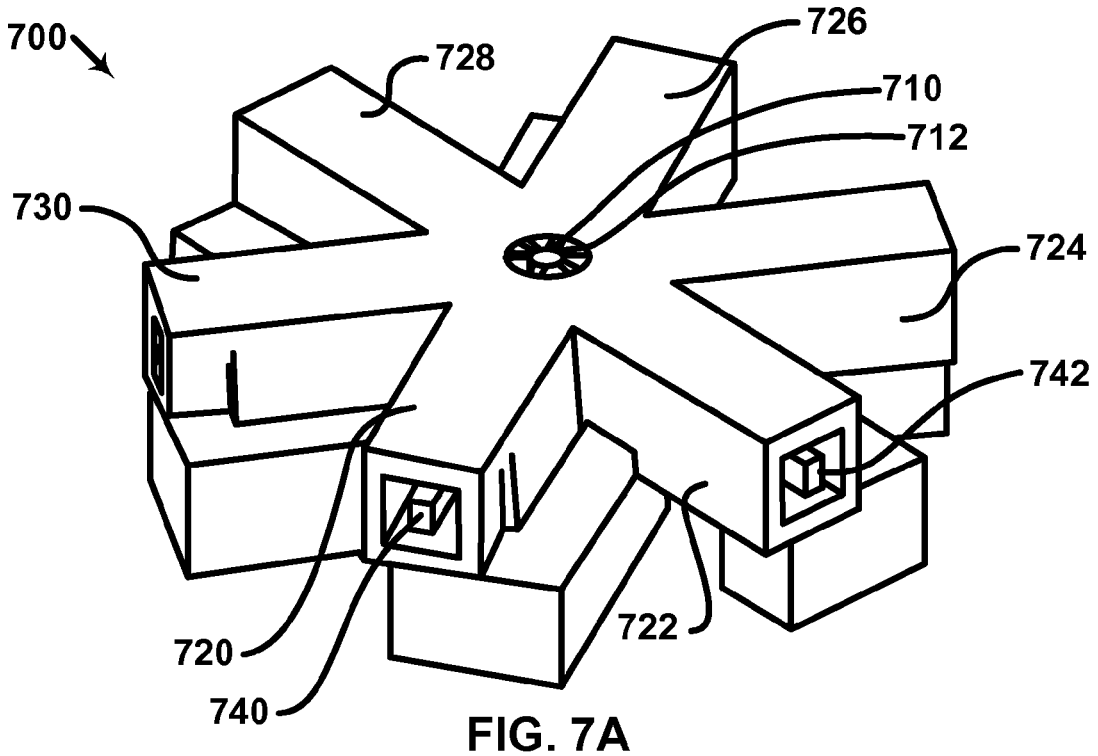
FIGS. 7A to 7B illustrates an n-way three-dimensional coaxial combiner/divider microstructure in accordance with one aspect of embodiments.
Figure 7B:
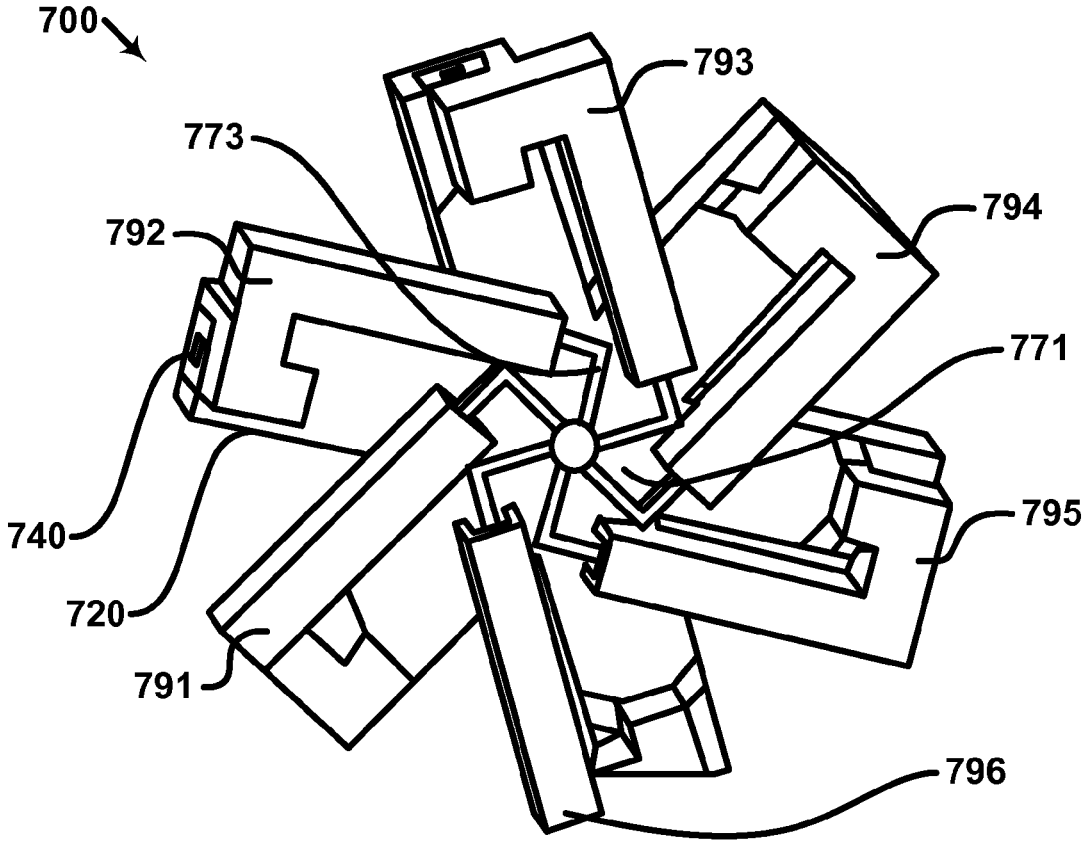

Referring to FIG. 7A to FIG. 7B, an n-way three-dimensional coaxial combiner/divider microstructure 700 is illustrated in accordance with one aspect of embodiments. According to embodiments, 1:6 way three-dimensional coaxial combiner/divider microstructure 700 may include port 710 and/or legs 720, 722, 724, 726, 728 and/or 730. In embodiments, port 710 and/or legs 720, 722, 724, 726, 728 and/or 730 may include a first microstructural element.

According to embodiments, 1:6 way three-dimensional coaxial combiner/divider microstructure 700 may operate as a combiner and/or as a divider. As illustrated in one aspect of embodiments in FIG. 7B, first microstructural elements may be connected to form an electrical path through 1:6 way three-dimensional coaxial combiner/divider microstructure 700. In embodiments, an operational wavelength may be considered to configure an electrical path through a 1:6 way three-dimensional coaxial microstructure 700. In embodiments, for example, a length of first microstructural element 740 may be approximately ¼ of an operational wavelength from the point where it joins at a common port to the 6-way star resistor where it meets the other branches electrically.

According to embodiments, 1:6 way three-dimensional coaxial combiner/divider microstructure 700 may include an electrical path between legs 720, 722, 724, 726, 728 and/or 730 and 6-way star resistive element 771 shown as a circle in the center of FIG. 7B. In embodiments, a first arm microstructural element may form an electrical path between a first microstructural element of an n-way three-dimensional coaxial microstructure and a resistive element. As illustrated in one aspect of embodiments in FIG. 7B, microstructural arm 792 may include a first arm microstructural element connected to first microstructural element 740 of leg 720 at one end, and connected to star resistor 771 at the other end. In embodiments, first microstructural elements 740 (e.g., center conductor) may branch into two portions, one which may traverse second microstructural element 720 (e.g., outer conductor) by $\lambda/4$ to a central feed port where it meets the other port center conductors at 710. In embodiments, for example the other branch of first microstructural element 740 (e.g., a first arm microstructural element) may traverse through microstructural arm 792, which may be disposed at a relatively lower coaxial layer, may turn and/or may electrically join the other lower coaxial center conductors in star resistor 771, which may be flip-chip attached to the 6 center conductors on the bottom surface. In embodiments, an outer conductor of microstructural arms 791 to 796 may cut away near a resistor. In embodiments, outer conductor of microstructural arms 791 to 796 may continue shielding respective center conductors terminating in a resistor mounting region, for example as illustrated in FIG. 22 and/or FIG. 3B. In embodiments, the length of a first arm microstructural element (e.g., center conductors) disposed in microstructural arms 791, 792, 793, 794, 795 and/or 796 may be approximately ½ of an operational wavelength between the branching point near the input ports to first microstructural elements 740, 742, 744, 746, 748 and/or 750 and where they join in the resistor 771. In FIG. 7, embodiments of a 6-way Wilkinson with a resistor removed by a $\lambda/2$ is illustrated. In embodiments, a Wilkinson without a $\lambda/2$ segment may be provided, for example a 4-way Wilkinson illustrated in FIG. 3B. It should be clear that such techniques may extend to N ways of N={2, 3, 4, 5, 6, 7, 8 . . . }.

Referring back to FIG. 1, an apparatus may include one or more impedance matching structures. As illustrated in one aspect of embodiments in FIG. 1, impedance matching structures 130 and/or 180 may be disposed between one or more signal processors 160 . . . 168 and splitter network 120 and/or combiner network 121, respectively.

According to embodiments, an impedance matching structure may include a tapered portion. In embodiments, a tapered portion may be a portion of one or more n-way three-dimensional coaxial microstructures. In embodiments, a portion of one or more first microstructural elements and/or second microstructural elements may be tapered, or their gaps or dimensions adjusted in one or more planes. In embodiments, a portion of a first microstructural element and/or second microstructural element may be tapered along an axis thereof, for example along the length of a first microstructural elements and/or second microstructural element. In embodiments, a taper may enlarge and/or reduce the cross-sectional area of a first microstructural elements and/or second microstructural element moving along an axis thereof.

According to embodiments, an impedance matching structure may include any structure configured to match impedance from a transmission line to a device or between two ports. In embodiments, for example, an impedance matching structure may include an impedance transformer, an open-circuited stub and/or a short-circuited stub, and/or the like. In embodiments, one or more impedance matching structures may be on a different on a different vertical tier and/or a different substrate of an apparatus relative to one or more n-way three dimensional microstructures, three-dimensional microstructure combiner/divider networks, electronic devices, portions thereof, portions thereof, and/or the like. In one aspect of embodiments, an impedance transformer may be of a design equal or similar to that presented in "Micro-coaxial Impedance Transformers," IEEE Transactions on Microwave Theory and Techniques, Vol. 58, Issue 11, pages 2908-2914, November 2010, Ehsan, N., Vanhille K. J., Ronineau, S., and Popovic Z., incorporated herein by reference in its entirety.

Referring back to FIG. 1, an apparatus may include one or more phase adjusters. According to embodiments, a phase adjuster may be disposed between two or more combiner/divider networks. As illustrated in one aspect of embodiments in FIG. 1, phase adjuster 190 may be disposed between splitter network 120 and signal processors 160 . . . 168.

Figure 8:
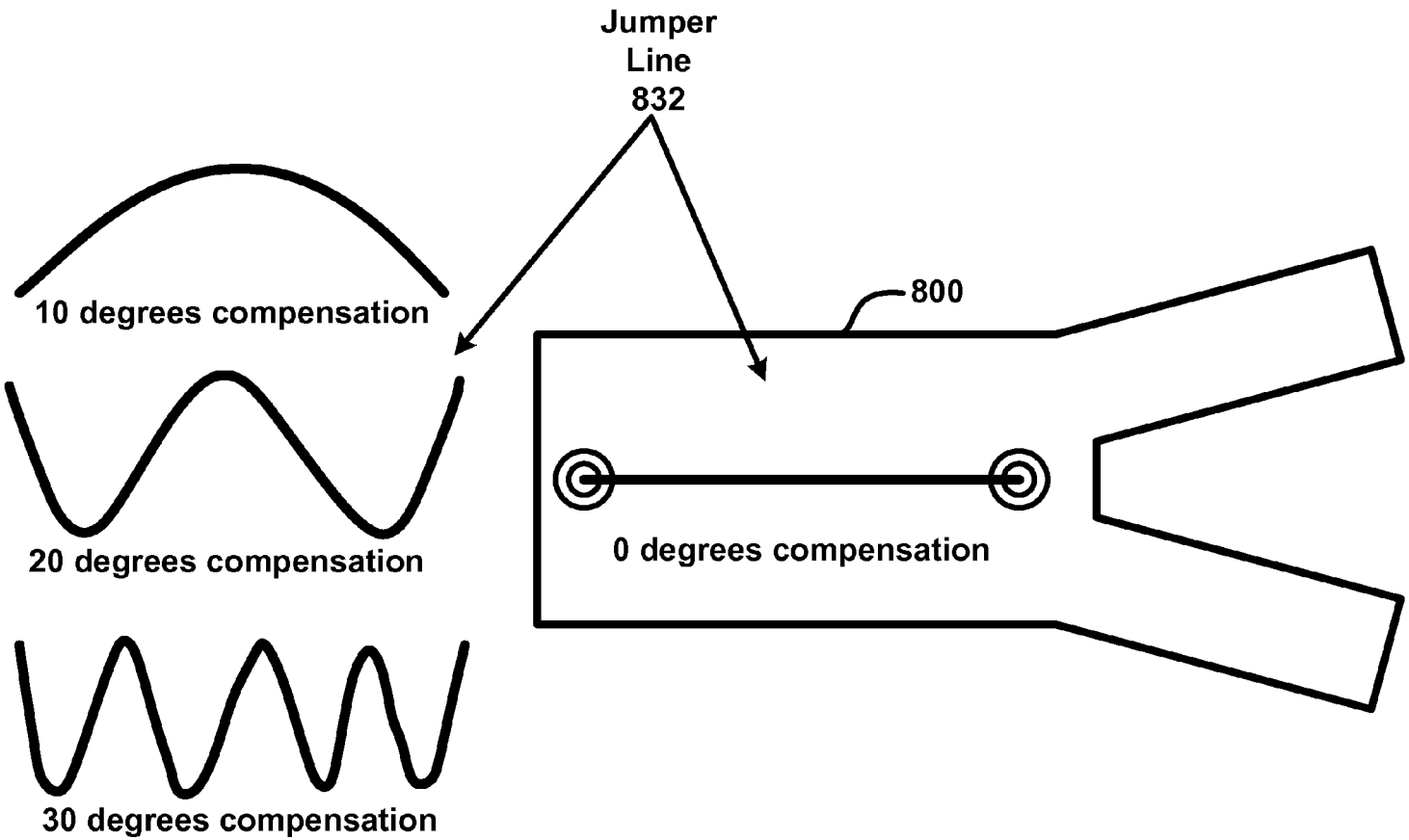
FIG. 8 illustrates a phase adjuster in accordance with one aspect of embodiments.

Referring to example FIG. 8, a phase adjuster is illustrated in accordance with aspects of embodiments. According to embodiments, a phase adjuster may include a portion of a jumper connecting two segments of a coaxial line and/or connecting a coaxial line to a signal processor. As illustrated in one aspect of embodiments in FIG. 8, jumper line 832 is schematically illustrated to represent different path lengths which may be connected to one or more inner microstructural elements of 1:2 way three-dimensional microstructure 800. In embodiments, three-dimensional coaxial microstructure 800 may include a 1:2 divider, as illustrated. In embodiments, three-dimensional coaxial microstructure 800 may be any coaxial transmission line made discontinuous in its center conductor, which may be made continuous through a series of wirebonds and/or a coaxial jumper segment chosen to be of the length desired, for example to correct phase change desired for the circuit. In embodiments, coaxial jumpers may short one or more coaxial line segments of varying length, may meander vertically and or horizontally, and/or may jumper ports of three-dimensional coaxial microstructure 800 to produce a predetermined path length correction, to produce a desired phase shift, and/or to compensate a circuit for a phase error. In embodiments, jumper line 832 may be configured to change the path length of the electrical paths of a 1:2 way three-dimensional coaxial microstructure 800. In embodiments, for example, modifying the length of jumper line 832 may change the path length of the electrical paths of an 1:2 way three-dimensional coaxial microstructure 800 and/or adjust the phase of an electromagnetic signal, for example 10 degrees compensation, 20 degrees compensation, 30 degree compensation, and/or the like. In embodiments, a phase adjuster may include a wire bond jumper configured to change a path length. In embodiments, wire bond jumpers may be of various heights or lengths and may include center conductor and ground segments. In embodiments, the ground plane section in FIG. 8 may be discontinuous between center conductor ports. In embodiments the center and outer conductors may be made continuous using a determined coaxial jumper segment bonded to this section or an array of wirebonds for the ground and signal sections of determined lengths or loop heights.

Figure 9:
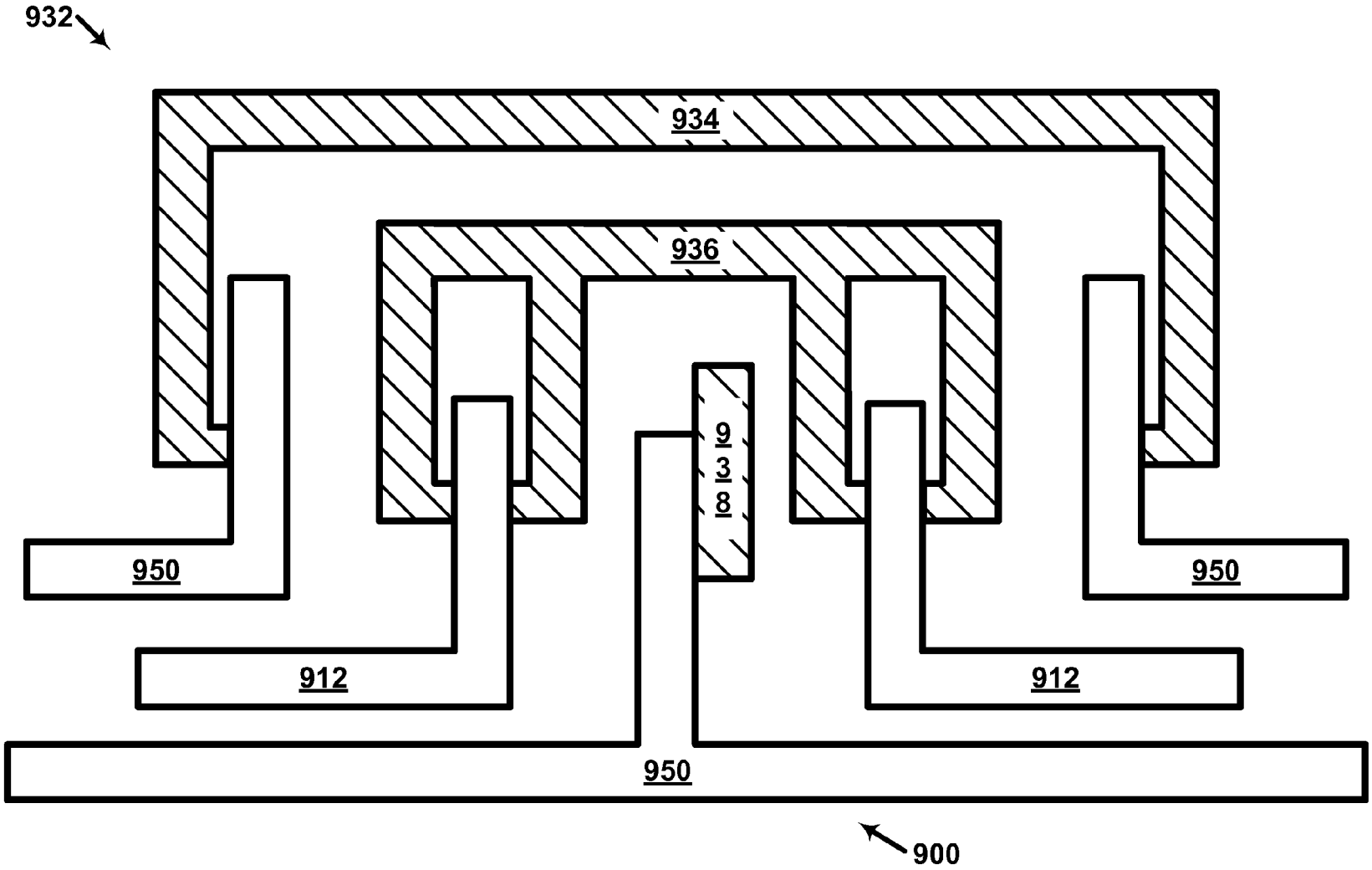
FIG. 9 illustrates a phase adjuster in accordance with one aspect of embodiments.

Referring to example FIG. 9, a coaxial sliding phase adjuster is illustrated in accordance with aspects of embodiments. As illustrated in one aspect of embodiments in FIG. 9, a phase adjuster may include a variable sliding structure configured to change a path length. In embodiments, sliding jumper 932 may include a first sliding portion 934, a second sliding portion 936 and/or a third sliding portion 938. All these sliding portions may be connected together mechanically so that they move as one component in relation to component 900, which may be a circuit. In embodiments, sliding portions of 932 may be configured to contact microstructural elements of 900, for example using a spring force. In embodiments, sliding portions 934, 936 and/or 938 may have a single sided or a double sided wiper. In embodiments, the wiper may be configured on one side or the opposite side proximate component 900. In embodiments, sliding portions 934, 938 may be configured to contact microstructural element 950. In embodiments, sliding portion 934, 936 and/or 938, across microstructural elements 912 and/or 950, may change the path length of the electrical paths of a three-dimensional coaxial microstructure and/or adjust the phase of an electromagnetic signal. In embodiments, this is accomplished by component 932 sliding up and down, or laterally, in relation to component 900. In embodiments, these components may be laid out in a semicircle to allow component 932 to move, for example like the motion of a dial or trimpot. In embodiments, one or more adjusters may be on a different vertical tier and/or a different substrate of an apparatus relative to one or more n-way three dimensional microstructures, three-dimensional microstructure combiner/divider networks, electronic devices, portions thereof, and/or the like. In embodiments, component 932 may be formed in place and/or may be formed separately and placed into component 900. In embodiments, adjuster structures may be employed when the phase of signal processor elements may include variation but must be combined in phase, for example with mm-wave GaN and/or GaAs power amplifiers where phase variations can be large.

Referring back to FIG. 1, an apparatus may include one or more transition structures. According to embodiments, a transition structure may be disposed between two or more combiner/divider networks. As illustrated in one aspect of embodiments in FIG. 1, transition structures 150 and/or 170 may be disposed between signal processors 160 . . . 168 and splitter network 120 and/or combiner network 121.

Figure 10:
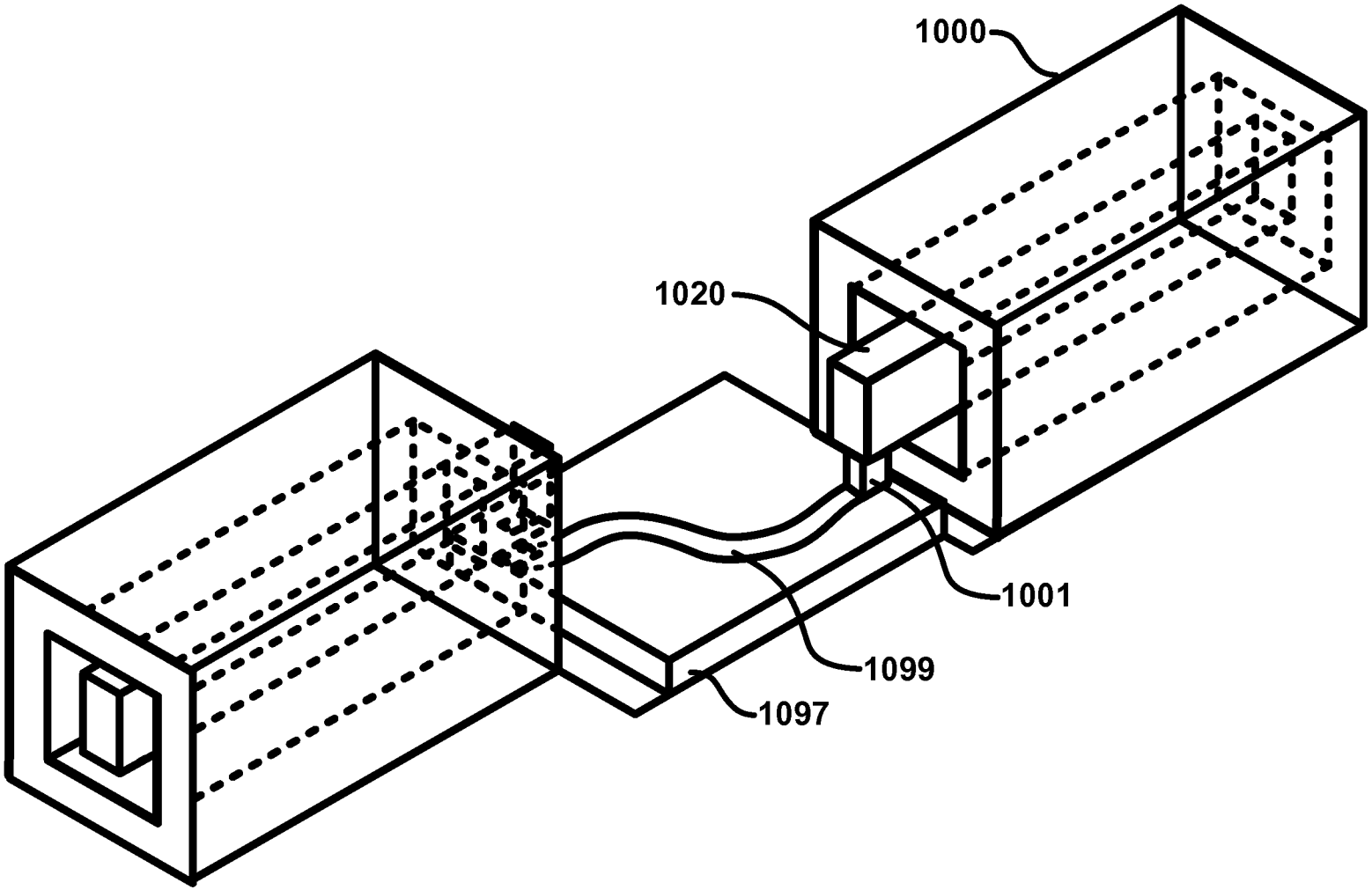
FIG. 10 illustrates transition structures coupled to a microstrip in accordance with one aspect of embodiments.
Figure 31:
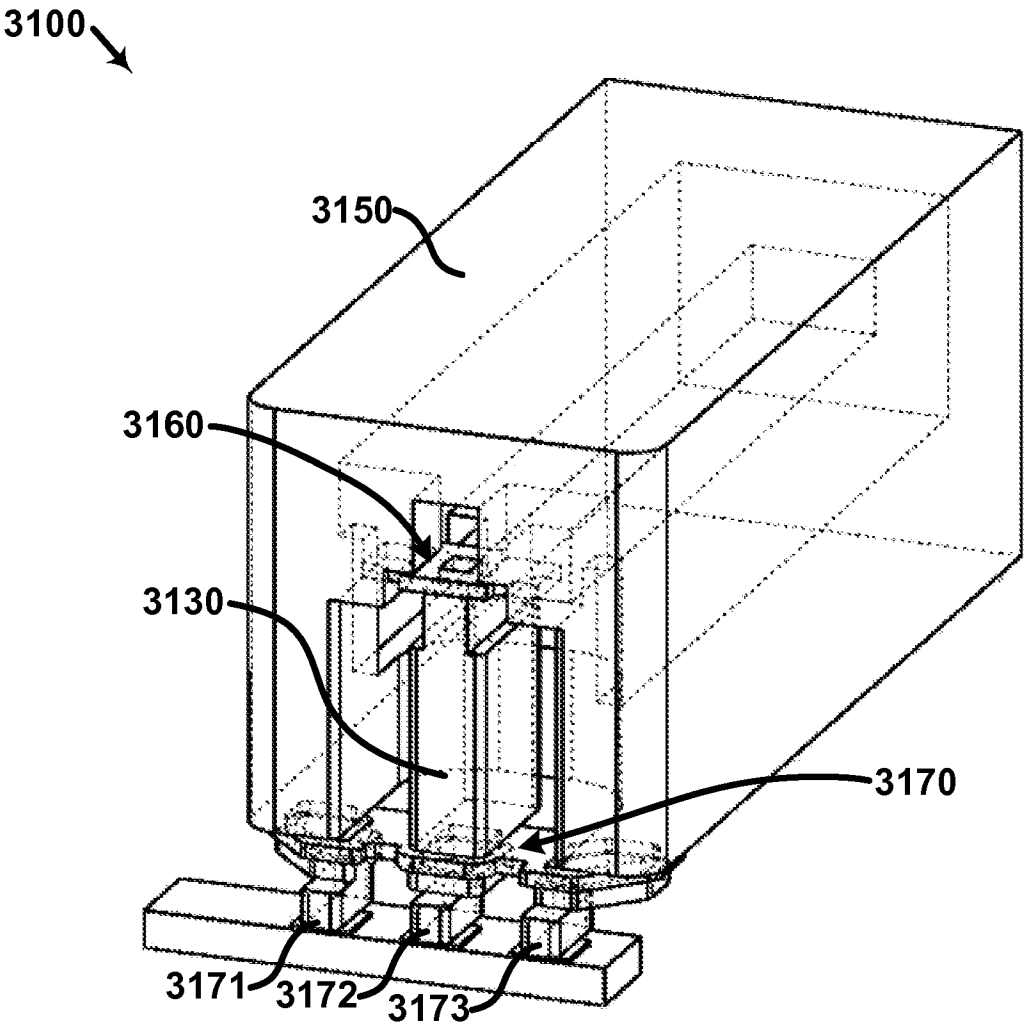
FIG. 31 illustrates a transition structure in accordance with one aspect of embodiments.

Referring to example FIG. 10, a transition is illustrated in accordance with aspects of embodiments. As illustrated in one aspect of embodiments in FIG. 10, a transition structure may be configured to connect to one or more electronic devices of an apparatus, for example one or more signal processors. According to embodiments, transition structure 1001 may be configured to connect first microstructural element, for example coaxial center conductor of 1020 of microstructure 1000, shown extending from an outer conductor of microstructure 1000 to transmission line substrate 1097. In embodiments, transition structure 1001 may include a material such as conductive material. In embodiments, transmission line 1099 on substrate 1097 may include any form, for example CPW and/or stripline. In embodiments, a transmission line on substrate 1097 may include conductive material, for example conductive trace 1099. In embodiments, conductive trace may be connected to an integrated circuit, for example a MMIC directly and/or through one or more vias. In embodiments, transition structure 1001 may be configured to connect directly to a MMIC, for example employing a down taper in one or more axes and/or an up taper to and/or from one or more electronic devices such as a signal processor. Any transition structures may be employed. For example transition structures employed in U.S. Provisional Patent Application No. 61/493,516, incorporated herein by reference in its entirety and illustrated in example FIG. 31. Briefly, as illustrated in FIG. 31, three-dimensional coaxial microstructure 3100 may include a first microstructural element 3130 and a second microstructural element 3150. In embodiments, first microstructural element 3130 may include a transition structure having one or more elements, for example element 3171, 3172 and/or 3173, which may connect coaxial microstructure 3100 with a MMIC circuit, electrical device and/or the like.

According to embodiments, a transition structure may be configured to connect to one or more electronic devices by employing a connector, for example a MMIC socket. In embodiments, a transition structure may be configured to connect to one or more electronic devices by employing a wire, for example a conductive wire bond and/or beam-lead. In embodiments, a transition structure may be configured to connect to one or more electronic devices by employing a direct connection, for example employing solder. In embodiments, a transition structure may be configured to connect to one or more electronic devices by employing a coaxial-to-planar transmission line structure such as a ground-signal-ground transition of similar form used by microwave probe tips, where upper and lower ground walls of the coax terminate and the side walls and center conductor taper down to a planar GSG probe connection which is optimized to interface to a CPW structure on a device or signal processor. Such transitions may be formed monolithically with the coax or may be formed as separate pieces and join a signal transformer or other device to the coax in a form, for example as jumper or bridge. Other connections between the signal processors and the coax may be used, for example a beam-lead construction or a lead-frame transition structure. Such structures can be optimized for performance in 3D finite element analysis (FEA) electromagnetic modeling software such as Ansoft's HFSS® software. Transition losses can typically be obtained with insertion loss below 0.1 dB and return loss above 20 dB, or 30 dB, or greater depending on the devices and the application as needed.

According to embodiments, one or more transition structures may be an independent structure. In embodiments, one or more transition structures may be on a different vertical tier and/or be formed on a different substrate. In embodiments, a transition structure may include or connect to an impedance matching structure. In embodiments, a transition structure may include a down taper, for example disposed to pass one or more split electromagnetic signals to a circuit. In embodiments, a transition structure may include an up taper, for example disposed to pass one or more processed electromagnetic signals. In embodiments, a down taper and/or an up taper may be disposed between one or more first microstructural elements of an n-way three-dimensional coaxial microstructure and a transmission line medium and/or electronic device. In embodiments, for example, an up taper may be disposed between an n-way three dimensional coaxial microstructure combiner and a transmission line medium and/or electronic device.

According to embodiments, an apparatus may include one or more tiered portions. In embodiments, a tiered portion may be of one or more combiner/divider networks. In embodiments, one or more n-way three-dimensional coaxial microstructures may be on different vertical tiers of an apparatus relative to itself, to one or more other n-way three-dimensional coaxial microstructures and/or one or more electronic devices of an apparatus, for example relative to one or more signal processors. In embodiments, coaxial tiers may be formed as separate components and/or connected using stacking and/or in-plane interconnection, such as through conductive epoxy, solder, micro-connectors, anisotropic conductive adhesives and/or the like. In embodiments, coaxial tiers may be formed monolithically. In embodiments, coaxial tiers may be composed of pieces such that assembly and/or insertion of additional components may be provided and then stacking and/or lateral interconnection may be completed to embed devices inside of a three-dimensional microelectronic network. In embodiments, the formation of a monolithic coaxial network may include insertion of active and/or passive devices during the build process.

Referring back to FIG. 2, 1:2 way three-dimensional coaxial microstructure 200 is illustrated in a plane, but may be on one or more different vertical tiers of an apparatus. According to embodiments, port 210 and/or leg 224 may be in part and/or entirely on a different vertical tier than legs 220 and/or 222. In embodiments, there may be a shaped connection traversing two or more vertical tiers of an apparatus disposed between port 210 and/or leg 224 and leg 220 and/or 222. In embodiments, shapes may be employed to compact routing of phase lengths which may make a device function, for example quarter and/or half wave segments. In embodiments, a shaped connection may include a Z-shape, S-shape, T-shape, V-shape, U-Shape, and/or L-shape, and/or the like. In embodiments, a shaped connection and/or coaxial line segments may be formed of one or more strata and/or layers, and/or may be of any thickness. In embodiments, a shaped connection may be a portion of an n-way three-dimensional coaxial microstructure. In embodiments, a shaped connection may be formed of the same and/or different material as n-way three-dimensional coaxial microstructure. In embodiments, 1:2 way three-dimensional coaxial combiner/divider microstructure 200 may be employed in a vertical orientation through one or more tiers of an apparatus. In embodiments, 1:2 way three-dimensional coaxial microstructure may be on a different vertical tier of an apparatus relative to a portion of itself, one or more other n-way three-dimensional coaxial microstructures, electronic devices, and/or the like.

Referring back to FIG. 4, one or more n-way three-dimensional coaxial microstructures of cascading n-way three-dimensional coaxial microstructures may be on different vertical tiers of an apparatus. In embodiments, 1:4 way three-dimensional coaxial combiner/divider microstructure 402 may be on a different vertical tier of an apparatus than 1:4 way three-dimensional coaxial combiner/divider microstructures 404 and/or 406. In embodiments, there may be a shaped connection traversing two or more vertical tiers of an apparatus disposed between leg 416 of 1:4 way three-dimensional coaxial combiner/divider microstructure 402 and leg 430 of 1:4 way three-dimensional coaxial combiner/divider microstructure 404. In embodiments, 1:4 way three-dimensional coaxial combiner/divider microstructure 400 may be employed in a vertical orientation through one or more tiers of an apparatus. In embodiments, one or more n-way three-dimensional coaxial microstructures of cascading n-way three-dimensional coaxial microstructures may be on a different vertical tier of an apparatus relative to a portion of itself, one or more other n-way three-dimensional coaxial microstructures, electronic devices, and/or the like.

Referring back to FIG. 5A to FIG. 5D, legs 514, 524, 534 and/or 544 may be on a different vertical tier of a apparatus relative to a portion of itself, for example relative to microstructural housing 590 and/or arms 595, 596, 597 and/or 598, relative to one or more other n-way three-dimensional coaxial microstructures, electronic devices, and/or the like. In embodiments, 1:4 way three-dimensional microstructure 500 may be on a different vertical tier of a apparatus relative to one or more other n-way three-dimensional coaxial microstructures, electronic devices, and/or the like. Referring back to FIG. 6, n legs may be on a different vertical tier of an apparatus relative to a portion of itself, for example port 660, relative to one or more other n-way three-dimensional coaxial microstructures, electronic devices, and/or the like. Referring back to FIG. 7A to FIG. 7B, legs 720, 722, 724, 726, 728 and/or 730 may be on a different vertical tier of a apparatus relative to a portion of itself, for example relative to arms 792, 794, 796 and/or 798, including a shaped connection and/or employed in a vertical orientation. In embodiments, 1:4 way three-dimensional microstructural element 700 may be on a different vertical tier of an apparatus relative to one or more other n-way three-dimensional coaxial microstructures, electronic devices, and/or the like.

Figure 11:
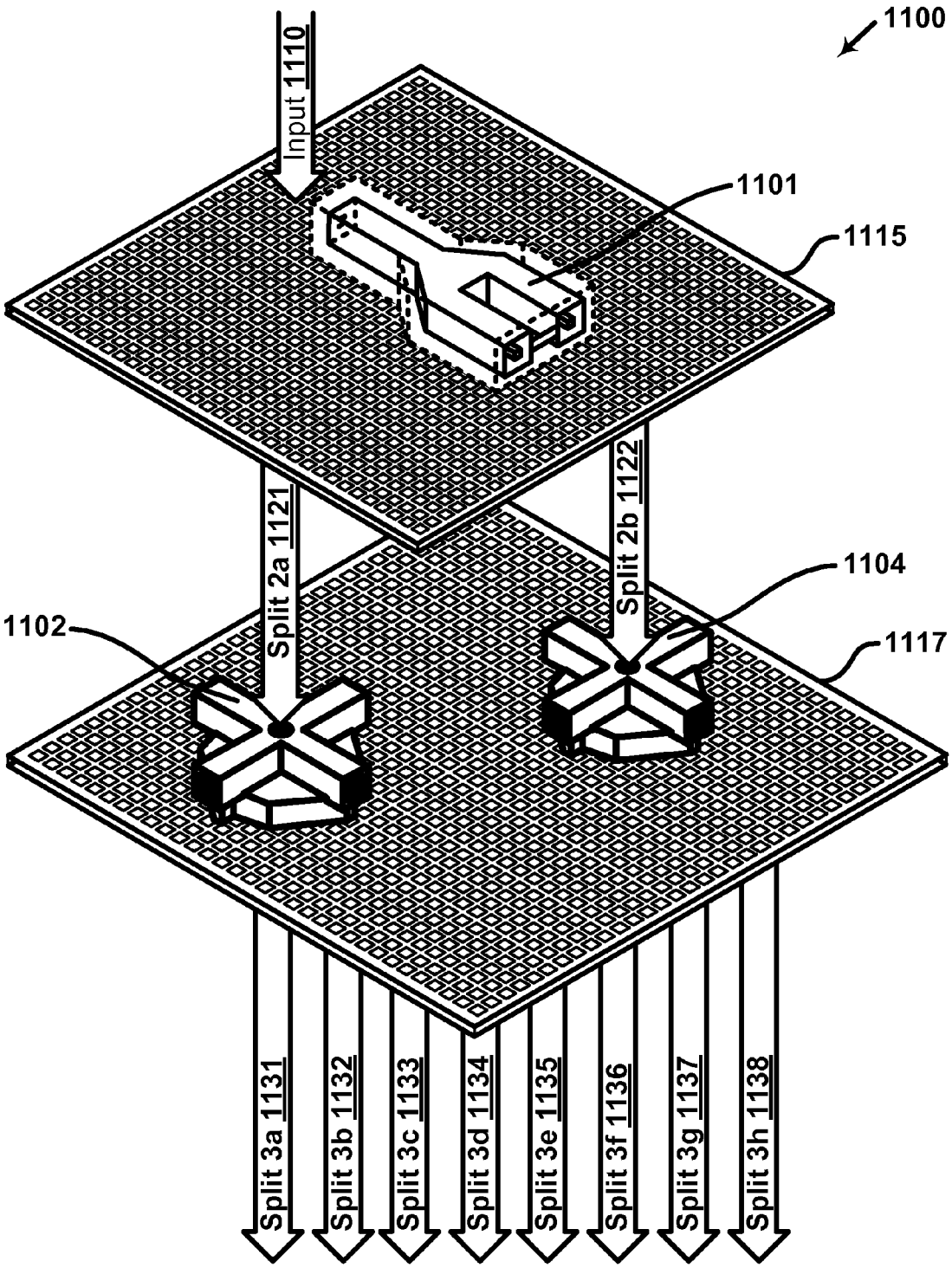
FIG. 11 illustrates an n-way three-dimensional coaxial combiner/divider and/or an n-way three-dimensional coaxial combiner/divider network disposed in a monolithic thermo-mechanical mesh in accordance with one aspect of embodiments.

Referring to FIG. 11, a combiner/divider and/or combiner/divider network may be cascading, tiered and/or disposed on different substrates in accordance with aspects of embodiments. According to embodiments, 1:2 way three-dimensional microstructure 1101 may be disposed on a substrate formed at the same time surrounding and/or partially surrounding devices that may support them, for example a mechanical mesh network 1115. In embodiments, a mesh network may include any shape, for example a cubic, wire frame and/or hexagonal repeating structure. In embodiments, a support mesh may allow multiple elements, such as combiner/divider 1102 and/or 1104, shown in FIG. 11, to be maintained in a lithographically defined relationship to each other, may provide assistance in thermal dissipation and/or transfer between elements disposed within mesh 1115 and/or connected to coaxial microstructures such as 1101, for example embedded chips such as power amplifiers and/or resistors, and/or may facilitate heat transfer to layers above and/or below it. In embodiments, a mesh structure may include mechanical alignment structures such as holes and/or posts to aid in the alignment of mesh 1115 and 1117 together and/or to other layers that may be above and/or below them or in relation to them. In embodiments, 1:2 way three-dimensional microstructure 1101 may be configured to receive and split input electromagnetic signal 1110 and transmit split electromagnetic signal 1121 and/or 1122.

According to embodiments, 1:2 way three-dimensional microstructure 1101 may be connected to 1:4 way three-dimensional microstructure 1102 and/or 1:4 way three-dimensional microstructure 1104. In embodiments, 1:4 way three-dimensional microstructure 1102 and/or 1:4 way three-dimensional microstructure 1104 may be disposed on a different substrate and/or at a different vertical tier than 1:2 way three-dimensional microstructure 1100, for example mechanical mesh network 1117 disposed on a lower vertical tier of apparatus 1100. In embodiments, 1:4 way three-dimensional microstructure 1102 and/or 1:4 way three-dimensional microstructure 1104 may be configured to receive and split input electromagnetic signals 1121 and/or 1122, and/or transmit split electromagnetic signals 1131, 1132, 1133, 1134, 1135, 1136, 1137 and/or 1138, for example to one or more n-way three dimensional microstructures, networks, and/or devices at a lower tier.

According to embodiments, a combiner/divider network formed by 1:2 way three-dimensional microstructure 1101, 1:4 way three-dimensional microstructure 1102 and/or 1:4 way three-dimensional microstructure 1104 may be cascading, tiered and/or on different substrates, as illustrated in one aspect of embodiments in FIG. 11. In embodiments, for example where mesh 1115 and 1117 are on the same vertical tier of an apparatus, a combiner/divider network formed by 1:2 way three-dimensional microstructure 1101 and 1:4 way three-dimensional microstructure 1102 and/or 1:4 way three-dimensional microstructure 1104 may be cascading and/or formed on different substrates, but on the same vertical tier of an apparatus. Any suitable configuration may be employed. In embodiments, a tiered configuration created in separate pieces such as mesh 1115 and 1117 may provide the ability to place resistors and/or other devices within the three-dimensional microelectronic system being constructed while minimizing the number of assembly steps otherwise required if such a three-dimensional system were to be constructed from unjoined elements 1101 and 1102, and/or 1104. In embodiments, any construction may be employable and constructions described are for illustrative purposes. In embodiments, actual systems may include more functional electrical elements which may maximize benefit in the alignment and/or assembly of a three-dimensional microelectronic module.

Figure 12:
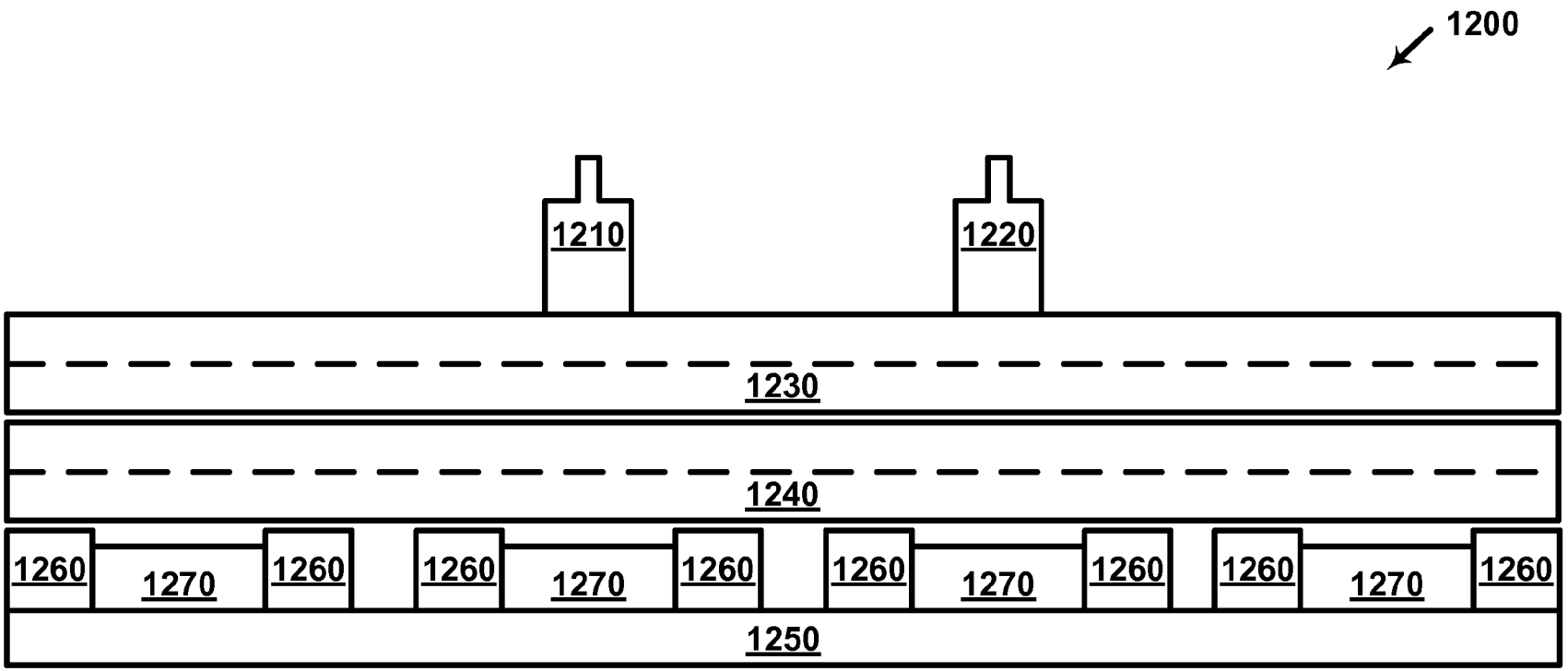
FIG. 12 illustrates an apparatus including a tiered and/or modular configuration in accordance with one aspect of embodiments.

Referring to example FIG. 12, an apparatus including a tiered and/or modular configuration is illustrated in accordance with aspects of embodiments. According to embodiments, apparatus 1200 may include input 1210 configured to input one or more electromagnetic signals. Input 1210 may include any configuration, for example a coax connector and/or a waveguide port. In embodiments, input 1210 may be connected to first combiner/divider network 1230. In embodiments, first combiner/divider network 1230 may be connected to second combiner/divider network 1240. In embodiments, second combiner/divider network 1240 may be connected to an assembly of devices mounted to a substrate, for example a one-dimensional or two-dimensional arrangement of power amplifier die mounted to substrate 1250, which may include circuit elements and/or may be an integrated circuit.

According to embodiments, first combiner/divider network 1230 and/or second combiner/divider network 1240 may include one or more n-way three-dimensional microstructures, waveguide power combiners/dividers, spatial power combiners/dividers and/or electric field probes. In embodiments, for example, input 1210 may be connected to one or more n-way three-dimensional microstructures of first combiner/divider network 1230 configured to split an input electromagnetic signal to split electromagnetic signals. In embodiments, one or more n-way three-dimensional microstructures in first combiner/divider network 1230 may be connected to one or more n-way three-dimensional microstructures of second combiner/divider network 1230 configured to further split one or more split electromagnetic signals.

According to embodiments, one or more n-way three-dimensional microstructures of second combiner/divider network 1240 may be connected one or more signal processors 1270 of substrate and/or integrated circuit 1250. In embodiments, a connection to signal processors 1270 of substrate and/or integrated circuit 1250 may be formed by employing a transition structure, which may include a down taper to a transmission line medium to coaxial and/or other transition structure 1260, such as a socket, for example designed to interconnect between network 1240 and devices 1270. In embodiments, one or more sockets may be formed of any material, for example conductive material, and would include conductive properties in regions where it transfers the coaxial, RF and/or DC signals from layers in network 1240 into circuits which may be included in an/or on circuit 1250. In embodiments, for example substrate 1250 may be formed of any material, for example insulative material such as BeO, AlN, $Al_2O_3$, and/or the like. In embodiments, substrate 1250 may be an integrated circuit such as SiGe, GaN, GaAs, or InP with devices 1270 including transistors, microwave integrated circuits, and/or devices diffused into or created in and/or on a semiconducting material with transition structures 1260 optionally added to facilitate their interconnection to one or more layers in network 1240. In embodiments, signal processors 1270 may process one or more input split electromagnetic signals and output one or more processed split electromagnetic signals.

According to embodiments, one or more signal processors 1270 of integrated circuit and/or substrate 1250 may be connected to one or more n-way three-dimensional microstructures in second combiner/divider network 1240 configured to divide, combine and/or route one or more processed electromagnetic signals. In embodiments, for example, a connection to signal processors 1270 of substrate and/or integrated circuit 1250 may be formed by employing a transition structure, which may include an up taper between a transmission line medium to socket and/or transition structure or interconnect 1260. In embodiments, one or more n-way three-dimensional microstructures of second combiner/divider network 1240 may be connected to one or more n-way three-dimensional microstructures of first combiner/divider network configured to further combine a split processed electromagnetic signal to an output electromagnetic signal. In embodiments, input and/or output 1220, for example a coaxial connector and/or waveguide port, may be connected to one or more n-way three-dimensional microstructures of first combiner/divider network 1230 configured to combine and/or divide an electromagnetic signal. According to embodiments, networks 1230 and/or 1240 may include embedded and/or hybridly mounted resistors, capacitors and/or other active or passive devices. In embodiments, DC and/or RF routing lines of various constructions may be included and/or may contain thermal transfer structures, sockets for mounting chips and/or the like.

According to embodiments, an apparatus may include one or more portions constructed as a mechanically releasable module. In embodiments, for example, circuits formed in mesh 1115 and 1117 may be formed on a handle substrate, released from that substrate, and/or interconnected in one or more axes with each other and/or other devices. In embodiments, modules may be permanently connected using solder, fusion bonding and/or epoxy, and may include connectors, interconnects and/or materials that may allow them to be joined and/or unjoined. a mechanically releasable module may be of one or more combiner/divider networks. In embodiments, a mechanically releasable module may include one or more combiner/divider networks, n-way three-dimensional coaxial microstructures, impedance matching structures, transition structures, phase adjusters, signal processors and/or cooling structures, and/or the like.

Referring back to FIG. 12, input 1210, first combiner/divider network 1230, second combiner/divider network 1240, integrated circuit 1250, and/or portions thereof, may be mechanically releasable. In embodiments, a combiner and/or divider of first combiner/divider network 1230 and/or second combiner/divider network 1240, and/or portion thereof, may be mechanically releasable. In embodiments, signal processor 1270 may be mechanically releasable. In embodiments, mechanically releasable portions may be removed, exchanged and/or replaced without substantial harm to a substrate, neighboring components and/or the apparatus. In embodiments, a releasable module may facilitate repair, rework, and troubleshooting during and/or after the assembly of portions and/or components thereof.

Figure 13A:
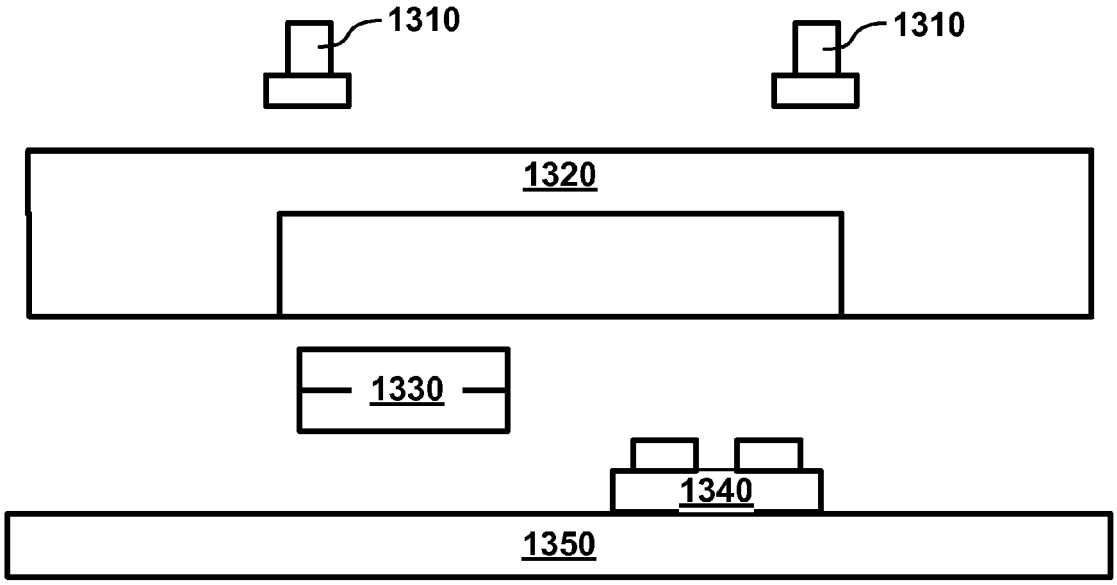
FIGS. 13A to 13B illustrate an apparatus including a tiered and/or modular configuration in accordance with one aspect of embodiments.
Figure 13B:
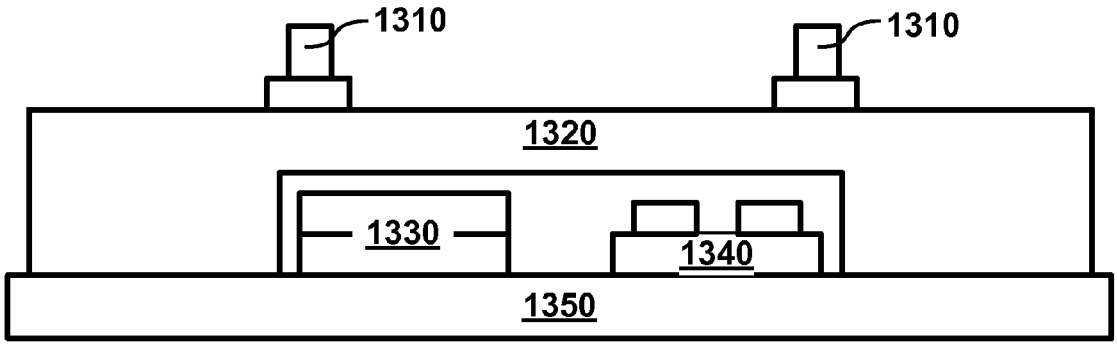

Referring to example FIG. 13A to FIG. 13B, an apparatus including a tiered and/or modular configuration is illustrated in accordance with one aspect of embodiments. According to embodiments, an apparatus may include connectors 1310 mechanically releaseably connectable and/or permanently connected to three-dimensional combiner/divider backplane 1320. In embodiments, mechanically releasably connectable three-dimensional combiner/divider backplane 1320 may itself include one or more mechanically releasable portions, for example one or more portions of a three-dimensional microstructural combiner/divider, microstructural combiner/divider network, and/or the like. In embodiments, integrated circuit and/or substrate 1350 may include one or more mechanically releasable portions, for example mechanical releasable signal processors 1330 and/or 1340. In embodiments, integrated circuit and/or substrate 1350 may be in the form of a module, for example including control DC circuits. In embodiments, integrated circuit and/or substrate 1350 may include a substrate material formed of relatively high thermally conductive material, for example metal and/or ceramic material. In embodiments, a mechanically releasable module may include a heat sink, a signal processor and a three-dimensional microstructure backplane. In embodiments, a heat sink may include any passive and/or active cooling structure, for example a fan, fin, and/or thermoelectric cooler, and/or the like. In embodiments, mechanically releasable elements may be joined using any mating structure, for example using a reworkable solder, a thermally reworkable electrically and/or thermally conductive epoxy, and/or a mechanical structure such as one using a spring force for example, in a connector, to join an array of devices. In embodiments, the network illustrated in FIG. 19 may be configured in two or more layers, released from a substrate on which they may be formed and/or contain input and/or output networks within components in a mechanical mesh, for example 1115 and 1117 illustrated in FIG. 11. In embodiments, mesh 1115 and/or 1117 of FIG. 11 may correspond to network 1230 and/or 1240 illustrated in FIG. 12, and/or correspond to backplane 1320 as an assembly illustrated in FIG. 13. In embodiments, substrate 1250 and substrate 1350 may correspond to each other. In embodiments, devices and/or signal processors 1270, as illustrated in FIG. 12, may correspond to devices 1340 of FIG. 13.

Referring to example FIG. 14, an apparatus including a modular configuration is illustrated in accordance with one aspect of embodiments. As illustrated in one aspect of embodiments in FIG. 14, a modular three-dimensional coaxial combiner 1400 is illustrated. In embodiments, signal processors 1421, 1422, 1423 and 1424 may include broadband and power amplifiers, for example GaN or GaAs power amplifiers. In embodiments, a signal processor may include 4×20-W GaN Chips (17 dB Gain, 400 mW Input). As illustrated in one aspect of embodiments in FIG. 14, power may be combined in a 4:1 three-dimensional microstructure power combiner 1460. In embodiments, 4:1 power three-dimensional microstructure combiner 1460 may be of similar design as 4:1 power three-dimensional microstructure combiner 600. In some embodiments, 1400 may include three 1:2 broadband Wilkinson power dividers cascaded to yield a 1:4 divider, for example to feed broad band power amplifiers 1421, 1422, 1423, 1424 from preamplifier 1402. In embodiments, the outputs of signal processors 1421, 1422, 1423, 1424 may be combined at 4:1 combiner 1460, and/or of similar design and/or larger size, with coax or a waveguide output port.

According to embodiments, an input electromagnetic signal may be input to module 1400 by transmission line 1401. In embodiments, an input three-dimensional coaxial divider may include a 1:2 Wilkinson three-dimensional microstructure 1430, which may divide power to a left and right side 1:2 Wilkinson power divider three-dimensional microstructure 1440 and 1450. In embodiments, an input divider may be disposed above, below, and/or intertwined with one or more combiners/dividers. As illustrated in one aspect of embodiments in FIG. 14, 1:2 input Wilkinson three-dimensional microstructure 1430 may be disposed above three-dimensional microstructure 1440, 1450 and 1460.

According to embodiments, a split electromagnetic signal may be connectable to an input of a signal processor. As illustrated in one aspect of embodiments in FIG. 14, a split electromagnetic signal from 1:2 Wilkinson three-dimensional microstructure 1430 may be further split into two split electromagnetic signals at 1:2 Wilkinson power divider three-dimensional microstructure 1440 and 1450. In embodiments, split electromagnet signals may be connectable to inputs 1471, 1472, 1473 and/or 1474 of signal processors 1421, 1422, 1423 and/or 1424. In embodiments, a configuration as illustrated may minimize the routing line length required on the loss-sensitive output combiner. In embodiments, output ports may face each other, for example in a quad configuration, which may minimize the excess routing line length within the module subassembly. In embodiments, input ports may face out as the excess loss before amplification may be relatively less important in determining amplifier performance when one or more signal processors includes an amplifier.

According to embodiments, signal processors 1421, 1422, 1423 and/or 1424 may be configured to process an electromagnetic signal, for example amplify a split electromagnetic signal. In embodiments, a processed electromagnetic signal may be connectable to an output port of a signal processor. As illustrated in one aspect of embodiments in FIG. 14, a processed electromagnetic signal may be connectable to output ports 1481, 1482, 1483 and/or 1484 signal processors 1421, 1422, 1423 and/or 1424.

According to embodiments, an apparatus may include one or more pre-processors. As illustrated in one aspect of embodiments in FIG. 14, module 1400 may include preamplifier 1402, which may feed the input ports of 1421 to 1424 through 1:2 Wilkinson power divider three-dimensional microstructure 1430 into 1:2 power dividers 1440 and 1450. In embodiments, for example, a preamplifier may include a Triquint TGA2501 (6-18 GHz, 2.8 W Output, 26 dB Gain).

According to embodiments, one or more phase shifters may not be needed, for example when MMICs and/or amplifiers below approximately 20 GHz are selected. In embodiments, phase correction may be adapted based on the process maturity of available chips and/or if they have phase correction built into the devices. In embodiments, chips may be sorted and binned by phase. In embodiments, phase correction may be added into a circuit through tunable and/or fixed means. In embodiments, relatively high performance die may be matched to approximately 10 degrees through manufacturing, sorting, correction in the circuit, and/or through one or more other processes. As illustrated in one aspect of embodiments, module 1400 may include between an approximately 2-20 GHz wideband amplifier construction, for example a 4-18 GHz amplifier. In embodiments, one or more phase shifters may be employed to maximize and/or provide power combining efficiency at approximately Ka band and above, for example approximately 60 GHz and above, and/or when amplifier die need to be combined with relatively high efficiency and have phase errors between die of greater than between approximately 10 to 15 degrees. In embodiments, one or more phase shifters may be employed with relatively small GaN and/or GaAs amplifiers at mm-wave frequencies, which may include relatively large phase variation between parts due to part material and/or processing variability.

According to embodiments, a combining/dividing network may include one or more jumpers and/or switches to configure a circuit and/or module. In embodiments, a jumper and/or switch may be included in jumper and/or switch area 1403. In embodiments, a jumper and/or switch may enable parts to be combined into higher power modules without requiring handedness, for example relative to a side they are mounted on. In embodiments, one module may be manufactured instead of requiring inventory of left and right handed modules when these components are combined as illustrated, for example, in example FIG. 15. In embodiments, module 1400 may include one or more module ports and/or transmission lines, for example transmission lines 1490 and/or 1491, which may be used to connect one or more modules together. In embodiments, transmission lines 1490 and/or 1491 may be an input and/or an output port for the module, and/or module 1400 may operate as a combiner and/or divider module. In embodiments, a jumper may be employed to connect a path from input divider 1548 into amplifier module 1510, 1514 at transmission line 1490, which may include a divider to divide the electromagnetic signal. In embodiments, transmission line 1590, similar to 1490 illustrated in FIG. 14, may route a split electromagnetic signal down one or two paths to allow its outer terminal port to feed the split signal to another module and/or to feed preamp 1402 through jumper and/or switch at area 1403.

Referring to example FIG. 15, an apparatus including a modular configuration is illustrated in accordance with one aspect of embodiments. As illustrated in one aspect of embodiments, modules 1510, 1514, 1516 and/or 1522 may include the configuration similar to that of module 1400 illustrated in example FIG. 14. According to embodiments, modules 1510, 1514, 1516 and/or 1522 may be fed by employing divider network component 1548, which may be fed by preamplifier 1530. In embodiments, Wilkinson divider component 1548 may feed amplifier modules 1510 and 1514 at input ports 1590 on each corresponding module. At location 1590 the signal may be divided into two channels, one to input signal into 1502 and 1514 by configuring port 1403 to feed module preamps 1502, and a second path from 1590 to feed modules 1516 and 1522 through outer path of 1590 through jumpers 1550 and/or 1552. In embodiments, on modules 1516 and 1522, and the corresponding preamps 1502 may be fed by configuring ports at jumper and/or switch in the area 1403 to interface 1591 into 1502 on the corresponding components of 1516 and 1522.

According to embodiments, output combiner network in area 1520 may be centrally located among the modules and/or may include two 2:1 Wilkinson combiners 1542 and 1544 combining 1516 and 1544 as well as 1510 and 1522 respectively. In embodiments, a final 2:1 combiner 1546 may combine 1544 and 1542 into output port 1504, which may include a coaxial and/or waveguide connector, and/or which may port the final combined power directly into coax, or otherwise as configured. In embodiments, the configuration of 4:1 and cascading 2:1 combiners may be employed as illustrated, and/or any other combiner types may be chosen for any reason, for example to meet the specifications of a circuit.

In embodiments, splitter 1548 may be formed above, below and/or intertwined in and/or with combiner network 1520. As illustrated in one aspect of embodiments, splitter 1548 may be disposed over and/or around output combiner network in combiner network 1520 proximate combiner 1544 in regions where cross-overs may be configured.

According to embodiments, input ports could be fed differently than shown, for example, according to embodiments, the outside of the four modules may be fed with a stripline and/or microstrip and/or other conventional passive feed network. In embodiments, for example, when area 1403 is configured with a jumper connecting preamplifier 1402 to transmission line 1401, the outside ports of each module may be fed by a circuit board at the four inputs of transmission line 1401 on the respective four modules being assembled onto combiner network 1520 on the outsides of the module illustrated in FIG. 15. Any configuration for passive microwave circuits and/or their construction techniques may be employed to address the input networks in FIG. 14 to FIG. 15. In embodiments, other layouts may be employed. In embodiments, the layout in FIG. 14 and FIG. 15 may enable relatively dense packing of a power amplifier die in a two-dimensional grid and/or minimal excess routing length in a combiner/divider network, for example the output combiner network illustrated. In embodiments, coaxial microstructures may increase in size as needed, for example as levels are combined in stages to increase the coax power handling, increase the thermal dissipation, and minimize propagation loss. In embodiments, modules illustrated in FIG. 14 may be fed and/or may be power combined, for example in waveguides using e-probe transitions at a port of combiner 1460 and/or area 1403 instead of using the coaxial power combiner illustrated in FIG. 15. In embodiments, a port of combiner 1450 may be waveguide and/or spatially combined to enhance the power handling and/or number of modules that may be combined.

Figure 16:
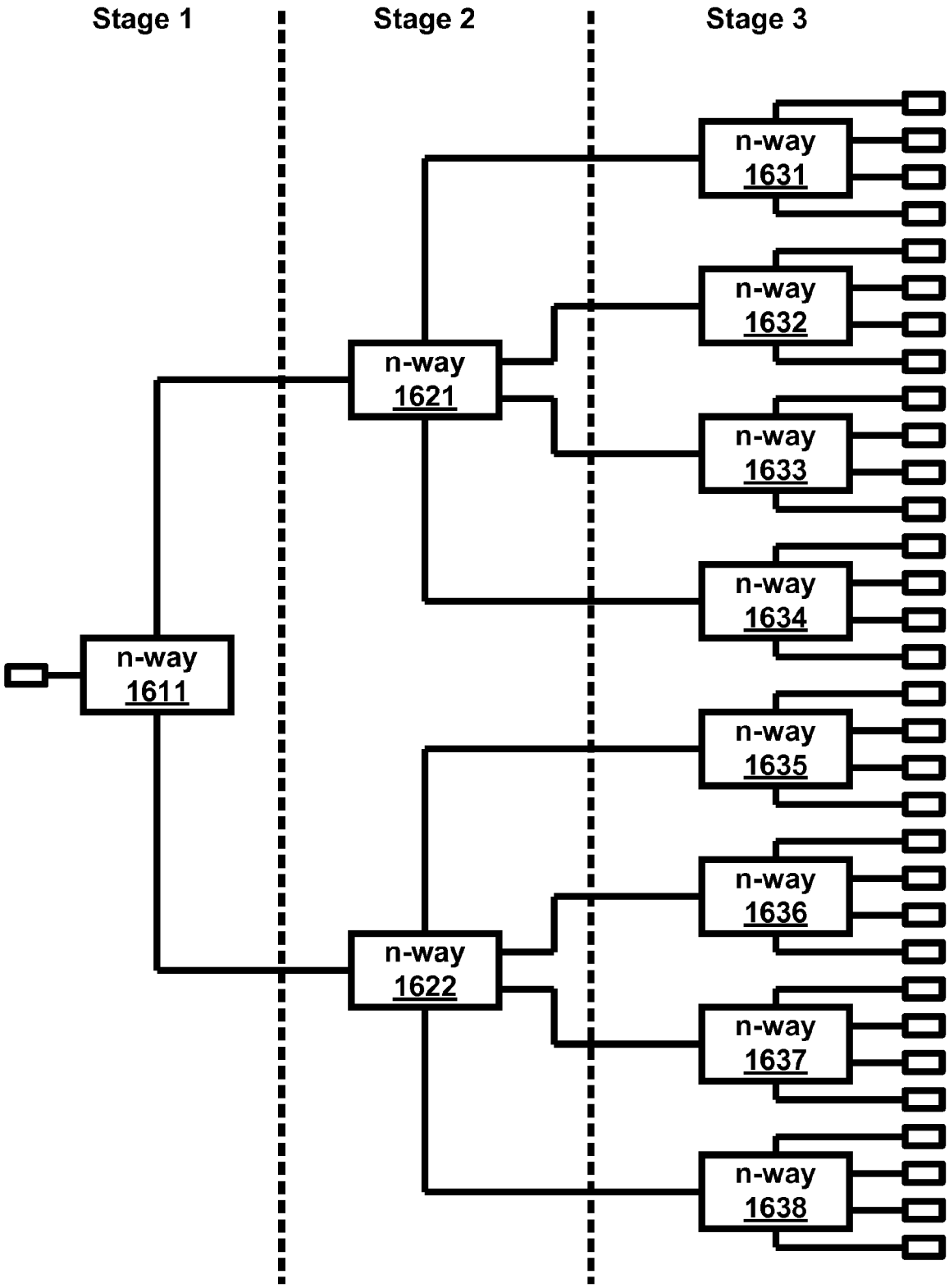
FIG. 16 illustrates an apparatus including a cascading, tiered and/or modular configuration in accordance with one aspect of embodiments.

Referring to example FIG. 16, an apparatus including a cascading, tiered and/or modular configuration is illustrated in accordance with one aspect of embodiments. According to embodiments, an apparatus may include one or more combiner/divider networks, for example a power combiner/divider network. In embodiments, a power combiner/divider network may be configured to split a first electromagnetic signal into two or more split electromagnetic signals. As illustrated in one aspect of embodiments in FIG. 16, an apparatus may include a 1:32 way three-dimensional microstructural power divider network configured to split a first electromagnetic signal into 32 split electromagnetic signals.

According to embodiments, one or more portions of a combiner/divider network may include a three-dimensional microstructure, for example one or more n-way three-dimensional microstructures. In embodiments, an n-way three-dimensional microstructure may include an n-way three-dimensional coaxial microstructure. In embodiments, an n-way three-dimensional coaxial microstructure may include a port and n legs connected to the port. As illustrated in one aspect of embodiments in FIG. 16, 1:32 way three-dimensional microstructural divider network may include 1:2 way three-dimensional coaxial microstructure 1611 and/or 1:4 way three-dimensional coaxial microstructure splitters 1621, 1622, 1631, 1632, 1633, 1634, 1635, 1636, 1637 and/or 1638.

According to embodiments, an apparatus may include one or more tiered and/or cascading portions. In embodiments, a tiered and/or cascading portion may be of one or more combiner/divider networks. As illustrated in one aspect of embodiments in FIG. 16, a 1:32 way three-dimensional microstructural divider network may include three cascading portions and/or stages 1, 2 and/or 3. In embodiments, an electromagnetic signal may be split to two split electromagnetic signals at 1:2 way three-dimensional microstructure splitter 1611 in stage 1. In embodiments, two split electromagnetic signals may be split to eight split electromagnetic signals at 1:4 way three-dimensional microstructure splitters 1621 and 1622 in stage 2. In embodiments, eight split electromagnetic signals may be split to thirty-two split electromagnetic signals at 1:4 way three-dimensional microstructure splitters 1631 . . . 1638 in stage 3. In embodiments, two or more split electromagnetic signals may each be connectable to one or more inputs of one or more electrical devices, for example one or more signal processors. As illustrated in one aspect of embodiments in FIG. 16, thirty-two split electromagnetic signals may be each connectable to an input of thirty-two amplifiers. In embodiments, one or more amplifiers may be configured to process one or more split electromagnetic signals to one or more processed electromagnetic signals, for example one or more amplified electromagnetic signals.

According to embodiments, one or more n-way three-dimensional coaxial microstructures, which may be cascading, may be on different vertical tiers of a apparatus. In embodiments, for example, 1:2 way three-dimensional microstructure splitter 1611 may be on a different vertical tier of an apparatus relative to itself, to another splitter in the same stage or a different stage, such as 1:4 way three-dimensional microstructure splitter 1621, and/or to one or more amplifiers, and/or the like. In embodiments, as another example, one or more 1:4 way three-dimensional microstructure splitters 1631 . . . 1638 may be on a different vertical tier of an apparatus relative to each other.

According to embodiments, one or more combiner/divider networks may be on a different substrate relative to one or more n-way three dimensional microstructures, three-dimensional microstructure combiner/divider networks, electronic devices, and/or the like. In embodiments, for example, 1:2 way three-dimensional microstructure splitter 1611 of 1:32 way three-dimensional microstructural divider network may be on a different substrate than 1:4 way three-dimensional microstructure splitters 1621 and/or 1622. In embodiments, as another example, 1:4 way three-dimensional microstructure splitter 1621 may be on a different substrate than 1:4 way three-dimensional microstructure splitter 1622. In embodiments, as a third example, one or more amplifiers may be on a different substrate relative to each other and/or one or more n-way three-dimensional microstructure splitters.

According to embodiments, one or more portions of a combiner/divider network may be inter-disposed with itself, with another portion of another combiner/divider network and/or with one or more electronic devices of an apparatus. In embodiments, for example, portions of 1:4 way three-dimensional microstructure splitter 1621 may be intertwined with portions of 1:4 way three-dimensional microstructure splitter 1621. In embodiments, for example, portions of 1:4 way three-dimensional microstructure splitters 1631, 1632, 1633, 1634, 1635, 1636, 1637 and/or 1638 may be intertwined with portions of themselves, portions of each other and/or portions of one or more signal amplifiers.

According to embodiments, one or more portions of a combiner/divider network may be inter-disposed vertically and/or horizontally. In embodiments, for example where portions of 1:2 way three-dimensional microstructure splitter 1611 is on a different vertical tier than 1:4 way three-dimensional microstructure splitter 1621, one or more portion of 1:2 way three-dimensional microstructure splitter 1611 may be inter-disposed vertically with one or more portions of 1:4 way three-dimensional microstructure splitter 1621. In embodiments, for example where portions of 1:2 way three-dimensional microstructure splitter 1611 is on the same vertical tier as 1:4 way three-dimensional microstructure splitter 1621, one or more portion of 1:2 way three-dimensional microstructure splitter 1611 may be inter-disposed horizontally with one or more portions of 1:4 way three-dimensional microstructure splitter 1621.

Figure 17:
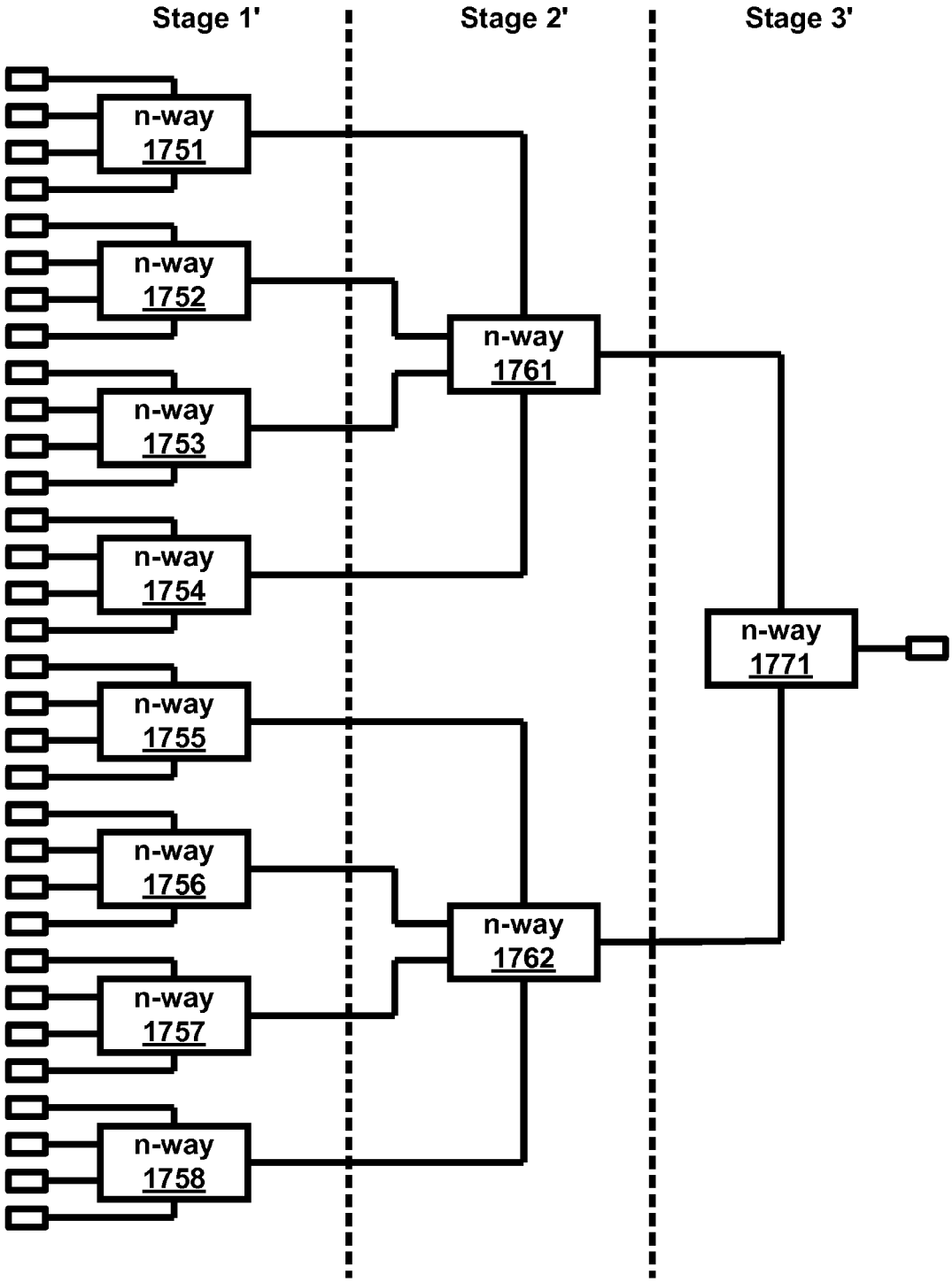
FIG. 17 illustrates an apparatus including a cascading, tiered and/or modular configuration in accordance with one aspect of embodiments.

Referring to example FIG. 17, an apparatus including a cascading, tiered and/or modular configuration is illustrated in accordance with one aspect of embodiments. According to embodiments, an apparatus may include one or more combiner/divider networks, for example a power combiner/divider network. In embodiments, a power combiner/divider network may be configured to combine two or more processed electromagnetic signals into a second electromagnetic signal. As illustrated in one aspect of embodiments in FIG. 16, an apparatus may include a 32:1 way three-dimensional microstructural power combiner network configured to combiner thirty-two processed electromagnetic signals to an electromagnetic signal.

According to embodiments, one or more portions of a combiner/divider network may include a three-dimensional microstructure, for example one or more n-way three-dimensional microstructures. In embodiments, an n-way three-dimensional microstructure may include an n-way three-dimensional coaxial microstructure. In embodiments, an n-way three-dimensional coaxial microstructure may include a port and n legs connected to the port. As illustrated in one aspect of embodiments in FIG. 17, 32:1 way three-dimensional microstructural combiner network may include 2:1 way three-dimensional coaxial microstructures 1771 and/or 4:1 way three-dimensional coaxial microstructure combiners 1751, 1752, 1753, 1754, 1755, 1756, 1757, and/or 1761.

According to embodiments, an apparatus may include one or more tiered and/or cascading portions. In embodiments, a tiered and/or cascading portion may be of one or more combiner/divider networks. As illustrated in one aspect of embodiments in FIG. 17, a 32:1 way three-dimensional microstructural combiner network may include three cascading portions and/or stages 1', 2' and/or 3'. In embodiments, two or more processed electromagnetic signals may each be connectable to one or more outputs of one or more electrical devices, for example one or more signal processors. As illustrated in one aspect of embodiments in FIG. 17, thirty-two processed electromagnetic signals may be each connectable to an output of thirty-two amplifiers. In embodiments, thirty-two processed electromagnetic signals may be combined to eight processed electromagnetic signals at 4:1 way three-dimensional microstructure combiners 1751 . . . 1758 in stage 1'. In embodiments, eight processed electromagnetic signals may be combined to two processed electromagnetic signals at 4:1 way three-dimensional microstructure combiners 1761 and 1762 in stage 2'. In embodiments, two processed electromagnetic signals may be combined at 2:1 way three-dimensional microstructure combiner 1771 in stage 3' to an electromagnetic signal.

According to embodiments, one or more n-way three-dimensional coaxial microstructures, which may be cascading, may be on different vertical tiers of a apparatus. In embodiments, for example, 2:1 way three-dimensional microstructure combiner 1771 may be on a different vertical tier of an apparatus relative to itself, to another combiner in the same stage or a different stage, such as 4:1 way three-dimensional microstructure splitter 1761, and/or to one or more amplifiers, and/or the like. In embodiments, as another example, one or more 4:1 way three-dimensional microstructure combiners 1751 . . . 1758 may be on a different vertical tier of an apparatus relative to each other.

According to embodiments, one or more combiner/divider networks may be on a different substrate relative to one or more n-way three dimensional microstructures, three-dimensional microstructure combiner/divider networks, electronic devices, and/or the like. In embodiments, for example, 2:1 way three-dimensional microstructure combiner 1771 of 32:1 way three-dimensional microstructural divider network may be on a different substrate than 4:1 way three-dimensional microstructure combiners 1761 and/or 1758. In embodiments, as another example, 2:1 way three-dimensional microstructure combiner 1771 may be on a different substrate than 4:1 way three-dimensional microstructure combiner 1762. In embodiments, as a third example, one or more amplifiers may be on a different substrate relative to each other and or one or more n-way three-dimensional microstructure combiners.

According to embodiments, one or more portions of a combiner/divider network may be inter-disposed with itself, with another portion of another combiner/divider network and/or with one or more electronic devices of an apparatus. In embodiments, for example, portions of 4:1 way three-dimensional microstructure combiner 1761 may be intertwined with portions of 4:1 way three-dimensional microstructure combiner 1762. In embodiments, for example, portions of 4:1 way three-dimensional microstructure combiners 1751, 1752, 1753, 1754, 1755, 1756, 1757 and/or 1758 may be intertwined with portions of themselves, portions of each other and/or portions of one or more signal amplifiers.

According to embodiments, one or more portions of a combiner/divider network may be inter-disposed vertically and/or horizontally. In embodiments, for example where portions of 2:1 way three-dimensional microstructure combiner 1771 is on a different vertical tier than 4:1 way three-dimensional microstructure combiner 1761, one or more portions of 2:1 way three-dimensional microstructure combiner 1771 may be inter-disposed vertically with one or more portions of 4:1 way three-dimensional microstructure combiner 1761. In embodiments, for example where portions of 2:1 way three-dimensional microstructure combiner 1771 is on the same vertical tier as 4:1 way three-dimensional microstructure combiner 1761, one or more portion of 2:1 way three-dimensional microstructure combiner 1771 may be inter-disposed horizontally with one or more portions of 4:1 way three-dimensional microstructure combiner 1761.

Referring to example FIG. 16 to FIG. 17, 1:32 way three-dimensional microstructural power splitter network and/or 32:1 way three-dimensional microstructural power combiner network may be connected to one or more other combiner/divider networks, which may include one or more n-way three-dimensional microstructures, waveguide power combiners/dividers, spatial power combiners/dividers and/or electric field probes. In embodiment, for example, 1:32 way three-dimensional microstructural power splitter network and 32:1 way three-dimensional microstructural power combiner network may be connected to each other to form an apparatus. In embodiments, for example where 1:32 way three-dimensional microstructural power splitter network and 32:1 way three-dimensional microstructural power combiner network are connected to each other to form an apparatus, the amplifiers in stage 3 of FIG. 16 may be the same amplifiers illustrated in stage 1' in FIG. 17, such that the same amplifier connected to 1:4 way three dimensional microstructure splitter 1631 may also be connected to 4:1 way three dimensional microstructure combiner 1751.

According to embodiments, an apparatus may include one or more portions constructed as a mechanically releasable module. In embodiments, a mechanically releasable module may be of one or more combiner/divider networks. In embodiments, a mechanically releasable module may include one or more combiner/divider networks, n-way three-dimensional coaxial microstructures, impedance matching structures, transition structures, phase adjusters, signal processors and/or cooling structures, and/or the like. In embodiments, for example, 1:32 way three-dimensional microstructural power splitter network and/or 32:1 way three-dimensional microstructural power combiner network may include one or more portions constructed as a mechanically releasable module. In one aspect of embodiments, stages 1, 1', 2, 2', 3 and/or 3' may be constructed as a mechanically releasable module. In embodiments, for example where stage 3 of FIG. 16 may be constructed as a mechanically releasable module, 1:4 way three dimensional microstructure splitters 1631 . . . 1638 may be constructed to be mechanically releasable relative to portions of themselves, each other, to one or more signal processors and/or to one or more other n-way three dimensional microstructures.

According to embodiments, one or more n-way three-dimensional coaxial microstructures, which may be cascading, may be on different vertical tiers of a apparatus.

In embodiments, for example where 1:32 way three-dimensional microstructural power splitter network and 32:1 way three-dimensional microstructural power combiner network are connected to each other to form an apparatus, 1:2 way three-dimensional microstructure splitter 1611 and 2:1 way three-dimensional microstructure combiner 1771 may be one the same vertical tier of an apparatus. In embodiments, for example, 1:2 way three-dimensional microstructure splitter 1611 and 2:1 way three-dimensional microstructure combiner 1771 may be on the same or different substrate. In embodiments, for example, 1:2 way three-dimensional microstructure splitter 1611 and 2:1 way three-dimensional microstructure combiner 1771 may be configured to be mechanically releasable relative to portions of themselves, each other, to one or more signal processors and/or to one or more other n-way three dimensional microstructures.

According to embodiments, one or more portions of a combiner/divider network may be inter-disposed with itself, with another portion of another combiner/divider network and/or with one or more electronic devices of an apparatus. In embodiments, for example where 1:32 way three-dimensional microstructural power splitter network and 32:1 way three-dimensional microstructural power combiner network are connected to each other to form an apparatus, portions of 1:4 way three-dimensional microstructure splitter 1621 may be intertwined with portions of 4:1 way three-dimensional microstructure combiner 1762.

According to embodiments, one or more portions of a combiner/divider network may be inter-disposed vertically and/or horizontally. In embodiments, for example where 1:2 way three-dimensional microstructure splitter 1621 is on the same vertical tier as 2:1 way three-dimensional microstructure combiner 1771, one or more portion of 1:2 way three-dimensional microstructure splitter 1621 may be inter-disposed horizontally with one or more portions of 2:1 way three-dimensional microstructure combiner 1771.

According to embodiments, the signal processing apparatus illustrated in FIG. 16 to FIG. 17 may include any other feature in accordance with embodiments, such as one or more splitter and/or combiner networks, one or more impedance matching structures, one or more phase adjusters, and/or the like. According to embodiments, one or more portions of one or more combiner/divider networks may include any architecture. In embodiments, one or more portions of one or more combiner/divider networks may include a multi-layer architecture and/or a planar architecture, and/or the like. In embodiments, for example, a multi-layer architecture may include an architecture with one or more apparatus components disposed on different vertical tiers and/or layers of an apparatus. In embodiments, a planar architecture may include an architecture with all apparatus components disposed on the same vertical tier of an apparatus.

Figure 18A:
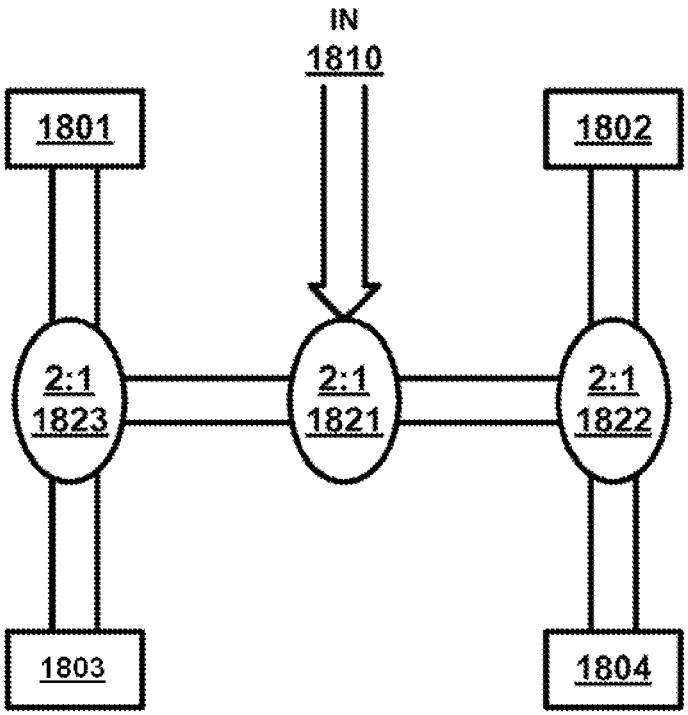
FIGS. 18A to 18B illustrate an H tree architecture and/or an X tree architecture of an apparatus in accordance with one aspect of embodiments.
Figure 18B:
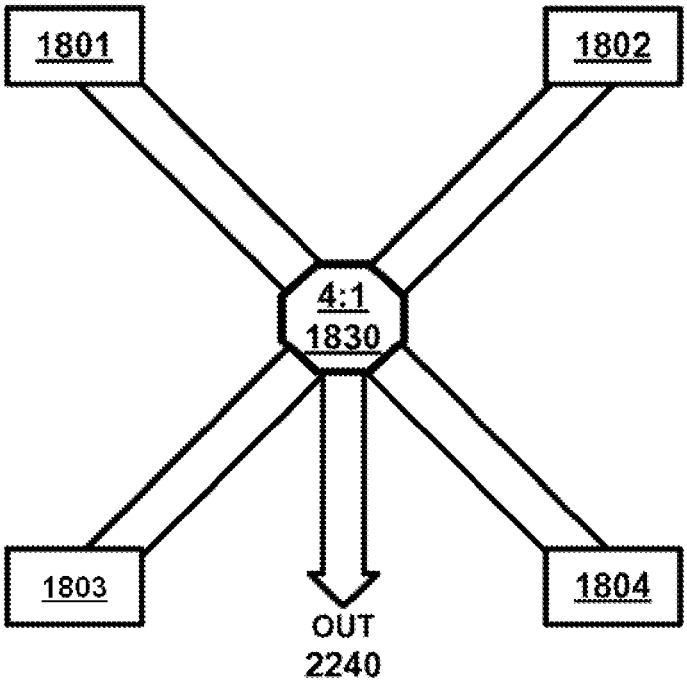

Referring to example FIG. 18A to FIG. 18B, an H tree architecture and/or an X tree architecture of an apparatus is illustrated in accordance with one aspect of embodiments. According to embodiments, an H tree architecture may include three or more n-way three-dimensional microstructure combiners/dividers. In embodiments, for example, an H tree architecture may include tree or more n-way three-dimensional coaxial microstructure combiners/dividers. In embodiments, architectures may be repeated into a one-dimensional and/or two-dimensional arrangement, for example to provide a relatively close packing density of signal processors, such as amplifier die to be combined with minimal added routing length between the devices.

As illustrated in one aspect of embodiments in FIG. 18A, 1:2 way three-dimensional microstructure splitter 1821 may be configured to split electromagnetic signal 1810 to two split electromagnetic signals. In embodiments, 1:2 way three-dimensional microstructure splitters 1822 and 1823 may be configured to split received split electromagnetic signals to two more split electromagnetic signals, to provide four split electromagnetic signals. In embodiments, the four split electromagnetic signals may each be connectable to an input of signal processors 1801, 1802, 1803 and/or 1804. In embodiments, electromagnetic signal 1810 may be a first electromagnetic signal and/or a split electromagnetic signal.

According to embodiments, 1:2 way three-dimensional microstructure splitters 1821, 1822 and/or 1823 may be connected to any device, for example to another 1:2 way three-dimensional microstructure splitter. In embodiments, for example where 1:2 way three-dimensional microstructure splitters 1822 and 1823 are connected to another 1:2 way three-dimensional microstructure splitter, each of the other 1:2 way three-dimensional microstructure splitters may be connected to other devices and/or signal processors in an H tree configuration. In embodiments, 1:2 way three-dimensional microstructure splitter 1821 may be connected to any device, for example an n-way three-dimensional microstructure and/or a connector, such as a coaxial connector and/or waveguide port. In embodiments, an H tree architecture may be employed in a combiner network and/or a divider network, for example to combine and/or divide electromagnetic signals.

According to embodiments, an X tree architecture may include one or more n-way three-dimensional microstructure combiner/divider. In embodiments, for example, an X tree architecture may include an n-way three-dimensional coaxial microstructure combiner/divider. As illustrated in one aspect of embodiments in FIG. 18B, 4:1 way three-dimensional microstructure combiner 1830 may be configured to combine four electromagnetic signals to one electromagnetic signals 2240. In embodiments, four electromagnetic signals may each be connectable to an output of signal processors 1801, 1802, 1803 and/or 1804.

According to embodiments, 4:1 way three-dimensional microstructure combiner 1830 may be connected to any device, for example to one or more other 4:1 way three-dimensional microstructure combiners which may be connected to one or more other devices and/or signal processors. In embodiments, 4:1 way three-dimensional microstructure combiner 1830 may be connected to a connector, such as a BNC connector. In embodiments, an X tree architecture may be employed in a combiner network and/or a divider network, for example used to combine and/or divide electromagnetic signals.

According to embodiments, the signal processing apparatus illustrated in FIG. 18 may include any feature in accordance with embodiments, such as one or more splitter and/or combiner networks, one or more impedance matching structures, one or more phase adjusters, and/or the like. In embodiments, a signal processing apparatus may include one or more tiered and/or cascading portions. In embodiments, a signal processing apparatus may include one or more portions on a different substrate relative to one or more n-way three-dimensional microstructures, three-dimensional microstructure combiner/divider networks, electronic devices, and/or the like. In embodiments, a signal processing apparatus may include one or more portions inter-disposed with itself, with another portion of another combiner/divider network and/or with one or more electronic devices of an apparatus. In embodiments, a signal processing apparatus may include one or more portions constructed as a mechanically releasable module. In embodiments, a signal processing apparatus may include any architecture.

Figure 19:
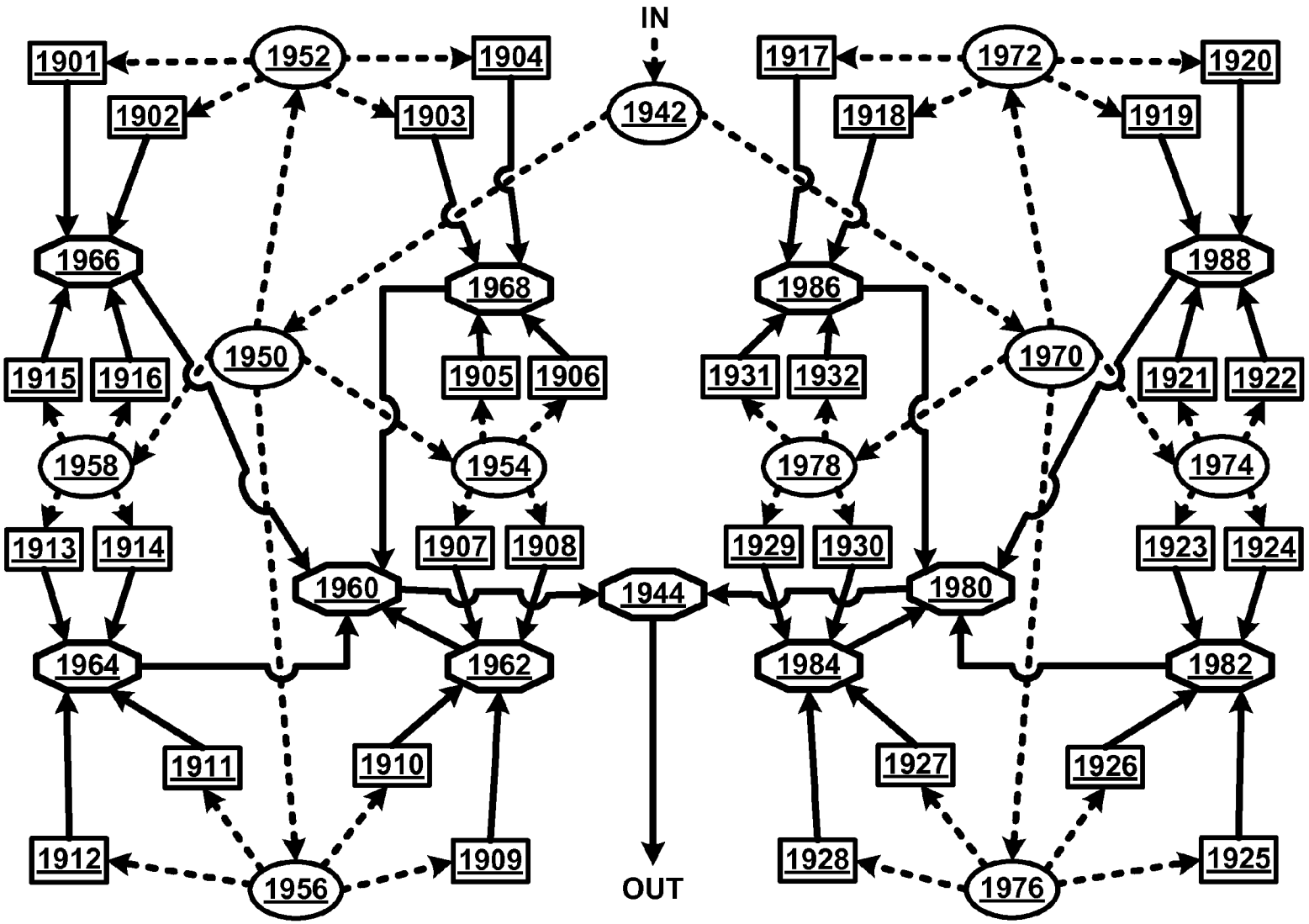
FIG. 19 illustrates an apparatus including a cascading, tiered and/or modular configuration in accordance with one aspect of embodiments.

Referring to example FIG. 19, an apparatus including a cascading, tiered and/or modular configuration is illustrated in accordance with one aspect of embodiments.

According to embodiments, 1:2 way three-dimensional microstructure splitter 1942 may be configured to split an electromagnetic signal to two split electromagnetic signals. In embodiments, 1:4 way three-dimensional microstructure splitters 1950 and 1970 may be configured to split received split electromagnetic signals to four more split electromagnetic signals, and/or provide a split electromagnetic signals to each 4:1 way three-dimensional microstructure splitters 1952, 1954, 1956, 1958, 1972, 1974, 1976 and/or 1978, respectively. In embodiments, a split electromagnetic signals may each be connectable to an input of signal processors 1901 to 1931.

According to embodiments, thirty-two processed electromagnetic signals may be each connectable to an output of signal processors 1901 to 1931. In embodiments, thirty-two processed electromagnetic signals may be combined to eight processed electromagnetic signals, for example combining sixteen processed signals to eight processed signals by employing 4:1 way three-dimensional microstructure combiners 1962, 1964, 1966, 1968, 1982, 1984, 1986 and/or 1988, respectively. In embodiments, eight processed electromagnetic signals may be combined to two processed electromagnetic signals, for example combining four processed signals to two processed signals by employing 2:1 way three-dimensional microstructure combiners 1960 and 1980. In embodiments, two processed electromagnetic signals may be combined to one processed electromagnetic signals, for example combining two processed signals to one processed signal by employing 2:1 way three-dimensional microstructure combiner 1944.

According to embodiments, the signal processing apparatus illustrated in FIG. 19 may include any feature in accordance with embodiments, such as one or more splitter and/or combiner networks, one or more impedance matching structures, one or more phase adjusters, and/or the like. In embodiments, a signal processing apparatus may include one or more tiered and/or cascading portions. In embodiments, a signal processing apparatus may include one or more portions on a different substrates relative to one or more n-way three-dimensional microstructures, three-dimensional microstructure combiner/divider networks, electronic devices, and/or the like. In embodiments, a signal processing apparatus may include one or more portions inter-disposed with itself, with another portion of another combiner/divider network and/or with one or more electronic devices of an apparatus. In embodiments, a signal processing apparatus may include one or more portions constructed as a mechanically releasable module. In embodiments, a signal processing apparatus may include any architecture.

Figure 20:
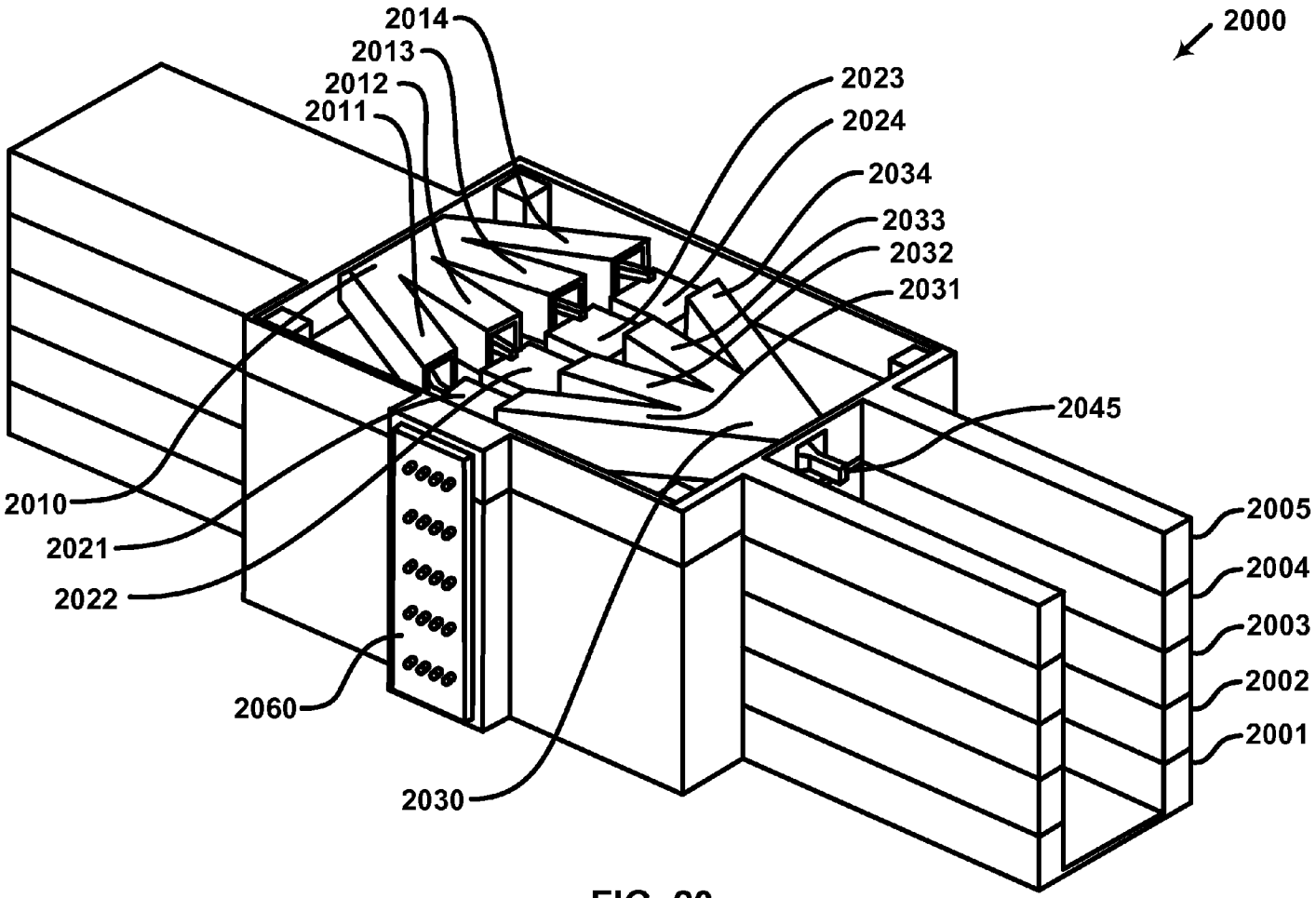
FIG. 20 illustrates an apparatus including a modular configuration and having one more antennas in accordance with one aspect of embodiments.

Referring to example FIG. 20, an apparatus including a modular configuration and having one more antennas is illustrated in accordance with one aspect of embodiments. According to embodiments, one or more pallets may be stacked, for example pallets stacked in tiers 2001 to 2005 of apparatus 2000. In embodiments, each pallet may include one or more input and/or output structures. As illustrated in one aspect of embodiments in FIG. 20, an input and/or output structure 2045 for pallet 2005 may include an e-probe leading into a three-dimensional coaxial microstructure splitter and/or combiner 2030. In embodiment, for example, three-dimensional coaxial microstructure 2030 may be employed as a splitter when e-probe 2045 is employed as an input structure. In embodiments, for example, three-dimensional coaxial microstructure 2030 may be employed as a combiner when e-probe 2045 is employed as an output structure.

According to embodiments, three-dimensional coaxial microstructure 2030 may branch to four legs 2031 to 2034 employing any configuration, for example employing a 1:4 Wilkinson and/or Gysel divider configuration. In embodiments, signal processors, such as amplifier die 2021 to 2024, may be connected to one or more three-dimensional coaxial microstructure by employing a transition structure. In embodiments, legs 2011 to 2014 may combine to an output structure, such as an e-probe on the opposite side by employing a similar configuration relative to e-probe 2045. In embodiments, the configuration may be the same and/or different in each pallet.

Figure 21:
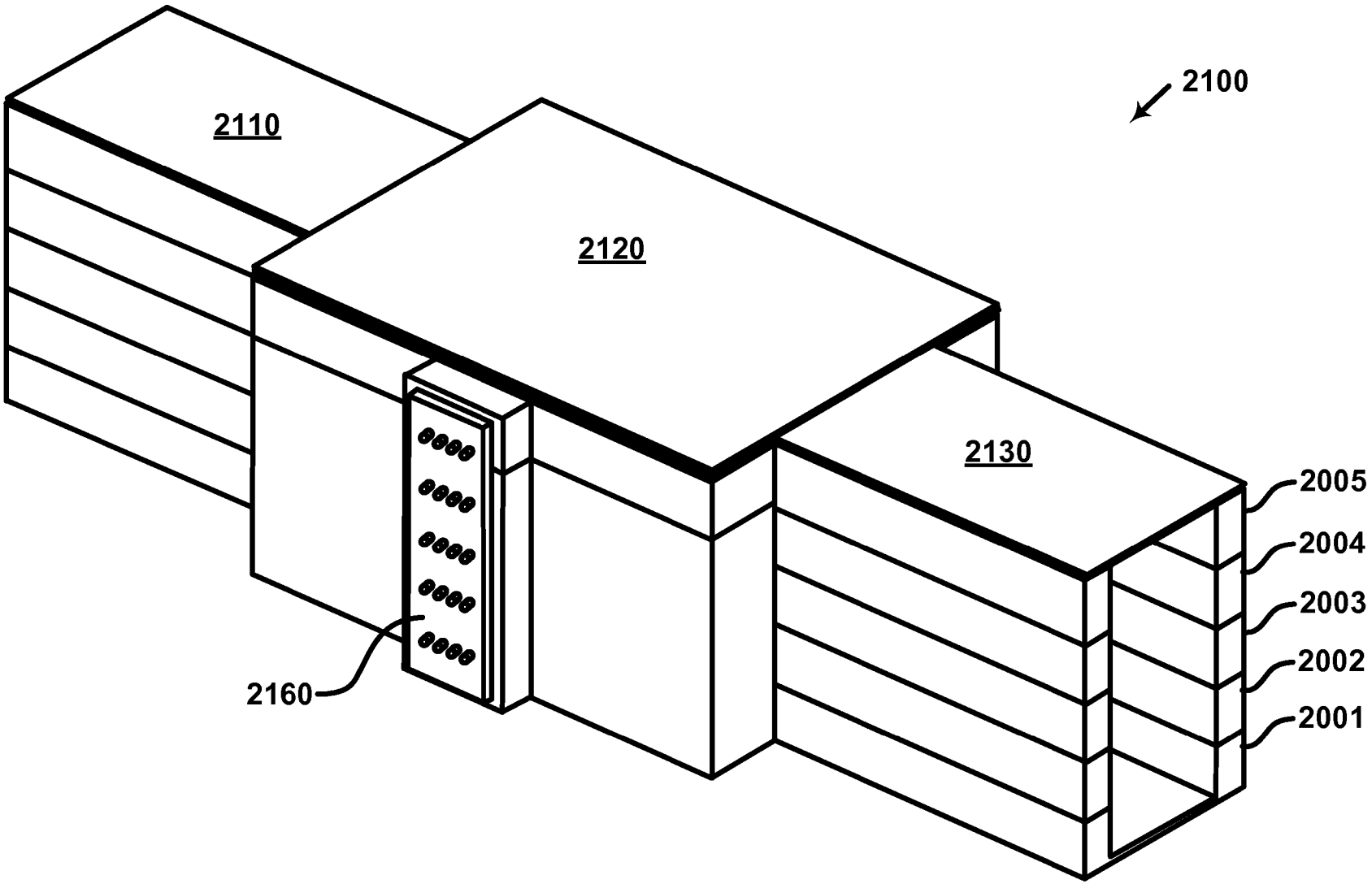
FIG. 21 illustrates an apparatus including a modular configuration and having one more antennas in accordance with one aspect of embodiments.

According to embodiments, pallets 2001 to 2005 may be stacked to provide a waveguide input and/or output, as illustrated in one aspect of embodiments in FIG. 21. In embodiments, an interconnect structure may be provided, for example interconnect structure 2060, which may provide bias, power, other I/O and/or control to one or more signal processors. In embodiments, an interconnect may be formed separately and/or as part of forming one or more pallets.

According to embodiments, stacking layers 2001 to 2005 may form a waveguide structure. In embodiments, an e-probe may be parallel to a three-dimensional coaxial microstructure and radiate in a waveguide that is parallel to the coaxial microstructure, as illustrated in one aspect of embodiments in FIGS. 20 to 21. In embodiments, pallets may include e-probes which radiate perpendicular to a three-dimensional coaxial microstructure to couple power and/or signals from two or more waveguides.

According to embodiments, waveguides may be formed monolithically and/or separately. In embodiments, waveguides may be disposed above and/or around one or more pallets, for example pallet 2005. In embodiments, processes and/or structures may be leveraged in a spatial power combiner structure for free-space propagation, for power combing into over-molded waveguides and/or for quasi optical and/or lens based power combining techniques.

Referring to example FIG. 21, an apparatus including a modular configuration and having one or more antennas is illustrated in accordance with one aspect of embodiments. As illustrated in one aspect of embodiments in FIG. 21, a capping structure may be provided, for example including portions 2110 to 2130, which may cap an apparatus. In embodiments, capping portion 2110, 2120, and 2130 may be placed over pallet 2005 to complete a waveguide assembly including pallets 2001 to 2005. In embodiments, capping portion 2130 may cover the signal processors and/or any other devices and/or structures. In embodiment, a completed assembly may provide signal processors such as amplifier die, to be combined with a mixture of coaxial and waveguide modes in a small form factor. In embodiments, a waveguide input and/or output may be formed in the process of assembly together with capping portions 2110, 2120, and 2130. In embodiments, capping portions may be formed separately in a separate forming operation and then combined with one or more pallets.

Referring back to example FIG. 22A to FIG. 22D, a resistor and/or resistor socket is illustrated in accordance with one aspect of embodiments. In embodiments, a resistor configuration illustrated in example FIG. 22A may be employed in one or more n-way three dimensional microstructures, for example as illustrated in FIG. 6 and/or any other 1:4 way combiner/divider networks, such as Wilkinson combiner/dividers. As illustrated in one aspect of embodiments in FIG. 22A, a 4-way resistor may include resistive materials 595, 596, 597, and/or 598, for example a film of TaN. In embodiments, four conductive interfaces 591 to 594, for example bond pads, may provide a diffusion barrier and/or may be formed of a noble metal such as Ni/Au. In embodiments, joining interfaces 2201 to 2204, for example thermal contact pads, may be provided, for example at the edges.

According to embodiments, films may be disposed on a substrate which may be a high thermal conductivity substrate, for example synthetic diamond, MN, BeO, or SiC. In embodiments, relatively small size may be provided and/or maximum power may be dissipated in a resistor. In embodiments, relatively lower power resistors may be disposed on other suitable substrates and/or may be chosen based on having a low dielectric constant and/or low loss factor. In embodiments, for example, quarts and/or $SiO_2$ mat be employed. In embodiments, resistor material may include semiconductors with diffused resistors. In embodiments, passivating films may be disposed on resistive films, for example $SiO_2$ or $Si_3N_4$. In embodiments, a substrate may be thinned to any undesired modes and standing waves. In embodiments, a substrate may have structures and/or resistive coatings on a back side to minimize unwanted resonances and/or modes in a substrate. In embodiments, resistive values employed may be derived from software such as Agilent's ADS® or Ansoft Designer®.

Referring to example FIG. 22B, a resistor mounting region for a coaxial 4-way Wilkinson combiner is illustrated in accordance with embodiments. In embodiments, a first coaxial microstructure may move through a second microstructural element. In embodiments, for example, first microstructural elements 2221, 2222, 2223 and/or 2224 may move upward from their normal path in a plane through openings. In embodiments, first microstructural elements 2221 to 2224 may protrudes above second microstructural element 2220, for example a ground plane, that is disposed over the four in-plane first microstructural elements 2221 to 2224 below. In embodiments, joining interfaces 2211 to 2214, for example thermal bond pads, may also be provided. In embodiments, thermal contact pads on a resistor, for example illustrated in FIG. 22A, may be bonded to a raised resistor port and/or socket, as illustrated in FIG. 22B, by flip-chip mounting without shorting resistor material and/or may be provided away from the ground plane 2220 at a distance to minimize and/or control parasitic capacitive coupling between a resistor and a socket. In embodiments, distances may depend on the resistor material and/or may be between approximately 5 to 50 microns. In embodiments, suitable structures may be grown in a fabrication process and/or the structure illustrated in FIG. 22B could be grown on a substrate containing a patterned resistor.

Figure 22C:
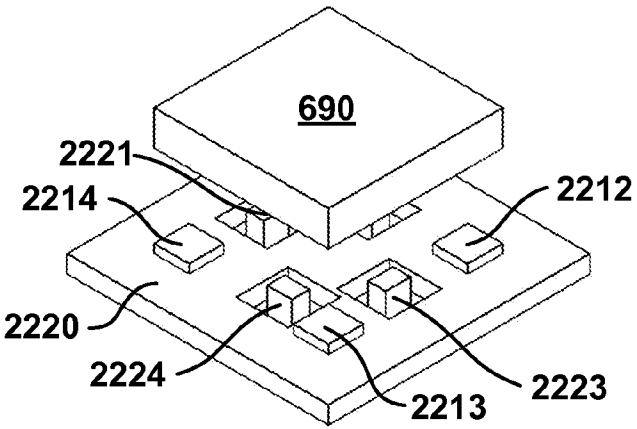
Figure 22D:
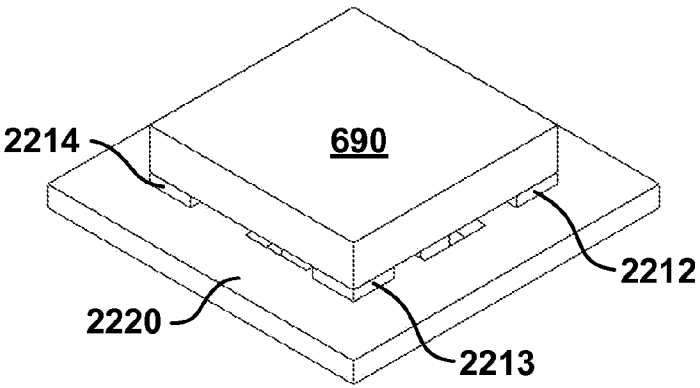

As illustrated in one aspect of embodiments in FIG. 22C, resistor 690 may be mounted in a flip-chip mode. As illustrated in FIG. 22D, the resistor is mounted. In embodiments, any suitable process may be employed to attach one or more resistors, for example employing technical requirements for conductivity and/or thermal transfer. In embodiments, for example, solder, conductive epoxy, and/or gold thermocompression bonding may be employed.

Referring to example FIG. 23A to FIG. 23B, an n-way three-dimensional coaxial combiner/divider microstructure is illustrated in accordance with one aspect of embodiments. As illustrated on one aspect of embodiments in FIG. 23A, a 4-way combiner may be modeled after a planar electrical design by Ulrich Gysel and/or realized as a three-dimensional coaxial microstructure for a 4-way path. In embodiments, 4-way combiner/divider may be adapted employing Ansoft's HFSS® and/or Ansoft's Designer® software.

According to embodiments, input and/or output 2302 may be provided for a divider and/or combiner. In embodiments, legs 2310, 2320, 2330, and/or 2340 may be provided. In embodiments, ports 2318, 2338 and/or 2348 each may be symmetric with port 2328, which may provide access to a first microstructure element of leg 2320. In embodiments, 2310, 2320, 2330, and/or 2340 may represent branches (e.g., legs), in this case four branches, of a divider/combiner. As illustrated in example FIG. 23A to FIG. 23B, 2318, 2328, 2338 and 2348 may represent output/input ports of each of the four branches, respectively 2310, 2320, 2330 and 2340.

According to embodiment, segments and/or branches may each include a resistor mounting region on their surface. In embodiments, a resistor mounting region may include a ground plane for an outer conductor and/or a coaxial output, for example as resistor mounting region 2312 illustrated in FIG. 23A on branch 2310. As illustrated in one aspect of embodiments in FIG. 23B showing a top down transparent view of FIG. 23A, output ports 2318, 2328, 2338 and/or 2348 may be disposed in a relatively lower level of coax. In embodiments, impedance adapted arms 2316, 2326, 2336, and/or 2346 branching from input/output port 2302 may be provided. In embodiments, impedance adapted arms may transition to an upper layer of a coaxial line, for example proximate to end portions of 2310, 2320, 2330 and 2340. In embodiments, a coaxial branch may connect a resistor mounting region in mounting regions 2312, 2322, 2332, and 2342, for example after a transition. In embodiments, relatively low-impedance adapted arms 2316, 2326, 2336, and/or 2346 may tie together at a point, for example, located above input/output port 2302.

According to embodiments, a Gysel configuration may not include a resistor in a relatively sensitive electrical center of a device. In embodiments, a standard 2-port resistor may be employed at each leg. In embodiments, the design may be less sensitive to detuning due to resistor placement and/or tolerance variations. In embodiments, a resistor's thermal density may be minimized as it is divided into multiple components, for example compared to an n-way Wilkinson (N>2). In embodiments, the design may provide a direct path to a thermal ground in an outer conductor of a coax. In embodiments, routing loss may be minimized for some configurations.

According to embodiments, bandwidth of a related Gysel design may not be expanded to the degree that the Wilkinson may, for example illustrated in one aspect of embodiments in FIG. 6, by adding more quarter wave stages as needed. In embodiments, a related Gysel design may be limited by the half wave segment required. In embodiments, a Gysel design in accordance with embodiments may add a single set of quarter wave transformers to output ports of a Gysel three-dimensional microstructure and may be adapted to achieve on the order of approximately 80% bandwidth. As illustrated in one aspect of embodiments in FIG. 24C, a Gysel design may be further adapted by employing Ansoft Designer®, Agilent ADS® or another electronic design analysis software for the correct resistor values with the quarter wave transformers added.

According to embodiments, a Gysel design may be further adapted in accordance with circumstances and/or requirements. In embodiments, for example, curved and/or folded branches may be employed to minimize the physical size of an apparatus. In embodiments, for example, legs may be folded and/or curved to minimize size. In embodiments, ports may be disposed at a lower layer, as illustrated in one aspect of embodiments in FIGS. 23A and 23B, and/or may be routed up, down, and/or laterally as desired.

Figure 24A:
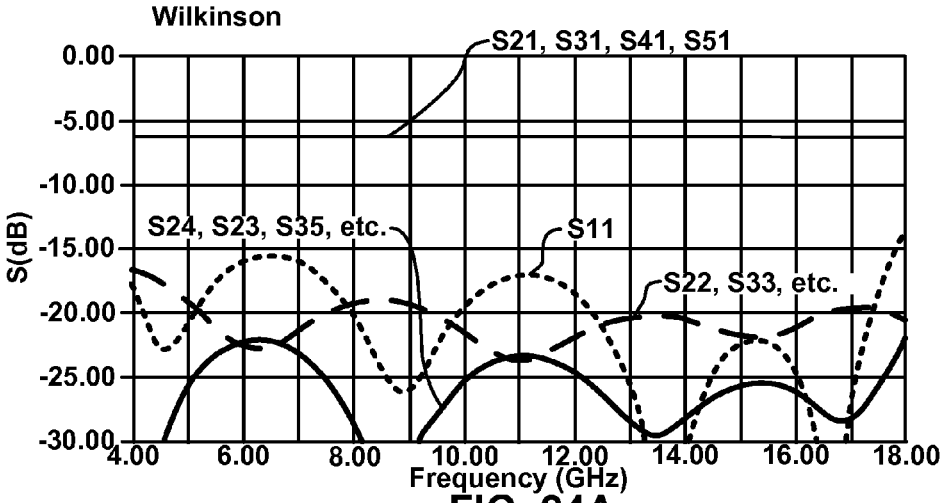
FIGS. 24A to 24C are graphical illustrations of performance of n-way three-dimensional coaxial combiner/divider microstructures in accordance with one aspect of embodiments.
Figure 24B:
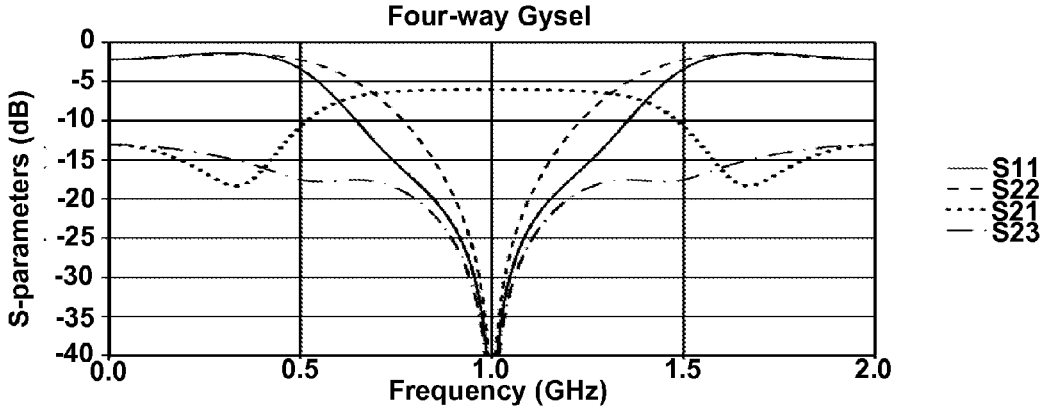
Figure 24C:
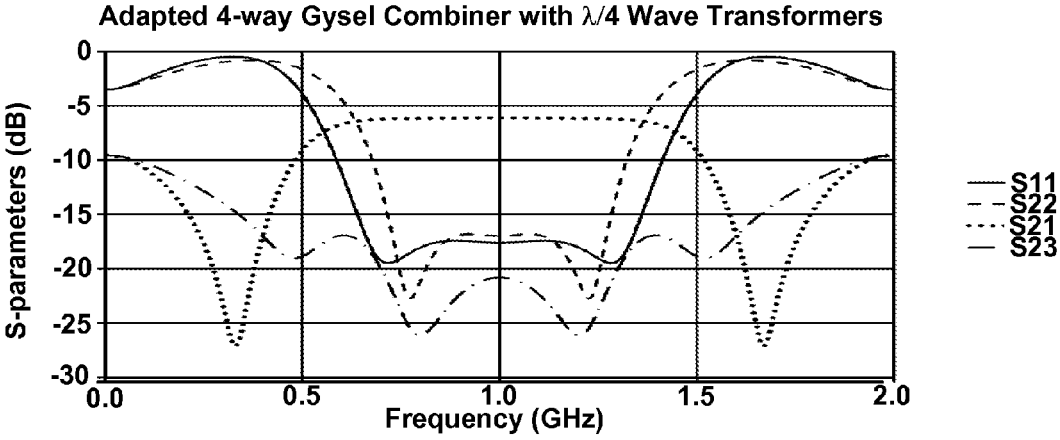

Referring to example FIG. 24A to FIG. 24C, graphs illustrate modeled performance of an n way three-dimensional microstructure combiner/divider. Referring to FIG. 24A, modeled performance of a 4-way extended bandwidth Wilkinson combiner/divider illustrated in FIG. 6 (as modeled in HFSS®) is illustrated. In embodiments, more or less bandwidth may be achieved by added more or less segments at the penalty of slightly increasing loss with each segment added. Referring to FIG. 24B, the bandwidth of a Gysel 4-way splitter/combiner illustrated in FIG. 23A to 23B is presented. Referring to example FIG. 24C, an adapted Gysel combiner/divider realized by adding quarterwave transformers to all ports and allowing the termination values to adjust without being fixed at 50 ohms is illustrated. In embodiments, adaptation was preformed across 80% bandwidth with a reduction in constraints of the center frequency. In embodiments, adaptation may be performed employing Designer® from Ansoft and/or ADS® from Agilent. As illustrated in FIG. 24C, substantially improved bandwidth performance may be achieved with an adapted Gysel design.

Figure 25C:
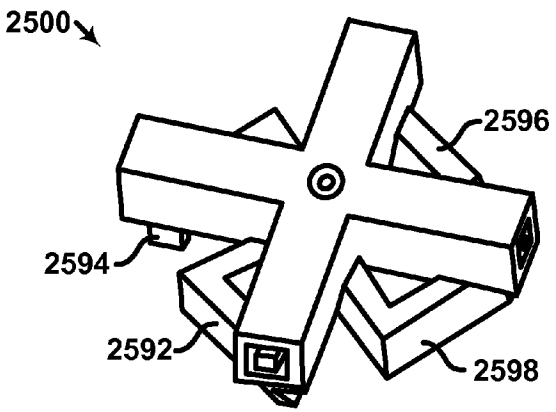
FIGS. 25A to 25D illustrate an n-way three-dimensional coaxial combiner/divider microstructure in accordance with one aspect of embodiments.
Figure 25D:
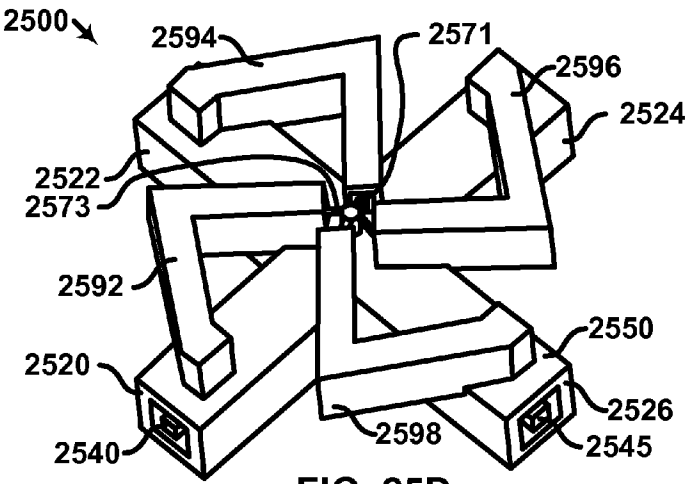
Figure 25A:
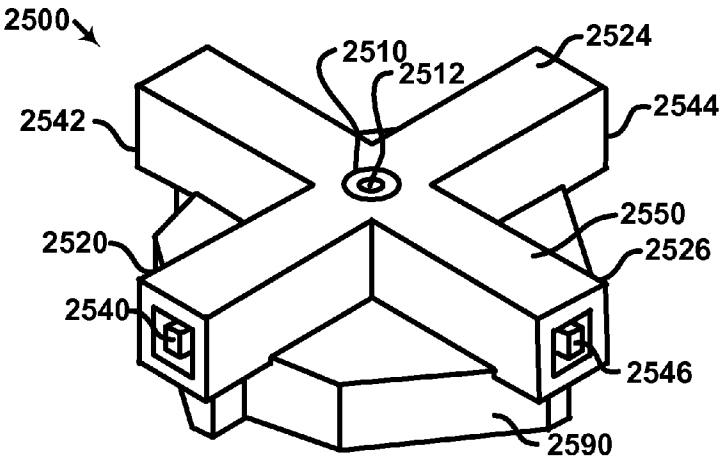
Figure 25B:
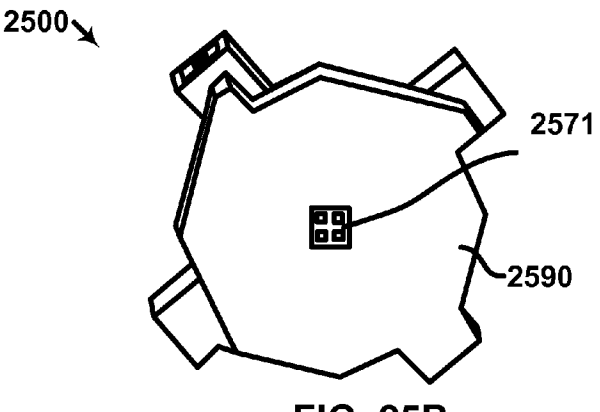

Referring to example FIG. 25A to FIG. 25C, an n-way three-dimensional coaxial combiner/divider microstructure is illustrated in accordance with one aspect of embodiments. According to embodiments, 1:4 way three-dimensional coaxial combiner/divider microstructure 2500 may include port 2510 and/or legs 2520, 2522, 2524 and/or 2526. In embodiments, 1:4 way three-dimensional coaxial combiner/divider microstructure 2500 may include first microstructural elements 2512, 2540, 2542, 2544 and/or 2546, which may be spaced apart from second microstructural element 2550.

According to embodiments, 1:4 way three-dimensional coaxial combiner/divider microstructure 2500 may operate as a combiner and/or as a divider. As illustrated in one aspect of embodiments in FIG. 25A, first microstructural elements 2512, 2540, 2542, 2544 and/or 2546 may be connected to form an electrical path through 1:4 way three-dimensional coaxial combiner/divider microstructure 2500. In embodiments, an operational wavelength may be considered to configure an electrical path through a 1:4 way three-dimensional coaxial microstructure 2500. In embodiments, for example, the length of first microstructural elements 2540, 2542, 2544 and/or 2546 may be approximately ¼ of an operational wavelength.

According to embodiments, an n-way three-dimensional coaxial combiner/divider microstructure may include an electrical path between n legs and a resistive element. As illustrated in one aspect of embodiments in FIG. 25B, 1:4 way three-dimensional coaxial combiner/divider microstructure 2500 may include an electrical path between legs 2520, 2522, 2524 and/or 2526 and resistive element 2571. In embodiments, a resistive element may be in the form of a resistor module. In embodiments, a resistor module may include any desired configuration. As illustrated in one aspect of embodiments in FIG. 25B, resistor module 2571 may include a star configuration.

According to embodiments, 1:4 way three-dimensional coaxial combiner/divider microstructure 2500 may include one or more additional microstructural elements, for example base structure 2590. In embodiments, base structure 2590 may house one or more resistive elements, for example star shaped resistor module 2571. In embodiments, base structure 2590 may include one or more cavities housing an electrical path connecting resistor module 2571 to first microstructural elements 2540, 2542, 2544 and/or 2546. In embodiments, base structure 2590 may further maximize electrical and/or mechanical insulation, mechanical releasable modularity, and/or the like, of 1:4 way three-dimensional coaxial combiner/divider microstructure 2500.

Referring to FIG. 25C to FIG. 25D, 1:4 way three-dimensional coaxial microstructure 2500 is illustrated in accordance with another aspect of embodiments. In embodiments, base structure 2590 may be removed to expose one or more additional microstructural elements. In embodiments, microstructural arms 2592, 2594, 2596 and/or 2598 may include a first arm microstructural element and/or a second arm microstructural element. In embodiments, a first arm microstructural element may be disposed inside a second arm microstructural element, and/or may be spaced apart from a second arm microstructural element.

According to embodiments, a first arm microstructural element may form an electrical path between a first microstructural element of an n-way three-dimensional coaxial microstructure and a resistive element. As illustrated in one aspect of embodiments in FIG. 25D, microstructural arm 2595 may include a first arm microstructural element connected to first microstructural element 2540 at one end and to resistor material 2573 of resister module 2571 at the other end. In embodiments, an operational wavelength may be considered to configure an electrical path through a 1:4 way three-dimensional coaxial microstructure 2500. In embodiments, for example, an operational wavelength may be considered to configure an electrical path between a resistive element and one or more first microstructural elements. In embodiments, for example, the length of a first arm microstructural element of arms 2592, 2594, 2596 and/or 2598 may be approximately ½ of an operational wavelength.

Referring to example FIG. 26A to FIG. 26D, a power combining architecture is illustrated in accordance with embodiments. As illustrated in one aspect of embodiments in FIG. 26A, a 32 chip power combining amplifier 2600 may include an interwoven three-dimensional input and/or output combiner including several vertical layers, and/or modularized into, for example, three of more stacked levels. In embodiments, 32 chips (e.g., 2612 illustrated in FIG. 26B) may be combined employing a 4-way X tree architecture (e.g., network 2620 illustrated in FIG. 26C). In embodiments, four 4-way combiners may be combined using a larger diameter 4-way combiner (e.g., 2630 illustrated in FIG. 26D).

Figure 26C:
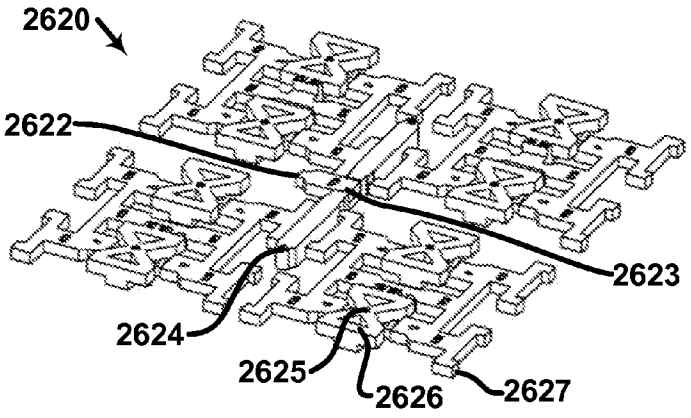
FIGS. 26A to 26D illustrate an apparatus including a cascading, tiered and/or modular configuration in accordance with one aspect of embodiments.
Figure 26D:
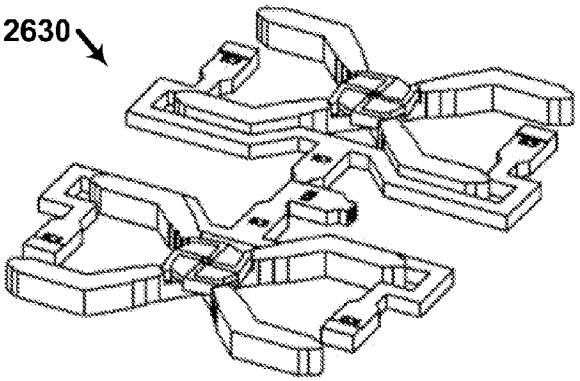
Figure 26A:
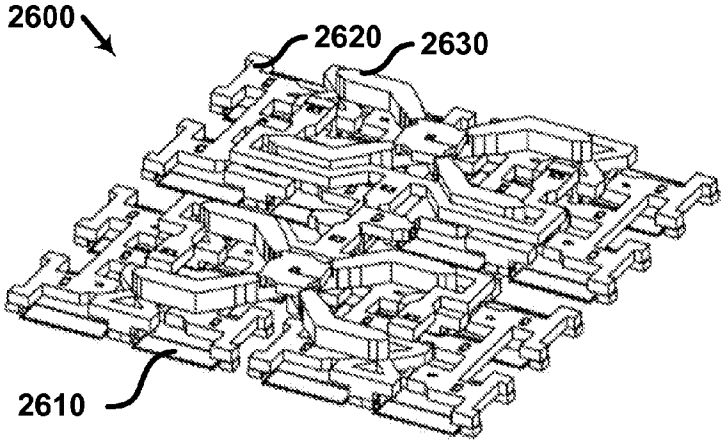
Figure 26B:
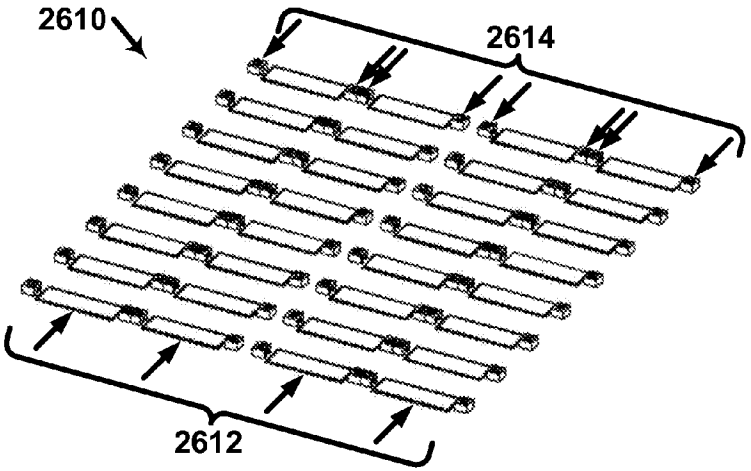
Figure 27:
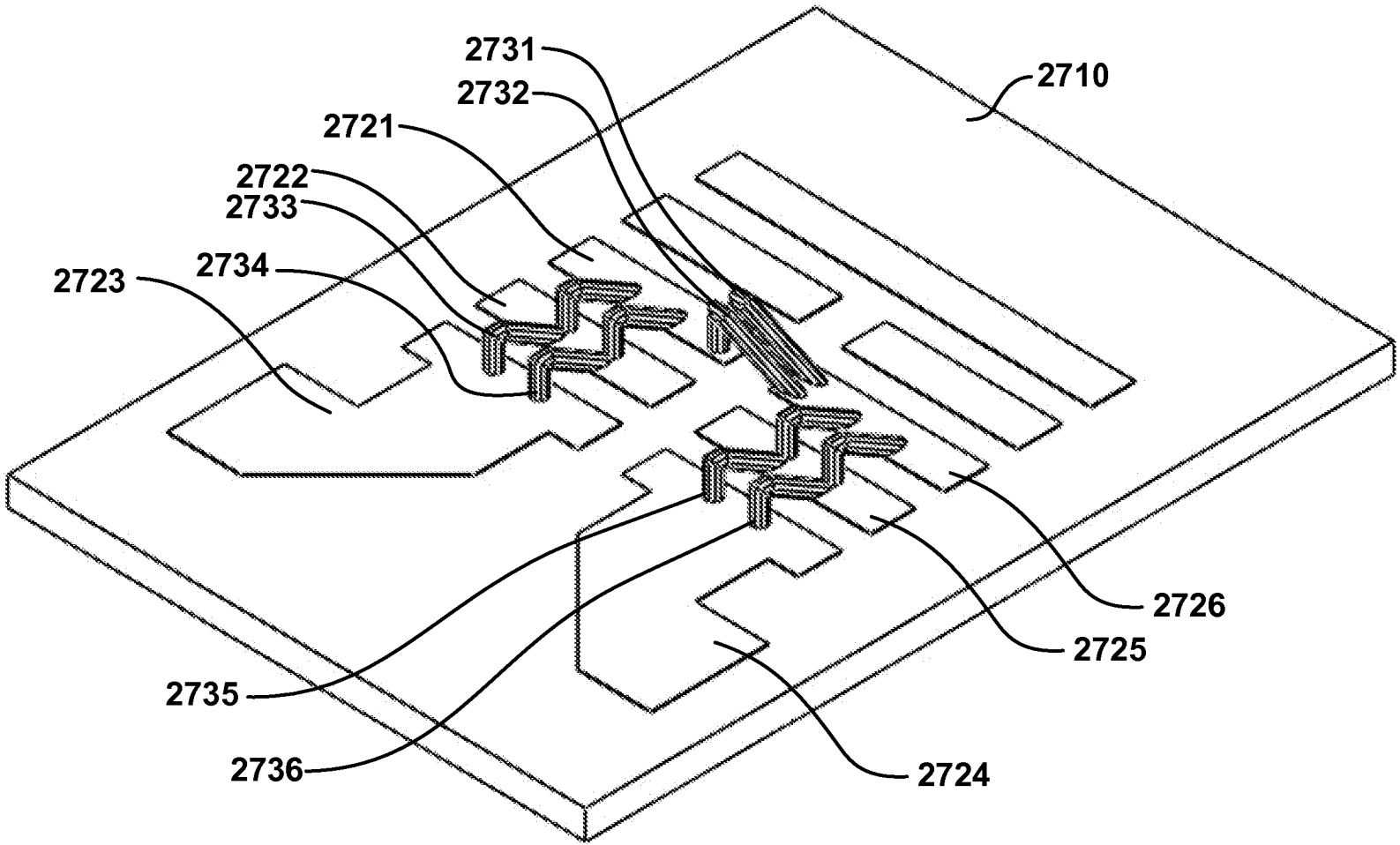
FIG. 27 illustrates a phase adjuster in accordance with one aspect of embodiments.

Referring to FIG. 26B, elements of a lowermost layer and/or module 2610 (e.g., lowermost vertical tier) may be disposed on a substrate, for example including MN, SiC, BeO, $Al_2O_3$, and/or the like. In embodiments, a substrate may contain signal processors. As illustrated in one aspect of embodiments, power amplifier die such as GaN or GaAs or InP chips 2612 may be provided in a two-dimensional array. In embodiments, chips 2612 may be interfaced to one or more three-dimensional coaxial microstructure combiners in a modular configuration using interface structures 2614. In embodiments, interface structures may provide a permanent and/or temporary interconnect to one or more combiners that may be connected above and/or beside layer 2610, for example combiner network 2620 illustrated in FIG. 26C. In embodiments, interface structures may include transition structures. In embodiments, transition structures 2614 may be disposed on a substrate and/or formed as part of a substrate of layer 2610. In embodiments, transition structures 2614 may provide a coaxial interface on their upper surface and/or a coaxial-to-CPW and/or microstrip transition to chips 2612 at each port on the chip to be interfaced.

Processes and/or structures in accordance with embodiments may be employed. In embodiments, for example, a jumper and/or a phase compensating jumper may be employed to provide a transition to chips 2612, which may include a microstrip or CPW mode. In embodiments, jumpers and/or transitions may be adapted to provide decades and/or more bandwidth, and/or may provide interface losses of less than approximately 1/10 of 1 dB. In embodiments, structures may include tapers to structures, resembling GSG probes, to interface with the chips. In embodiments, chips may be wirebonded to connect them directly or indirectly to coax adapters/connectors 2614. In embodiments, elements such as interface structures 2614 may optionally be contained as part of network 2620 and/or become interfaced after network 2620 is placed over and/or around the chips. In embodiments, one or more further features and/or functions may be provided between the chips and/or interface structures 2614, for example in accordance with embodiments such as discussed in FIG. 1, to include phase compensators such as MMIC phase shifters, wirebond jumpered phase shifters, sliding coaxial phase shifters and/or the like.

According to embodiments, impedance transformers may be located between a chip and an interface to a higher level combiner, providing the chips and/or signal processors with reduced loss and/or greater bandwidths, by minimizing dielectric and resistive losses in semiconductor substrate suffered in on-chip impedance transformers, which may convert a low and/or complex impedance into a real impedance at 50 ohms on the chip. In embodiments, impedance transformers may contain a coaxial impedance transformer based on changing gaps between center conductors and outer conductors, diameters of the center conductors in the coax over a finite distance and/or in one or more discrete steps.

According to embodiments, impedance transformers may take the form of balloon transformers, and/or may take other electrical forms capable of transforming from a real impedance at approximately 30-70 ohms in a coax, for example approximately 50 ohms, to lower and/or higher real impedances as needed to reduce loss in signal processors of layer/and or module 2610. In embodiments, broadband string amplifier, traveling wave, and/or other amplifier die MMIC in GaN or GaAs may be constructed to have a piratical impedance transformer on chip and provide low near real impedances. In embodiments, leaving these die at 12.5 ohms can reduce the loss on the chip, and a coaxial based transformer may be employed to complete the transformation to 50 ohms at reduced total loss in the system.

According to embodiments, structures on layer 2610 with a substrate may include capacitors, resistors, bias controllers, feed networks, mounting pads or sockets, solders pads, and/or the like, for example constructed using thin film or thick film microelectronics. In embodiments, elements presented in FIG. 26B may be disposed in or on a monolithic semiconductor circuit, for example a microwave integrated circuit (MIC), MMIC, CMOS and/or SiGe die. In embodiments, chips 2612, such as amplifier chips, may be contained in a semiconductor device. In embodiments, elements to interface to higher level circuits, such as interfaces 2614, may be formed on a semiconductor wafer in one or more layers using the PolyStrata® process. In embodiments, interfaces 2614 may not be needed to apply layers disclosed in FIG. 26C and/or FIG. 26D, but may aid alignment, rework, testing, and/or modular construction.

Referring to FIG. 26C, an interwoven input and output combiner network is illustrated. To minimize loss, it is ideal to have a coax diameter larger than may be disposed between chips without adding significantly to the line lengths, one-dimensional and/or two-dimensional pitch of the chips and/or signal processors being combined. According to embodiments, a three-dimensional microstructure may be employed to leverage any of the combiner/divider approaches outlined herein, including cascading combiners in and out of plane with one or many quarter wave segments added to increase their bandwidth. In embodiments, cascading 1:2 or 1:N combiners may be chosen based on the layout desired. In embodiments, network 2620 may include input combiner network 2627 having two 1:2 combiners combined with inner 1:2 combiners. In embodiments, the combiners may be single stage Wilkinsons, which may provide sufficient bandwidth for the application illustrated. In embodiments, resistor mounting regions may be included. In embodiments, an output combiner network may include a 1:4 single stage Wilkinson, and chips 2612 in substrate may be arranged in two rows of two from front left to back right with the output ports of the chips facing each other. In embodiments, a relatively small 1:4 Wilkinson combiner may combine 4 chips, and 8 of them may be used in a first stage of combining.

According to embodiments, output port 2625 of 4-way combiner 2626 is repeated by symmetry for eight other output combiners on this level. In embodiments, input combiner network including cascading 1:2 Wilkinsons may come together in combiner 2624 and exit at coaxial output 2622, which may transition either out or up to a coaxial connector and/or waveguide interface with an e-probe adapter. As illustrated in one aspect of embodiments, two four way Wilkinson combiners 2630 may be contained in a higher tier, for example using larger uptapering than lower levels.

According to embodiments, the two four way combiners of FIG. 25D may couple to eight ports at 2625 (and the like) as illustrated in FIG. 26C. In embodiments, ports can be connected using integrated coaxial microconnectors, by soldering or transfer of conductive epoxy between the layers and/or any other joining process. In embodiments, two four way Wilkinson combiners may themselves be combined with a final 2-way Wilkinson combiner in the center of FIG. 26D and output employing a port (e.g., exiting in plane to the right). In embodiments, as in the input network, the termination can be to a coaxial connector, and e-probe to waveguide transition, and/or any other suitable I/O.

According to embodiments, multiple systems such as these could also be combined, for example, in a waveguide combiner network placed above them with e-probe feeds for the input and output waveguide region or regions. In embodiments, combiner layers may take different distributions, use different combiners, and/or be put in more or less layers. In embodiments, they may be held in mechanical alignment with respect to each other using a thermomechanical mesh, for example as shown in FIG. 11, which may be formed around them at the same time or in a separate operation but which may provide ease of handling, assembly, robustness, and may acts as a thermal heat sink In embodiments, it may also house shielded or unshielded DC or RF signal, power or control lines in its mesh supported by dielectrics.

According to embodiments, fluid cooling may be provided under the substrate, and/or the mesh itself may include cooling channels for fluids, gasses, or liquids, and/or may include heat-pipes, as well as solid metal cooling structures. In embodiments, part or all of a mesh and part or all of a circuit may be immersed in a cooling fluid and/or include a phase change system such as used in heat pipe technology, employ inert fluids and/or refrigerants.

According to embodiments, division into multiple permanent and/or reworkable layers may be provided by returning to FIG. 12, for example, containing the substrate 1250, devices 1270 and/or interconnect transitions 1260, followed by a two layer coax and/or waveguide combiner/divider network such as 1240, further followed by a third tier final combiner stage in one, two, or more layers of coax and/or combiner/divider networks 1230. In embodiments, final input and output coax connectors and/or waveguide interfaces may be provided, for example 1210 and/or 1220. In embodiments, correlations between one or more aspects of embodiments may be made, such as between FIGS. 11-13 and 26 as one example.

According to embodiments, any configuration for a phase adjuster may be employed. Referring to example FIG. 26, a phase adjuster is illustrated in accordance with embodiments. In embodiments, an adjustable phase compensator approach using a microstrip mode in a dielectric and/or high-resistivity substrate 2710, for example on fused silica ($SiO_2$), $Al_2O_3$ and/or MN. In embodiments, a wirebondable metal, such as Cr/Au or Cr/Ni/Au, may be deposited and/or patterned on the surface of substrate 2710. In embodiments, substrate 2710 may include one or more ports, for example input and output ports 2723 and 2724, which may be employed to wirebond it and/or interface it to a circuit.

According to embodiments, one or more segments 2721, 2722, 2725 and 2726, and/or the like, may be and jumpered into different circuit path lengths using a series of wirebonds, for example wirebonds 2631, 2632, 2633, 2634, 2635 and/or 2636. In embodiments, bridging more or less of thin film segments in a variety of discrete electrical path lengths may be achieved to provide a determined phase delay. In embodiments, a single substrate may be inserted before an electronic device, for example a power amplifier, to correct its phase in relation to other power amplifiers in the same circuit. In embodiments, a phase adjuster may be provided on an input side directly before an amplifier and/or before an impedance transformer feeding an amplifier. In embodiments, it may be provided with any further adaptations as required and/or desired it and/or interface it to a circuit.

Figure 28A:
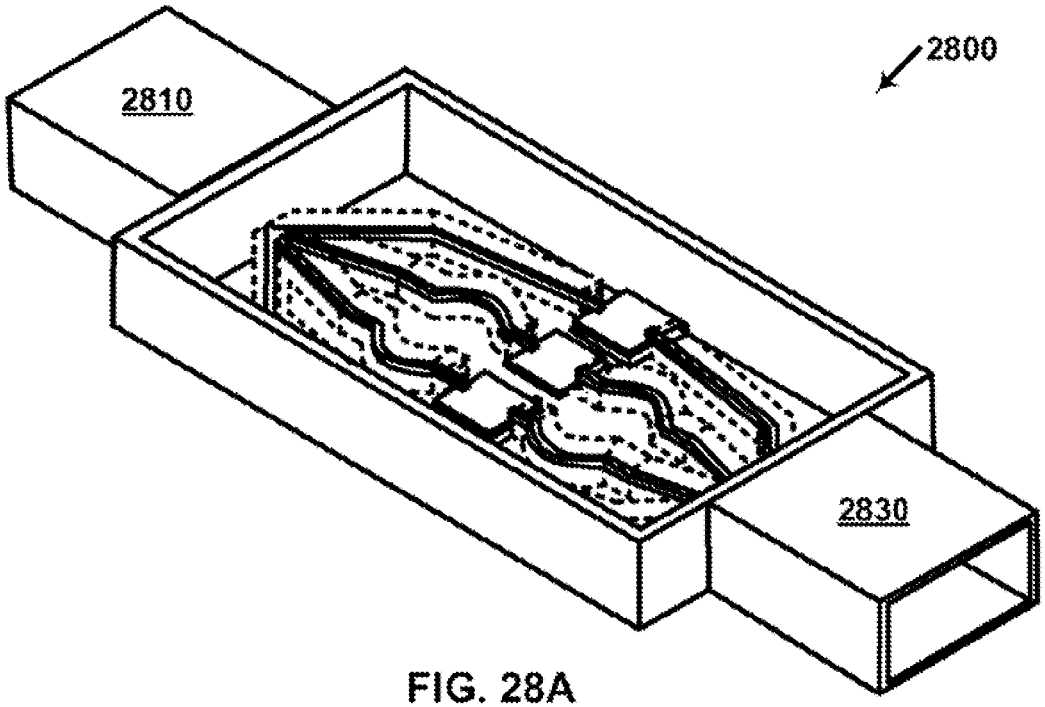
FIGS. 28A to 29 illustrate n-way three-dimensional coaxial combiner/divider microstructure including an e-probe in accordance with one aspect of embodiments.
Figure 28B:
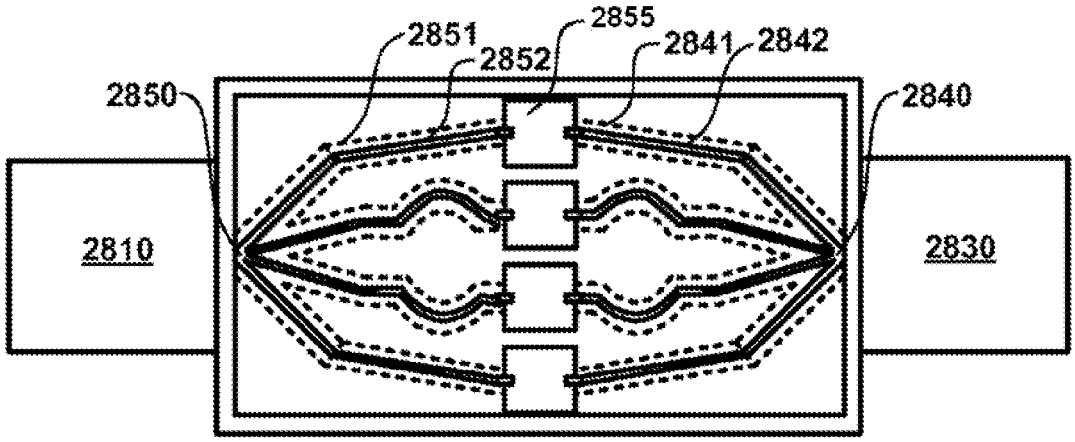
Figure 28C:
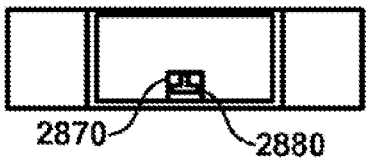

FIG. 28A to FIG. 28C illustrate an example modular n-way power amplifier 2800 that employs a combiner/splitter microstructure network as per at least one aspect of the present invention. FIG. 28A is a perspective view of example apparatus 2800. FIG. 28B is a plain view from above showing an example meandering divider/combiner network structure. FIG. 28C is an end view of apparatus 2800 showing antenna 2800 passing through opening 2870.

As illustrated, this example embodiment has a waveguide configuration 2810 and 2830 on each end of apparatus 2800 used as a signal input and output. For the purpose of description, this circuit will be described with waveguide 2810 as the input and waveguide 2830 as the output. However, one skilled in the art will recognize that the circuit could be configured with different orientations.

Following one leg of this example modular n-way power amplifier 2800, a signal may enter the structure through waveguide 2810 to divider/combiner network structure 2850. The signal may pass down microstructure element 2852 to signal processor 2855. According to embodiments, microstructure element 2852 may be an inner conductor of a coaxial structure. According to embodiments, microstructure element 2851 may be an outer conductor of a coaxial structure. A processed version of the signal may exit signal processor 2855 and may pass down microstructure element 2842 to divider/combiner network structure 2840. According to embodiments, microstructure element 2842 may be an inner conductor of a coaxial structure. According to embodiments, microstructure element 2841 may be an outer conductor of a coaxial structure. According to embodiments, the various legs of divider/combiner network structures 2840 and 2850 may meander. According to embodiments, the meandering may be configured to modify the relative path lengths between the legs of divider/combiner network structures 2840 and 2850. According to embodiments, the meandering may be configured for physical routing considerations. According to embodiments, the path length variations may be compensated for phase inconsistencies between the various legs of divider/combiner network structures 2840 and 2850. According to embodiments, the signal my pass from divider/combiner network structures 2840 into waveguide structure 2830 employing antenna 2880. Pallet 2800 may be configured to enable antenna 2800 to radiate into free space, into a waveguide or the like.

Figure 29:
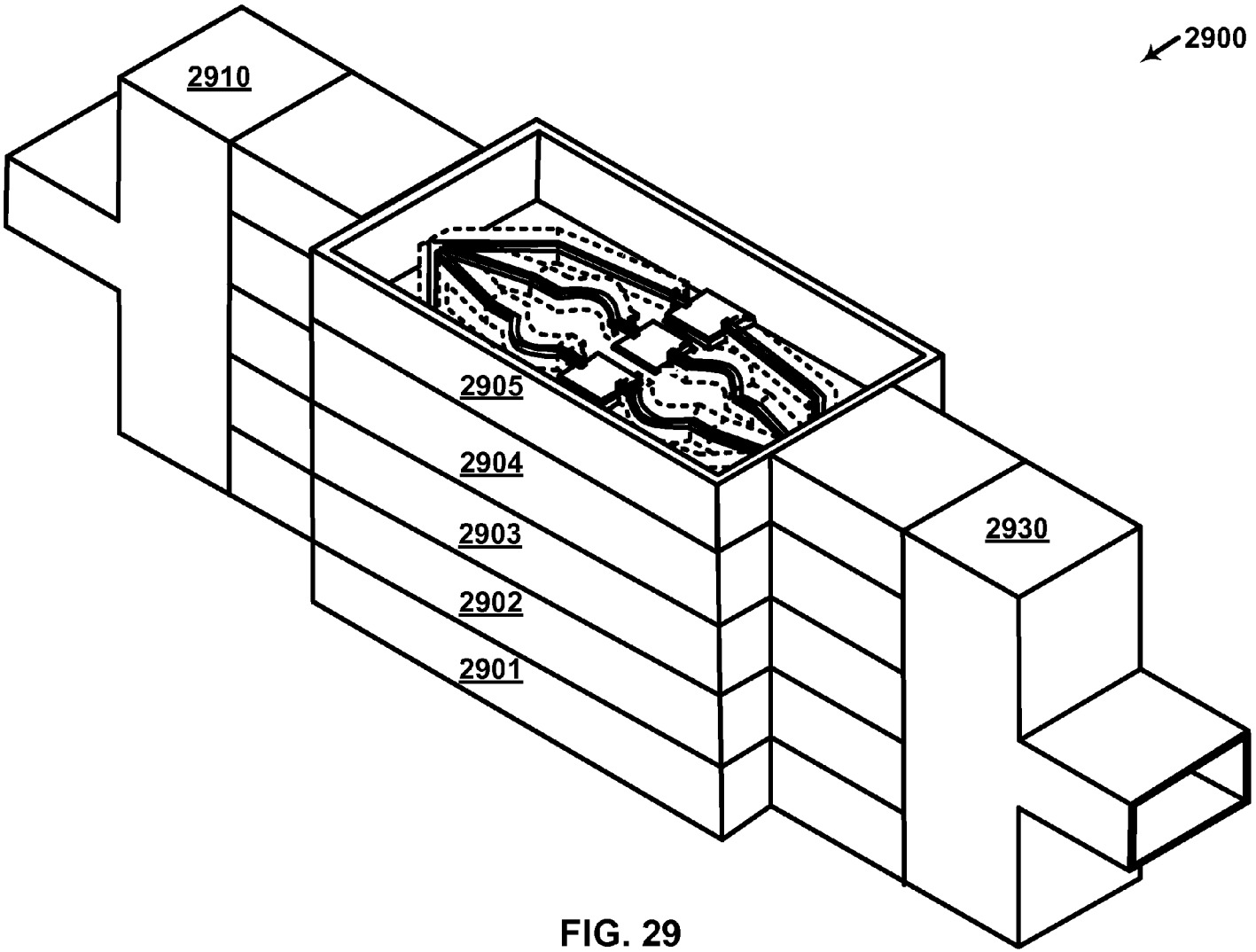

FIG. 29 is an illustration of a series of stacked modular n-way power amplifiers 2901 through 2905 as per an aspect of an embodiment of the present invention. At least one of the stacked modular n-way power amplifiers 2901 through 2905 may be similar to example modular n-way power amplifiers 2800. According to embodiments, at one or both end of the stack 2900, there may be an n-way waveguide combiner 2910 and/or 2930 configured to enable a multitude of pallets (e.g. 2901 through 2905) to combine or split signal employing a single mode waveguide at a target frequency band.

FIG. 30 is an example stacked n-way three-dimensional coaxial combiner/divider microstructure illustrated in accordance with one aspect of embodiments. This embodiment is similar to the 4-stage 4-way three-dimensional coaxial combiner/divider microstructure illustrated in FIG. 6. Whereas in FIG. 6, the example n-way three-dimensional coaxial combiner/divider microstructure is laid out in a horizontal planar format, this embodiment is stacked in a vertical format. According to some embodiments, microstructural elements 3010, 3020 and 3040 and/or 3030 (not shown) in FIG. 30 are equivalent to microstructural elements 611, 612, 613 and 614 in FIG. 6 in terms of being coaxial feed lines entering a 4-way multistage Wilkinson power combiner/divider. According to some embodiments, microstructural element 3050 in FIG. 30 is equivalent to microstructural elements 662 in FIG. 6 in terms of being a combined output port or divided input port. According to some embodiments, microstructural elements 3001, 3002, 3003 and 3004 may include connections from the inner conductor of each leg to resistive elements for each of the legs. In FIG. 30, these legs 3001 to 3004 are half wave routings into a 4-way resistor located in the center of each. In FIG. 6, the half wave routing is not needed as the resistor is able to short the coaxial lines directly at locations 620, 630, 640 and 650. Each microstructural element 3001, 3002, 3003 and 3004 may include a star resistor equivalent to 690 in FIG. 6 located in a central region similar to the resistor mounting regions of FIG. 25B or 25D. The resistors may be formed monolithically during the formation of the microstructure 3000 or microstructure 3000 may be formed in multiple pieces that are divided at a lower surface of 3001, 3002, 3003, and 3004 wherein the resistors are mounted in these parts and then the parts are assembled into a stack and bonded using any suitable methods such as solder, conductive epoxy, gold fusion bonding, anisotropic conductive adhesive or similar. This example 4-stage 4-way Wilkinson power divider/combiner includes 4 segments/sections. As illustrated, these sections are located in each of pillars 3080, 3081, 3082 and 3083 of this example embodiment. For example, microstructural elements 3053, 3043, 3033 and 3023 in pillar 3083 may include the functionality of respectively leg elements 653, 643, 633, and 623. The three remaining pillars 3080, 3081 and 3082 are each constructed with similar elements and include functionality of respectively leg elements in FIG. 6. For example, microstructural elements in pillar 3081 may include the functionality of respectively leg elements 621, 631, 641 and 651. By symmetry the relationships in the other legs should be obvious to one skilled in the art. According to some embodiments, signals may meander up structure 3000 in many ways, including through portions of structures 3001, 3002, 3003, and/or 3004 as well as through portions of the outside pillars. In FIG. 30 quarter wave segments are located between 3023 and 3033, between 3033 and 3043, between 3043 and 3053, and between 3053 and central output or input port 3050.

These correspond to the quarter wave segments 623, 633, 643 and 653 in FIG. 6. In FIG. 30 sections 3001, 3002, 3003 and 3004 may have different configuration and different resistor values and may be determined through software simulation such as through Ansoft's Designer™, HFSS™ or Agilent's ADS™. While lambda/2 segments are shown in FIG. 30, alternative resistor mounting methods which do not require lambda/2 segments, such as shown in FIG. 3B could be used with alternative routings to produce a multi-stage stacked structure similar to FIG. 30.

FIG. 31 illustrates a transition structure 3100 in accordance with one aspect of embodiments. Transition structure 3100, as illustrated, is a transition/interconnection that switches a three-dimensional coaxial microstructure to an RF line, for example, a coplanar waveguide line (CPW) or microstrip line. This transition may be optimized using software such as Ansoft's HFSS® to reduce the transition loss. Inner conductor 3130 makes a downward Z-transition from a three-dimensional coaxial to connect to the signal line of the RF line using foot 3172. Grounding microstructure feet 3171 and 3173 connect to the ground of an RF line. A dielectric material may be located between the center conductor feet 3172 and center conductor 3130 as is shown at 3160 and 3170. The dielectric is located between outer conductor foot 3171 and 3173 and outer conductor ground 3150 and is shown as 3170. The dielectric may be configured to stop solder and conductive epoxy upward flow and/or provide mechanical stability of the center conductor. A second dielectric 3160 may be located at the top of the center conductor 3130 to minimize the upward and lateral motion.

As presented herein, an n-way three dimensional microstructural divider/combiner may be manufactured in a process, such as the PolyStrata® process or other microfabrication technique for creating coaxial quasi-coaxial microstructures. In embodiments, any suitable process may be employed, for example a lamination, pick-and-place, transfer-bonding, deposition and/or electroplating process. Such processes may be illustrated at least at U.S. patent and U.S. patent application Nos. incorporated herein by reference.

According to embodiments, for example, a sequential build process including one or more material integration processes may be employed to form a portion and/or substantially all of an apparatus. In embodiments, a sequential build process may be accomplished through processes including various combinations of: (a) metal material, sacrificial material (e.g., photoresist), insulative material (e.g., dielectric) and/or thermally conductive material deposition processes; (b) surface planarization; (c) photolithography; and/or (d) etching or other layer removal processes. In embodiments, plating techniques may be useful, although other deposition techniques such as physical vapor deposition (PVD) and/or chemical vapor deposition (CVD) techniques may be employed.

According to embodiments, a sequential build process may include disposing a plurality of layers over a substrate. In embodiments, layers may include one or more layers of a dielectric material, one or more layers of a metal material and/or one or more layers of a resist material. In embodiments, a support structure may be formed of dielectric material. In embodiments, a support structure may include an anchoring portion, such as a aperture extending at least partially there-through. In embodiments, a microstructural element, such as a first conductor and/or a second conductor, may be formed of a metal material. In embodiments, one or more layers may be etched by any suitable process, for example wet and/or dry etching processes.

According to embodiments, a metal material may be deposited in an aperture of a microstructural element, affixing one or more microstructural elements together and/or to a support structure. In embodiments, sacrificial material may be removed to form a non-solid volume. In embodiments, a non-solid volume may be filled with dielectric material, and/or insulative material may be disposed between a first microstructural element and a second microstructural element and/or the like.

According to embodiments, for example, any material integration process may be employed to form a part and/or all of an apparatus. In embodiments, for example, transfer bonding, lamination, pick-and-place, deposition transfer (e.g., slurry transfer), and/or electroplating on and/or over a substrate layer, which may be mid-build of a process flow, may be employed. In embodiments, a transfer bonding process may include affixing a first material to a carrier substrate, patterning a material, affixing a patterned material to a substrate, and/or releasing a carrier substrate. In embodiments, a lamination process may include patterning a material before and/or after a material is laminated to a substrate layer and/or any other desired layer. In embodiments, a material may be supported by a support lattice to suspend it before it is laminated, and then it may be laminated to a layer. In embodiments, a material may be selectively dispensed.

The exemplary embodiments described herein in the context of a coaxial transmission line for electromagnetic energy may find application, for example, in the telecommunications industry in radar systems and/or in microwave and millimeter-wave devices. In embodiments, however, exemplary structures and/or processes may be used in numerous fields for microdevices such as in pressure sensors, rollover sensors;

mass spectrometers, filters, microfluidic devices, surgical instruments, blood pressure sensors, air flow sensors, hearing aid sensors, image stabilizers, altitude sensors, and autofocus sensors.

Therefore, it will be obvious and apparent to those skilled in the art that various modifications and variations can be made in the embodiments disclosed. Thus, it is intended that the disclosed embodiments cover the obvious and apparent modifications and variations, provided that they are within the scope of the appended claims and their equivalents.

What is claimed is:

1. An apparatus comprising:

a) a first power combiner/divider network configured to split a first electromagnetic signal into a plurality of split electromagnetic signals, at least two of said split electromagnetic signals each connectable to at least one input of a plurality of signal processors;

b) a second power combiner/divider network configured to combine at least two of a plurality of processed electromagnetic signals into a second electromagnetic signal, at least two of said plurality of processed electromagnetic signals each connectable to at least one output of said plurality of signal processors;

c) wherein at least a portion of at least one of said first power combiner/divider network and said second power combiner/divider network includes a three-dimensional coaxial microstructure;

d) at least one phase adjuster disposed between said first power combiner/divider network and said second power combiner/divider network; and e) wherein said apparatus includes at least one of the following:

i) at least one tiered portion of at least one of said first power combiner/divider network and said second power combiner/divider network;

ii) at least one portion of at least one of said first power combiner/divider network and said second power combiner/divider network constructed as a mechanically releasable module; and iii) at least said second power combiner/divider network includes said three-dimensional coaxial microstructure and at least one of the following:

(1) a waveguide power combiner/divider;

(2) a spatial power combiner/divider; and (3) an electric field probe.

2. The apparatus of claim 1, wherein said apparatus includes each of:

i) said at least one tiered portion of at least one of said first power combiner/divider network and said second power combiner/divider network;

ii) said at least one phase adjuster disposed between said first power combiner/divider network and said second power combiner/divider network;

iii) said at least one portion of at least one of said first power combiner/divider network and said second power combiner/divider network constructed as a mechanically releasable module;

iv) said at least said second power combiner/divider network including said three-dimensional coaxial microstructure and at least one of the following:

(1) a waveguide power combiner/divider;

(2) a spatial power combiner/divider; and (3) an electric field probe.

3. The apparatus according to claim 1, wherein at least one of said first power combiner/divider network and said second power combiner/divider network includes at least one n-way three-dimensional coaxial microstructure.

4. The apparatus according to claim 3, wherein said at least one n-way three-dimensional coaxial microstructures includes at least one of the following:

a) m ports; and b) n legs connected to said port.

5. The apparatus according to claim 4, further comprising an electrical path containing at least one resistive element between at least two of said n legs.

6. The apparatus according to claim 3, wherein said at least one n-way three-dimensional coaxial microstructures includes at least one of the following:

a) a 1:4 way three-dimensional coaxial microstructure; and b) a 1:6 way three-dimensional coaxial microstructure.

7. The apparatus according to claim 3, wherein at least two of said at least one n-way three-dimensional coaxial microstructures are on different vertical tiers.

8. The apparatus according to claim 3, wherein at least one of said at least one n-way three-dimensional coaxial microstructures is on a different vertical tier than at least one of said plurality of signal processors.

9. The apparatus according to claim 3, wherein at least one electrical path is a fraction of an operation wavelength.

10. The apparatus according to claim 1, wherein at least one of said first power combiner/divider network and said second power combiner/divider network includes at least one the following:

a) a Wilkinson power combiner/divider;

b) a Gysel combiner/divider;

c) a combination thereof.

11. The apparatus according to claim 1, wherein at least a portion of at least one of said first power combiner/divider network and said second power combiner/divider network includes at least one of the following:

a) a H tree architecture;

b) a X tree architecture;

c) a multi-layer architecture;

d) a planar architecture; and e) combinations thereof.

12. The apparatus according to claim 1, wherein at least a portion of said first power combiner/divider network and at least a portion of said second power combiner/divider network are inter-disposed.

13. The apparatus according to claim 1, wherein at least a portion of said first power combiner/divider network and at least a portion of said second power combiner/divider network are inter-disposed horizontally and vertically.

14. The apparatus of claim 1, wherein a substrate of at least one of said plurality of signal processors is different than a substrate of at least one of the following:

a) said first power combiner/divider network; and b) said second power combiner/divider network.

15. The apparatus according to claim 1, wherein said phase adjuster is part of a jumper.

16. The apparatus according to claim 1, wherein said phase adjuster includes a wire bond jumper configured to change a path length.

17. The apparatus according to claim 1, wherein said phase adjuster includes a variable sliding structure configured to change a path length.

18. The apparatus of claim 1, further including at least one transition structure configured to connect to at least one of said plurality of signal processors through a coaxial to planar transmission line structure.

19. The apparatus of claim 18, wherein at least one of said at least one transition structure is an independent structure.

20. The apparatus according to claim 1, wherein said mechanically releasable module includes at least one of the following:

a) a heat sink;

b) a MMIC; and c) a three-dimensional microstructure backplane.

21. The apparatus of claim 1, wherein at least one of said first power combiner/divider network and said second power combiner/divider network includes at least two antennas disposed inside a common waveguide.

22. The apparatus of claim 21, wherein at least one of said at least two antennas is an electric field probe.

23. The apparatus according to claim 1, wherein said apparatus includes an impedance matching portion.

24. The apparatus according to claim 23, wherein said impedance matching portion includes at least one of the following:

a) a tapered portion of said three-dimensional coaxial microstructure;

b) an impedance transformer;

c) an open-circuited stub; and d) a short-circuited stub.

25. The apparatus of claim 1, wherein a down taper is disposed to pass at least one of said plurality of split electromagnetic signals.

26. The apparatus of claim 1, wherein an up taper is disposed to pass at least one of said plurality of processed electromagnetic signals.

27. The apparatus of claim 1, wherein said signal processor is a semiconductor device.

28. The apparatus of claim 1, wherein said signal processor is an amplifier.

29. An apparatus comprising:

a) a first power combiner/divider network configured to split a first electromagnetic signal into a plurality of split electromagnetic signals, at least two of said split electromagnetic signals each connectable to at least one input of a plurality of signal processors;

b) a second power combiner/divider network configured to combine at least two of a plurality of processed electromagnetic signals into a second electromagnetic signal, at least two of said plurality of processed electromagnetic signals each connectable to at least one output of said plurality of signal processors;

c) wherein at least a portion of at least one of said first power combiner/divider network and said second power combiner/divider network includes a three-dimensional coaxial microstructure; and d) wherein said apparatus includes at least one of the following:

i) at least one tiered portion of at least one of said first power combiner/divider network and said second power combiner/divider network;

ii) at least one phase adjuster disposed between said first power combiner/divider network and said second power combiner/divider network;

iii) at least one portion of at least one of said first power combiner/divider network and said second power combiner/divider network constructed as a mechanically releasable module; and iv) at least said second power combiner/divider network includes said three-dimensional coaxial microstructure and at least one of the following:

(1) a waveguide power combiner/divider;

(2) a spatial power combiner/divider; and (3) an electric field probe;

wherein at least one of said first power combiner/divider network and said second power combiner/divider network includes at least one n-way three-dimensional coaxial microstructure that includes at least one of: a) m ports and b) n legs connected to said port; and wherein at least two of said at least one n-way three-dimensional coaxial microstructures are cascading.

30. The apparatus according to claim 29, wherein at least two of said at least one cascading n-way three-dimensional coaxial microstructures are on different vertical tiers.

31. A method comprising:

a) splitting a first electromagnetic signal into a plurality of split electromagnetic signals;

b) transitioning at least one of said plurality of split electromagnetic signals to at least one signal processor;

c) combining at least two of a plurality of processed electromagnetic signals from said signal processor into a second electromagnetic signal; and d) wherein said method employs a three-dimensional coaxial microstructure comprising at least one phase adjuster disposed between said first power combiner/divider network and said second power combiner/divider network and at least one of the following:

i) at least one tiered portion of at least one of said first power combiner/divider network and said second power combiner/divider network;

ii) at least one portion of at least one of said first power combiner/divider network and said second power combiner/divider network constructed as a mechanically releasable module; and iii) at least said second power combiner/divider network includes said three-dimensional coaxial microstructure and at least one of the following:

(1) a waveguide power combiner/divider;

(2) a spatial power combiner/divider; and (3) an electric field probe.

32. An n-way three-dimensional coaxial microstructure comprising:

a) m ports; and b) n legs connected to said port; and c) wherein an electrical path includes at least one resistive element between at least two of said n legs, said at least one resistive element formed in a same vertical tier of an apparatus as at least one of said legs.

* * * * *